US010308057B2

(12) United States Patent
Tsutsui et al.

(10) Patent No.: US 10,308,057 B2
(45) Date of Patent: Jun. 4, 2019

(54) TRANSFER MATERIAL, PRINTED MATERIAL, AND MANUFACTURING METHOD FOR PRINTED MATERIAL

(71) Applicant: CANON FINETECH NISCA INC., Misato-shi (JP)

(72) Inventors: Takahiro Tsutsui, Matsudo (JP); Yusuke Sumikawa, Kashiwa (JP); Hiromitsu Hirabayashi, Yokohama (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/823,792

(22) Filed: Nov. 28, 2017

(65) Prior Publication Data

US 2018/0154669 A1 Jun. 7, 2018

(30) Foreign Application Priority Data

Dec. 2, 2016 (JP) ..... 2016-234907
Oct. 4, 2017 (JP) ..... 2017-194484

(51) Int. Cl.
*B41M 5/52* (2006.01)
*B41M 3/12* (2006.01)
(Continued)

(52) U.S. Cl.
CPC ..... *B41M 5/5218* (2013.01); *B41M 3/12* (2013.01); *B41M 5/502* (2013.01); *B44C 1/172* (2013.01); *B44C 1/1712* (2013.01)

(58) Field of Classification Search
CPC ..... B41M 5/5218; B41M 5/502; B41M 3/12; B44C 1/172
See application file for complete search history.

(56) References Cited

U.S. PATENT DOCUMENTS 4,514,457 A * 4/1985 Sasaki ..... B41M 3/12 428/172
5,232,527 A * 8/1993 Vernhet ..... B41M 3/12 156/67

(Continued)

FOREIGN PATENT DOCUMENTS

JP S56-120508 A 9/1981
JP H04-189200 A 7/1992

(Continued)

OTHER PUBLICATIONS

"Geometrical product specifications—Surface Texture: Areal; Part 6: Classification of methods for measuring surface texture," International Standard, ISO 25178-6 (2010).

(Continued)

*Primary Examiner* — Nathan L Van Sell
(74) *Attorney, Agent, or Firm* — Venable LLP

(57) ABSTRACT

The present invention simplifies structures of a transfer material and a printed material both having an image based on a three-dimensional micro-structure, making manufacture of the materials more efficient and reducing prices thereof. An ink receiving layer and an adhesive are provided on a substrate of the transfer material. The ink receiving layer is of an air gap absorption type and has an image based on a three-dimensional micro-structure. Aggregates of the adhesive are discretely arranged on a front surface of the ink receiving layer.

6 Claims, 20 Drawing Sheets

(51) Int. Cl.
*B41M 5/50* (2006.01)
*B44C 1/17* (2006.01)

(56) References Cited

U.S. PATENT DOCUMENTS

| | | | | |
|---|---|---|---|---|
| 5,597,618 | A * | 1/1997 | Bayer, Jr. | B05C 1/06 118/210 |
| 6,667,080 | B2 | 12/2003 | Inamoto | |
| 8,399,076 | B2 | 3/2013 | Watanabe et al. | |
| 9,789,677 | B2 | 10/2017 | Tsutsui et al. | |
| 2005/0070433 | A1* | 3/2005 | Hirota | B41M 7/0027 503/227 |
| 2006/0281847 | A1 | 12/2006 | Furutachi et al. | |
| 2008/0233324 | A1* | 9/2008 | Lee | B41M 3/12 428/40.1 |
| 2009/0033730 | A1* | 2/2009 | Shino | B41M 5/00 347/102 |
| 2010/0032083 | A1* | 2/2010 | Oliveira | B44C 1/17 156/240 |
| 2011/0045248 | A1* | 2/2011 | Hoffmuller | B41M 1/04 428/156 |
| 2011/0111157 | A1* | 5/2011 | Onderisin | B31D 1/027 428/41.8 |
| 2014/0175707 | A1* | 6/2014 | Wolk | B29C 35/0894 264/447 |
| 2015/0042737 | A1* | 2/2015 | Tsutsui | B41M 5/502 347/105 |
| 2016/0288468 | A1 | 10/2016 | Tsutsui et al. | |
| 2017/0157910 | A1 | 6/2017 | Sumikawa et al. | |
| 2017/0210123 | A1 | 7/2017 | Sumikawa et al. | |
| 2017/0320347 | A1 | 11/2017 | Staub et al. | |

FOREIGN PATENT DOCUMENTS

| | | | |
|---|---|---|---|
| JP | H05-016015 | A | 1/1993 |
| JP | 2001-213073 | A | 8/2001 |
| JP | 2003-181990 | A | 7/2003 |
| JP | 2003-251920 | A | 9/2003 |
| JP | 2005-238674 | A | 9/2005 |
| JP | 2009-107241 | A | 5/2009 |
| JP | 2013-039791 | A | 2/2013 |
| JP | 2013-136156 | A | 7/2013 |
| JP | 5944947 | B2 | 7/2016 |
| JP | 2017-132123 | A | 8/2017 |
| JP | 2018-506446 | A | 3/2018 |
| WO | 2016/092044 | A1 | 6/2016 |

OTHER PUBLICATIONS

Gulari, et al., "Photon correlation spectroscopy of particle distributions," J. Chem. Phys., 70(8), Apr. 15, 1979, 3965-3972.

Oct. 2, 2018 Japanese Office Action, in Japanese Patent Application No. 2017-194484.

* cited by examiner

TRANSFER MATERIAL, PRINTED MATERIAL, AND MANUFACTURING METHOD FOR PRINTED MATERIAL

BACKGROUND OF THE INVENTION

Field of the Invention

The present invention relates to a transfer material on which an image can be printed, a printed material to which the transfer material is transferred, and a manufacturing method for the printed material. The print material of the present invention can be used, for example, for labels, IC cards, packaging materials, and construction materials, and in other various fields.

Description of the Related Art

In recent years, security of printed materials and printed images has been desired to be improved. To prevent forgery and duplication of printed images, for example, multi-printing is performed by adding a hologram image to a printed image and various pieces of information are additionally printed on the printed image (additional printing) as needed.

Japanese Patent Laid-Open No. H04-189200(1992) describes a bondable transfer foil. The transfer foil includes a substrate sheet having a recessed and protruding front surface, and the substrate sheet has a peel-off layer, a thin-film layer, a picture layer on which an image is printed, and a bonding layer; the layers are sequentially formed on the substrate sheet. The thin-film layer is formed like a thin film on a front surface of the substrate sheet by deposition, ion plating, sputtering, or the like, using a metal compound. Thus, on the thin-film layer, an image (hologram image) is formed that has a recessed-and-protruding three-dimensional micro-structure corresponding to the front surface of the substrate sheet. A picture layer is formed by printing an image on such a thin-film layer by gravure printing, screen printing, or the like.

For the transfer foil described in Japanese Patent Laid-Open No. H04-189200(1992), the metal thin-film layer needs to be formed on the recessed and protruding front surface of the substrate sheet by deposition or the like. Moreover, on the thin-film layer, the image for the picture layer needs to be printed by a particular method such as gravure printing, inhibiting the use of a general-purpose ink jet printing apparatus or the like. This results in a complicated structure and reduced manufacturing efficiency of the transfer coil, and thus an increased price of the transfer coil.

Furthermore, for such a transfer foil, after the image for the picture layer is printed, a bonding layer needs to be formed on the image. That is, a process for forming the bonding layer intervenes between printing of the desired image and transfer. This inhibits the desired image from being printed immediately before the transfer. Furthermore, the thin-film layer forming the image based on the three-dimensional micro-structure is a metal film, thus possibly reducing visibility of the image of the picture layer overlapping the image of the thin-film layer.

SUMMARY OF THE INVENTION

The present invention simplifies structures of a transfer material and a printed material both having an image based on a three-dimensional micro-structure, making manufacture of the materials more efficient and reducing prices thereof.

In an aspect of the present invention, there is provided a transfer material, including:

a substrate;

an ink receiving layer provided on the substrate, the ink receiving layer being of an air gap absorption type and having an image based on a three-dimensional micro-structure; and an adhesive including aggregates discretely disposed on surface of the ink receiving layer.

In the transfer material of the present invention, an image may be printed on a front surface of an ink receiving layer that is opposite to a substrate using an ink jet method or the like. In the transfer material of the present invention, a bonding layer is formed on the front surface of the ink receiving layer, enabling the transfer material to be bonded to an image support. The use of the transfer material of the present invention allows acquisition of a printed material having an image based on three-dimensional micro-structure that is visible both before and after peel-off of the substrate, and also having a printed image with high weatherability. The image based on the three-dimensional micro-structure is visible based on a difference in optical refractive index between two layers defining a boundary for the image (the ink receiving layer and a substrate-side layer), and has a function to prevent a printed material from being forged.

In the transfer material of the present invention, the ink receiving layer and the substrate are allowed to function as a protective layer for a first image by printing the first image on the front surface of the ink receiving layer opposite to a surface thereof that contacts the substrate, and transferring the transfer material such that the front surface faces the image support. As a result, the weatherability of the first image may be improved. For example, in a case where the substrate of the transfer material is peeled off, a recessed and protruding portion of the image based on the three-dimensional micro-structure of the ink receiving layer is positioned on a front surface of the printed material, and a second image is printed on the front surface of the printed material, then the recessed and protruding portion of the image based on the three-dimensional micro-structure protects the second image from scratching.

In the transfer material of the present invention, the ink receiving layer has a higher ink absorption speed than an adhesive, allowing ink on a surface of the adhesive to be quickly drawn and absorbed into the ink receiving layer. Consequently, in a case where an image is printed, the ink is quickly absorbed into the ink receiving layer, making a color material of the ink less likely to remain on the surface of the adhesive.

A portion of the ink comes into contact with the front surface of the ink receiving layer, which has a higher ink absorption speed than the adhesive, and thus, the ink present on the surface of the adhesive or inside the adhesive is quickly drawn into the ink receiving layer. The ink absorbed through the front surface of the ink receiving layer sequentially permeates the inside of the ink receiving layer, and is absorbed while spreading in a film thickness direction and a layer surface direction, according to permeation anisotropy of the ink receiving layer.

The permeation anisotropy of the ink receiving layer is designed to allow spread of dots of the ink to be appropriately controlled. That is, in a case where relatively large ink dots are needed, permeability is set higher in the layer surface direction than in the film thickness direction. In contrast, in a case where relatively small ink dots are needed and the absorbable amount of ink is to be increased, permeability is set higher in the film thickness direction than in the layer surface direction, and the ink receiving layer is configured to be thicker. To improve productivity of the ink receiving layer while inhibiting the ink receiving layer from being provided with permeation anisotropy so as to allow the ink to infiltrate isotropically, permeability of the ink receiving layer as a whole is controlled so as to allow ink dots to spread in a desired manner. Specifically, the film thickness and the like are adjusted according to the desired absorbable amount of ink.

In a case where the ink receiving layer has a higher ink absorption speed than the adhesive, the ink is less likely to remain on the surface of the adhesive, allowing a bonding capability to be maintained. Moreover, the spread of the ink in the ink receiving layer may be appropriately controlled to allow suppression of bleeding of the image and a decrease in print resolution, while enabling print characteristics of the image to be improved.

The adhesive is locally provided so as not to cover the entire front surface of the ink receiving layer, which serves as a print surface for the image, with parts of the front surface of the ink receiving layer left exposed directly to outside. Consequently, a portion of the ink applied to the print surface is brought into direct contact with the front surface of the ink receiving layer, which has a high absorption speed, to allow the ink to be absorbed into the ink receiving layer in a bypassing manner without passing through the adhesive. As a result, the ink is less likely to remain on the surface of the adhesive, which has a low ink absorption speed, or inside the adhesive. The ink for ink jet printing has surface tension and viscosity thereof appropriately controlled. Thus, once a portion of the ink having come into contact with an exposed portion of the ink receiving layer after bypassing movement starts to be absorbed into an ink absorbing layer, which has a high ink absorption speed, the remaining portion of the ink continuous with the above-described portion are sequentially and uninterruptedly drawn into the ink receiving layer. That is, the ink having landed on the surface of the adhesive is sequentially absorbed into the ink absorbing layer, which has a high ink absorption speed, and is unlikely to remain on the surface of the adhesive or inside the adhesive, so long as the ink is continuous with a portion of the ink having come into contact with the exposed portion of the ink receiving layer after bypassing movement.

The ink absorbed through the exposed portion of the ink receiving layer permeates the inside of the ink receiving layer to form desired ink dots according to the appropriately designed permeation anisotropy of the ink receiving layer. In the ink receiving layer, the ink infiltrates and spreads according to the permeability of the ink receiving layer, allowing ink dots to be also formed below the adhesive to achieve proper print characteristics.

Aggregates of the adhesive included in the bonding layer is discretely provided on the front surface of the ink receiving layer so that the externally exposed portions remain on the front surface of the ink receiving layer. Consequently, as described above, the ink receiving layer may quickly absorb the ink. As a result, ink dots may also be formed in the area of the ink receiving layer including an area below the adhesive, and the ink is less likely to remain on the surface of the adhesive or inside the adhesive, thus reducing the likelihood of improper bonding. As a result, both proper print characteristics and proper bonding capability may be achieved.

In particular, inorganic particulates may be bound together with a binder of a water-soluble resin to allow the ink receiving layer provided with air gaps to hold the air gap structure even after bonding (transfer) between the transfer material and the image support. Thus, the ink receiving layer may hold the absorbed ink inside even in a case where the adhesive and the binder are melted during transfer, and allows vapor generated during transfer to be sealed inside the ink receiving layer. As a result, the bonding between the transfer material and the image support is further improved. Moreover, the aggregates of pieces of the adhesive are discretely disposed on the front surface of the ink receiving layer like islands, with a plurality of sea portions provided on the front surface in communication with the bonding layer. Then, in a case where the bonding layer and the image support are allowed to adhere to each other, air may be discharged through the sea portions, preventing possible air traps during transfer.

A three-dimensional image may be formed on the ink receiving layer by inverting an image based on the three-dimensional micro-structure to be formed on the ink receiving layer (hereinafter referred to as the "three-dimensional image") to provide a three-dimensional image (the image based on the three-dimensional micro-structure) on the substrate, and covering the three-dimensional image on the substrate with an ink receiving layer of an air gap absorbing type. The ink receiving layer has an optical refractive index different from the optical refractive index of the substrate, allowing visibility of the three-dimensional image to be improved. The substrate and the ink receiving layer function as a protective layer for the image printed from the bonding layer side to improve the weatherability of the image. In a case where the transfer material is transferred to an image support that is inferior in breatherability and in a case where the substrate is poor in moisture permeability, the color material of the ink may re-diffuse due to moisture of the ink remaining after image printing and moisture absorption during storage, leading to image bleeding. Thus, in particular, in a case where an image is printed from the bonding layer side using a dye ink, the substrate is preferably formed using a material with a certain degree of moisture permeability.

In a case where an image is printed from the bonding layer side using a pigment ink, the pigment ink may be subjected to solid-liquid separation on the front surface of the ink receiving layer of the air gap absorption type, with the pigment remaining on the front surface of the ink receiving layer. However, in a case where the transfer material is transferred to the image support, image bleeding caused by re-diffusion of the color material is unlikely because the pigment is fixedly bonded with the discretely provided (sea-and-island-like) aggregates of pieces of the adhesive.

Furthermore, a difference in optical refractive index between the ink receiving layer and the substrate makes the three-dimensional image positioned between the ink receiving layer and the substrate visible. Thus, before the image is printed on the printed material and the transfer material, those of various available print and transfer materials which are to be actually used can be determined based on the three-dimensional image. This allows avoidance of, for example, misuse of a hologram image.

Furthermore, after the transfer material is transferred to the image support, a part of the substrate may be peeled off. Also in such a case, the visibility of the three-dimensional image positioned at a boundary between the ink receiving layer and a second part of the substrate different from the above-described part (the protective layer or the like) is maintained. For improved designability and visibility of the three-dimensional image, a three-dimensional image resulting from inversion of the three-dimensional image to be formed on the ink receiving layer may be provided on the substrate, and an anchor layer, a semi-transmissive/semi-reflective light transmission regulating layer, the ink receiving layer of the air gap absorption type, and the bonding layer may be sequentially provided on the three-dimensional image on the substrate. The light transmission regulating layer is formed of, for example, a thin metal film with light transmittance regulated, and the bonding layer is formed using discretely disposed (sea-and-island-like) aggregates of pieces of the adhesive.

In a case where a part of the substrate is peeled off after the transfer of the transfer material, an image may be additionally printed (additional printing) on a flat front surface of the second part of the substrate (the protective layer or the like) using various printing methods such as thermal transfer. Additional printing may be achieved after a plurality of transfer materials is laminated.

In a case where all of the substrate is peeled off after the transfer of the transfer material, the three-dimensional image provided on the substrate may be transferred to the ink receiving layer and held thereon. An image may be additionally printed on the recessed and protruding three-dimensional image on the ink receiving layer exposed after the peel-off of the substrate. In a case where the image is thus additionally printed, scratch resistance of the additionally printed image may be improved by regulating the recessed and protruding portion of the three-dimensional image so as to make the color material in the recesses of the three-dimensional image on the ink receiving layer less likely to be scratched. Thus, the ink used to print the additional image is preferably a pigment ink in which the color material itself has high weatherability. In a case where an optical difference between the ink receiving layer and an air layer is larger than the difference in optical refractive index between the ink receiving layer and the substrate, the three-dimensional image on the ink receiving layer exposed after the peel-off of the substrate may have improved visibility.

For more improved designability and visibility, a semi-transmissive/semi-reflective light transmission regulating layer may be provided on the three-dimensional image on the substrate. In that case, discrete (sea-and-island-like) pieces of the bonding layer may be provided after provision of the light transmission regulating member on the substrate via the peel-off layer and the further provision of the ink receiving layer of the air gap absorption type via the anchor layer. However, in a case where an image is additionally printed on a front surface of the three-dimensional image exposed after the peel-off of the substrate, the film strength, film thickness, and bonding strength of each of the layers are adjusted in a balanced manner, with heating and pressurization conditions during transfer finely adjusted. This inhibits air gaps in the front surface of the ink receiving layer of the air gap absorption type from being occluded by the peel-off layer, the light transmission regulating layer, the anchor layer, or the like.

According to the present invention, an image may be printed on the ink receiving layer of the air gap absorption type having the image based on the three-dimensional micro-structure. Thus, the structures of a printed medium, the transfer material, and the printed material may be simplified to allow the printed medium, the transfer material, and the printed material to be efficiently manufactured, while enabling a reduction in the prices thereof.

Further features of the present invention will become apparent from the following description of exemplary embodiments with reference to the attached drawings.

DESCRIPTION OF THE EMBODIMENTS

Embodiments of the present invention will be described below based on the drawings.

A transfer material of the present invention basically includes an ink receiving layer and a bonding layer sequentially provided on a substrate, and has, on a surface of the ink receiving layer contacting the substrate, an image based on a three-dimensional micro-structure shaped like recesses and protrusions (hereinafter also referred to as a "three-dimensional image"). A recessed and protruding three-dimensional image (an image based on a three-dimensional micro-structure) is pre-formed on a front surface of the substrate, and an ink receiving layer is provided on the front surface of the substrate. Then, the three-dimensional image on the substrate side can be transferred to and formed on the ink receiving layer side.

For an adhesive forming the bonding layer, aggregates of pieces of the adhesive may be discretely provided on a front surface of the ink receiving layer so as to expose parts of the front surface of the ink receiving layer to the outside. Such a configuration of the bonding layer may hereinafter be designated as a "sea and island structure" or a "sea-and-island-like bonding layer". Each of the discretely provided aggregates of pieces of the adhesive may hereinafter be designated as "bonding portions" or "island portions", exposed portions of the front surface of the ink receiving layer may be designated as "exposed portions (of the ink receiving layer)", and parts of the front surface including no adhesive may be designated as "sea portions" or "bypass portions". Therefore, areas below the sea portions correspond to the exposed portions of the ink receiving layer.

[1] Bonding Layer

[1-1] Structure of the Bonding Layer (Sea and Island Structure)

Figure 1:
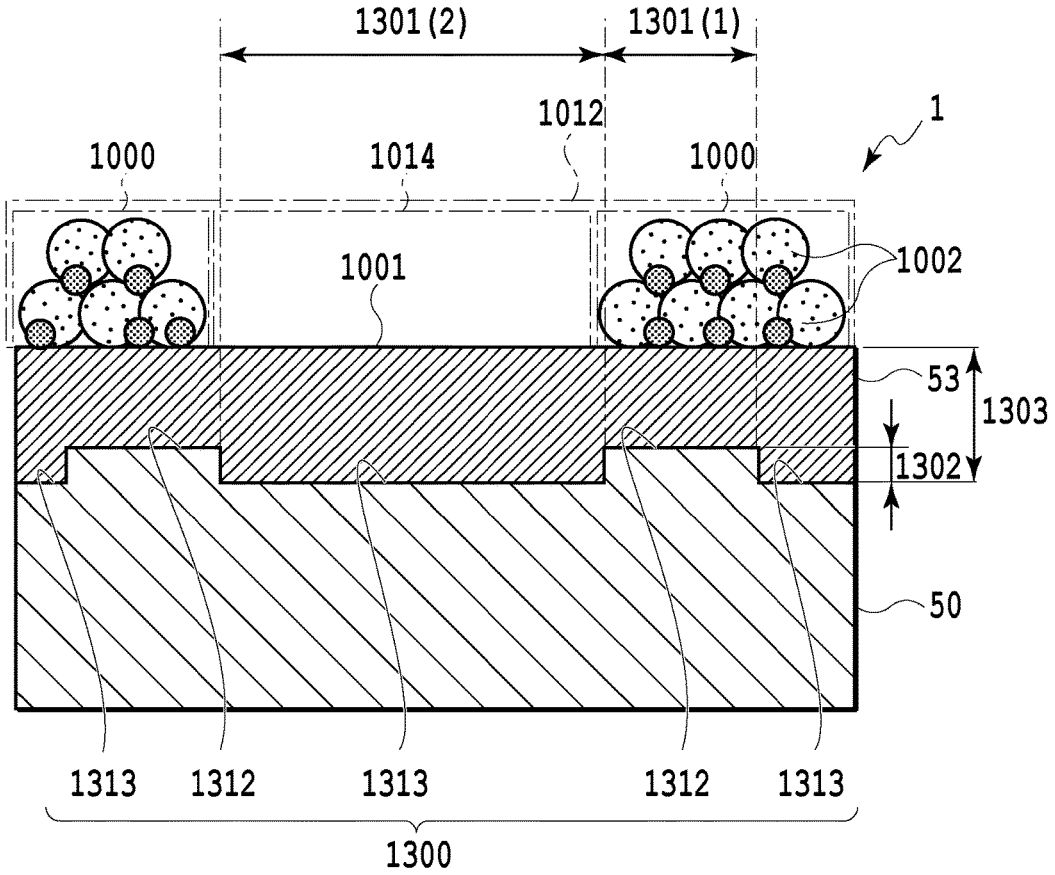
FIG. 1 is a cross-sectional view of a transfer material of the present invention.

As depicted in FIG. 1, in a transfer material 1 of the present embodiment, an ink receiving layer 53 of an air gap absorption type that absorbs ink through air gaps is disposed on a front surface of a substrate 50, and a bonding layer 1012 of an adhesive 1002 is disposed on a front surface of the ink receiving layer 53. The adhesive 1002 absorbs substantially no ink or absorbs ink but only at a low absorption speed. On the other hand, the ink receiving layer 53 of the air gap absorption type has high ink absorptivity and a high ink absorption speed. The bonding layer 1012 includes island portions 1000 corresponding to aggregates of pieces of the adhesive 1002 and serving as bonding portions and sea portions 1014 including no adhesive 1002 and serving as bypass portions. Parts of the ink receiving layer 53 corresponding to the sea portions 1014 form exposed portions 1001 exposed to the outside.

A portion of an ink droplet having landed on the vicinity of the center of the aggregate of pieces of the adhesive may fail to come into direct contact with the corresponding exposed portion of the ink receiving layer. Even in that case, the ink droplet travels along a surface of the adhesive to spread instantaneously within a time of the order of microseconds to milliseconds while being transformed as a result of landing impact. A portion of the ink droplet droops onto the exposed portion of the ink receiving layer. Consequently, the remaining portion of the ink droplet starts to be quickly absorbed into the ink receiving layer. Substantially no ink is absorbed by the adhesive. The ink is independently and quickly drawn and absorbed into the exposed portion of the ink receiving layer of the air gap absorption type, which has a high ink absorption speed. Thus, the ink is unlikely to remain on the surface of the adhesive or inside the adhesive, allowing an excellent bonding capability and high ink absorptivity to be achieved.

[1-2] Area of the Exposed Portions of the Ink Receiving Layer

For the area of exposed portions of the front surface of the ink receiving layer which portions include no adhesive, the ratio (area ratio) of the exposed portions to the entire front surface of the ink receiving layer may be adjusted so as to set the area factor to approximately 100%. For example, as is known, in a case where the ink substantially isotropically permeates the inside of the ink receiving layer, a spread rate of the aqueous ink that can be stably ejected using the ink jet method is approximately doubled, and at the time of permeation following landing, the ink droplet has the diameter thereof approximately doubled. The ink having infiltrated substantially isotropically spreads by approximately 25% in the horizontal direction in the ink receiving layer. Thus, in a case where the area ratio of the exposed portions of the ink receiving layer is 50% or more, an area factor of approximately 100% is achieved to allow a dense image with no blown-out highlights to be printed. Therefore, the area ratio of the exposed portions to the entire front surface of the ink receiving layer is preferably 50% or more.

[1-3] Shape of the Aggregate of Pieces of the Adhesive

The shape of the bonding portion depends on the shape of the aggregate of pieces of adhesive forming the bonding portion, and thus, the shape of the aggregate of pieces of adhesive may be selected to allow the color material of the ink to move around to the ink receiving layer below the bonding portion. To provide high ink absorptivity, the area of a portion of the ink that contacts a front layer of the ink receiving layer is preferably minimized so as to maximize the area of the adhesive measured when the transfer material is viewed from a print surface side. To achieve this, pieces of the adhesive generally shaped like particles, polyhedrons, or the like may be used. The use of such an adhesive allows the ink receiving layer of the air gap absorption type to be provided with as high ink absorptivity as possible and with the proper bonding capability while maximizing the area of the exposed portions of the ink receiving layer. The pieces of the adhesive are preferably shaped like particles in order to eliminate the need for special orientation treatment and to allow productivity to be improved.

[1-4] Air Ratio of the Bonding Layer

To provide high ink absorptivity, the expected range of a variation in the diameter of ink droplets may be taken into account and the horizontal dimension of each of the bonding portions forming the bonding layer may be controlled so that the ink inevitably sufficiently sticks out from the bonding layer and droops onto the corresponding exposed portion of the ink receiving layer. To allow the ink having landed on the bonding portion to stick inevitably out therefrom, it is important to set controllably the horizontal diameters of each piece of the adhesive and each bonding portion smaller than the diameter of the ink droplet measured when the ink droplet has landed on the adhesive (landing diameter). The ratio (area ratio) of the area of the bonding layer to the entire front surface of the ink receiving layer as viewed directly from the print surface side may be set to 50% or less by setting the dimension of the bonding portion smaller than the expected landing diameter of the ink droplet and sufficiently discretely arranging the bonding portions like islands.

In a case where the bonding portion is assumed to be formed by aggregating a plurality of particle-like pieces of the adhesive into a cylindrical shape, setting the area ratio of the bonding portions to the ink receiving layer to 50% or less makes the dimension of the bonding portion smaller than the landing diameter of the ink droplet measured when the ink droplet has landed on the bonding portion. In spite of the effects of viscosity and surface tension of the ink, a portion of the ink having landed on the bonding portion can be allowed to stick inevitably out from the bonding portion and droop onto the exposed portion of the ink receiving layer. In a case where a portion of the ink comes into contact with the exposed portion of the ink receiving layer, the ink is independently drawn and absorbed into the exposed portion of the ink receiving layer of the air gap absorption type, which absorbs the ink at a high speed. Therefore, preferably, high ink absorptivity can be achieved and the ink can be made less likely to remain on the surface of the adhesive or inside the adhesive, leading to improved bonding capability.

[1-5] Thickness of the Bonding Layer

To allow the ink having landed on the bonding portion to be drawn and absorbed into the exposed portion of the ink receiving layer, the thickness of the bonding layer is preferably controlled so as to inhibit a portion of the ink having landed on the bonding portion from being broken away when the portion sticks out from the bonding portion and droops onto the exposed portion of the ink receiving layer. That is, with the viscosity and surface tension of the ink taken into account, the thickness of the bonding layer is preferably controlled so as to inhibit the ink on the bonding layer and the ink in contact with the exposed portion of the ink receiving layer from being broken away.

A single-color image is assumed to be printed (single color printing) under the following conditions. That is, aqueous ink droplets that can be stably ejected spread in cylindrical form upon landing on the bonding portion, and aggregates of pieces of the adhesive are discretely arranged so as to achieve an area ratio of 50% or less. Further conditions are set such that, with only the absorption of the ink through the air gaps in the ink receiving layer taken into account, the ink receiving layer of the air gap absorption type has an absorption rate of 80%, and each ink droplet has a volume of 2 pl or 4 pl. In a case where a single-color image is printed (single color printing) under such conditions, the bonding portion may be smaller in thickness than the ink receiving layer.

For single color printing, the bonding portion can be made smaller in thickness than the ink droplet having landed on the bonding portion by setting the thickness of the bonding portion smaller than the thickness of the ink receiving layer according to the expected dimension of the ink droplet. Consequently, high ink absorptivity can be achieved so as to inhibit the ink on the bonding layer and the ink in contact with the exposed portion of the ink receiving layer from being broken away. The bonding capability can also be improved because the ink is less likely to remain on the surface of the bonding portion and inside the bonding portion. For printing of a multicolor image (color printing), in a case where the ink receiving layer of the air gap absorption type is assumed to have an ink absorption rate of 80% and ink for two or three colors is assumed to be received, the thickness of each piece of the adhesive may be smaller than approximately half or approximately one third of the thickness of the ink receiving layer.

In a case where the color material of the ink is a pigment, the height of the bonding portion is set slightly larger than six-hundredth of the thickness of the ink receiving layer to allow the exposed portion of the ink receiving layer to receive all of the single-color color material. As a result, the color material is inhibited from protruding upward beyond the height of the bonding portion, and the color material remaining in the front layer of the ink receiving layer is prevented from affecting the bonding capability, allowing an excellent bonding capability to be achieved. Preferably, the height of the bonding portion may be set larger than seven-hundredth of the thickness of the ink receiving layer. For color printing, given ink for two or three colors, the ink receiving layer needs to be made thicker. In addition, an increased amount of solids remain on the front surface of the ink receiving layer, and thus, the thickness of each piece of the adhesive needs to be increased at substantially the same rate at which the amount of solids has increased.

A higher bonding capability can also be provided because a sufficient amount of adhesive melted at the time of thermal transfer covers the color material remaining in the front layer of the ink receiving layer to form a bonding film of the melted adhesive between the color material and the image support. For example, in a case where a pigment ink with a pigment concentration of 10% is used, an excellent bonding capability can be achieved by setting the thickness of the bonding portion larger than one-tenth of the thickness of the ink receiving layer. In a case where an ink such as a pigment ink is used which contains solids such as the color material which are likely to remain in the front layer of the ink receiving layer, the thickness of the bonding portion may be set to approximately seven-hundredth to approximately half of the thickness of the ink receiving layer.

More preferably, a sufficient bonding capability is achieved by setting the height of the bonding portion to one-tenth to one-third of the thickness of the ink receiving layer. That is, in a case where the ink droplet has a volume of 2 to 4 pl, the ink receiving layer of the air gap absorption type has a porosity of 80%, and a color image is printed, then preferably the ink receiving layer has a thickness of approximately 8 μm to approximately 16 μm, and the bonding portion has a thickness of approximately 0.5 μm to approximately 8 μm. With an environmental variation in the volume of the ink droplet and a manufacturing variation in the porosity of ink receiving layer taken into account, the thickness of the bonding portion is more preferably 1 μm to 5 μm. In a case where the ink has a pigment concentration of approximately 5%, the thickness of the bonding layer is preferably within the range of approximately three-hundredths to approximately half of the thickness of the ink receiving layer. That is, in a case where the ink droplet has a volume of 2 to 4 pl, the ink receiving layer of the air gap absorption type has a porosity of 80%, and a color image is printed, then preferably the ink receiving layer has a thickness of approximately 8 μm to approximately 16 μm, and the bonding portion has a thickness of approximately 0.3 μm to approximately 8 μm. With an environmental variation in the volume of the ink droplet and a manufacturing variation in the porosity of ink receiving layer taken into account, the thickness of the bonding portion is more preferably 0.5 μm to 5 μm.

[1-6] Particle Size of the Adhesive

The average particle size of the pieces of the adhesive is not particularly limited and is preferably set so as to meet the following two conditions.

A first condition is that the ink having landed on the bonding layer is drawn and absorbed into the exposed portion of the ink receiving layer without being broken away as described above. The average particle size of the pieces of the adhesive is set so as to satisfy such a condition. Specifically, the thickness of the bonding layer depends on the average particle size and the amount of the adhesive, and thus, the average particle size of the pieces of the adhesive is preferably set so as to make the thickness of the bonding portion smaller than the thickness of the ink receiving layer. For color printing, the average particle size of the pieces of the adhesive may be set so as to make the thickness of the bonding portion smaller than one-third of the thickness of the ink receiving layer. In a case where the adhesive forms a plurality of the bonding portions, the average particle size of the pieces of the adhesive may further be reduced. A second condition is that the adhesive is inhibited from entering the air gaps in the ink receiving layer to prevent reduced ink absorptivity resulting from filling of the air gaps with the adhesive. The average particle size of the pieces of the adhesive is set so as to satisfy such a condition. That is, the average particle size of the pieces of the adhesive is preferably set so as not to be smaller than the air gap diameter of the ink receiving layer. To satisfy the two conditions, the average particle size of pieces of the adhesive is preferably larger than the air gap diameter of the ink receiving layer and equal to or smaller than the half of the thickness of the ink receiving layer to achieve both printability and bonding capability of the image.

In a case where the color material of the ink is a pigment, the average particle size and the amount of the adhesive may be adjusted so as to allow the color material remaining on the ink receiving layer as a result of solid-liquid separation to be covered with the adhesive during bonding. For example, since an aqueous ink that can be stably ejected by ink jet printing has a pigment concentration of the order of 10% or less, and a certain amount of pigment permeates the ink receiving layer, the adhesive may have an average particle size larger than approximately one-tenth of the ink receiving layer. In a case where the pigment concentration is larger than 10%, the average particle size of the pieces of the adhesive may be further larger than one-tenth of the thickness of the ink receiving layer. The average particle size and the amount of the adhesive may be adjusted as needed according to the pigment concentration of the ink used.

That is, given a single-color pigment ink, preferably, the average particle size of the adhesive is larger than the air gap diameter of the ink receiving layer, and the average particle size is further larger than one-tenth of the ink receiving layer and is equal to or smaller than the thickness of the ink receiving layer. This allows both image printability and bonding capability to be achieved. For color printing, the average particle size of the adhesive may be larger than the air gap diameter of the ink receiving layer and may be larger than one-tenth of the ink receiving layer and smaller than one-third of the thickness of the ink receiving layer. In a case where the pigment is a resin dispersing pigment and the dispersing resin has a melting point lower than a bonding temperature, the dispersing resin contributes to bonding to enable excellent bonding without the need to completely cover the pigment with the adhesive, allowing the thickness of the adhesive to be reduced below the above-described thickness. Basically, the transfer material and the image support need to be able to be properly bonded together with the bonding inhibited from being hindered by the color material. To achieve this, the thickness of the bonding layer and the thickness of the ink receiving layer may be adjusted as needed according to factors such as the porosity of the ink receiving layer, the type of the ink color material used, the concentration of the color material, and the printed image (a single-color image or a multicolor image).

Specifically, the average particle size of the pieces of the adhesive is preferably larger than 10 nm and smaller than 5 μm. In a case where the average particle size of the pieces of the adhesive is set larger than 10 nm, the particle size of the pieces of the adhesive is sufficiently larger than the air gap diameter of the ink receiving layer, making the adhesive less likely to enter the air gaps in the ink receiving layer. Consequently, a reduction in ink absorptivity is prevented to allow high ink absorptivity to be achieved. In a case where the average particle size of the pieces of the adhesive is set smaller than 5 μm, the bonding portion can be made smaller in thickness than the ink receiving layer to allow the ink having landed on the bonding layer to be drawn and absorbed into the exposed portion of the ink receiving layer without being broken away. As a result, the ink is made less likely to remain on the surface of the bonding layer or inside the bonding layer to allow the bonding capability to be improved.

On the other hand, in a case where the pieces of the adhesive have an average particle size of 10 nm or less, the average particle size may be smaller than the air gap diameter of the ink receiving layer. In this case, the adhesive may enter and fill the air gaps in the ink receiving layer to reduce the ink absorptivity. However, in a case where particles of the adhesive are likely to aggregate, the particles aggregate into large secondary particles even at an average particle size of 10 nm or less, and are thus inhibited from filling the air gaps. Therefore, in such a case, the average particle size may be smaller than 10 nm. Basically, the average particle size needs to be adjusted as needed so as not to fill the air gaps in the ink receiving layer.

[1-7] Amount (Volume) of the Adhesive

The amount of the adhesive may be adjusted according to the intended purpose. For example, in a case where a high bonding force is needed, the amount of the adhesive is preferably such that the adhesive can absorb recesses and protrusions on bonding surfaces of the image support and the ink receiving layer. More preferably, the amount of the adhesive and a bonding area resulting from melting are adjusted so that, during bonding, the melted adhesive covers substantially the entire surface of the ink receiving layer to allow the entire surface of the ink receiving layer to be bonded to the image support. On the other hand, in a case where a weak bonding force is sufficient, the area of the exposed portions of the ink receiving layer may be increased to improve the characteristics of printing of images with the ink.

[1-8] Density of the Exposed Portions of the Ink Receiving Layer

The intervals between the exposed portions of the ink receiving layer may be adjusted so as to set an area factor to approximately 100%. To maintain the area factor needed to form images, the density of the exposed portions of the ink receiving layer may be set such that one or more sea portions are present in an area that is double the square of the diameter of each ink droplet. In other words, one or more exposed portions of the ink receiving layer, which has a high ink absorption speed, may be present in each expected pixel in ink jet printing. Consequently, the ink is inhibited from remaining on the island-shaped bonding portions and is quickly absorbed into the ink receiving layer, preventing improper bonding. The presence of one or more sea portions in each pixel allows the ink having landed on the bonding portion to be absorbed into the ink receiving layer without being significantly misaligned with a predetermined pixel. This results in excellent image printing characteristics.

The ink receiving layer is configured to be able to absorb all of an amount of ink that satisfies an area factor of 100%. For example, for the ink and the ink receiving layer expected to be used as described above, the ink receiving layer is assumed to have an absorption rate of 80%, and one 2- or 4-pl ink droplet is assumed to land on the bonding portion during single color printing. Then, given single color printing, at least one sea portion needs to be present in a square with four sides each of which is six times the value of $\sqrt{2}$-th of the thickness of the ink receiving layer that can receive an amount of ink allowing an area factor of 100% to be achieved. Given multicolor printing, in order to achieve an area factor of 100% or more, at least one sea portion needs to be present in a square with four sides each of which is double the value of a √2-th of the thickness of the ink receiving layer. This is substantially similarly applicable to a case where, in single color printing and multicolor printing, one pixel is printed using a plurality of ink droplets.

[1-9] Other Configurations

One or more types of adhesives may be used, but importantly, at least the adhesive in contact with the ink receiving layer substantially maintains the particle shape. Since the adhesive in contact with the ink receiving layer substantially maintains the particle shape, the color material of the ink is likely to move around to below the adhesive, thus improving the characteristics of printing of images based on the ink jet method or the like.

For example, a plurality of types of adhesives with different particle sizes may be used. For enhanced bonding capability, the adhesive may be formed of a plurality of thermoplastic resin particles. An adhesive formed using a plurality of materials may be used.

One or more bonding layers may be provided. For example, an ink receiving layer-side layer of the bonding layer may be configured to be likely to bond to the ink receiving layer, whereas an image support-side layer of the bonding layer may be configured to be likely to bond to the image support; the respective layers provide the separate functions. In a case where the bonding layer includes a plurality of layers, the adhesive on the uppermost layer may be in a complete film form and may be smoothed instead of being shaped like particles. However, importantly, the adhesive in the bonding layer in contact with the ink receiving layer maintains the particle shape. In a case where at least the adhesive in the bonding layer in contact with the ink receiving layer maintains the particle shape, the ink is likely to move around to below the adhesive during image printing, thus improving the image printing characteristics.

[2] Three-Dimensional Image (Image Based on the Three-Dimensional Micro-Structure)

The transfer material of the present embodiment has a recessed and protruding three-dimensional image (an image based on a three-dimensional micro-structure) 1300 on a surface of the ink receiving layer 53 that contacts the substrate 50.

Figure 10B:
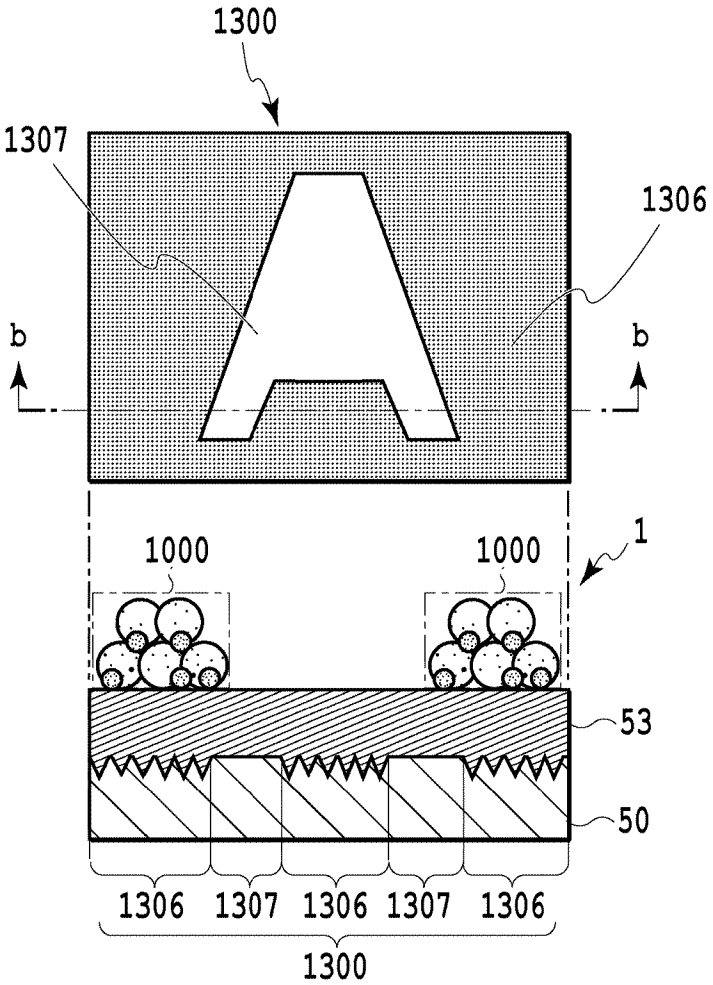
FIG. 10A and FIG. 10B are diagrams illustrating different configuration examples of an image based on a three-dimensional micro-structure.
Figure 10A:
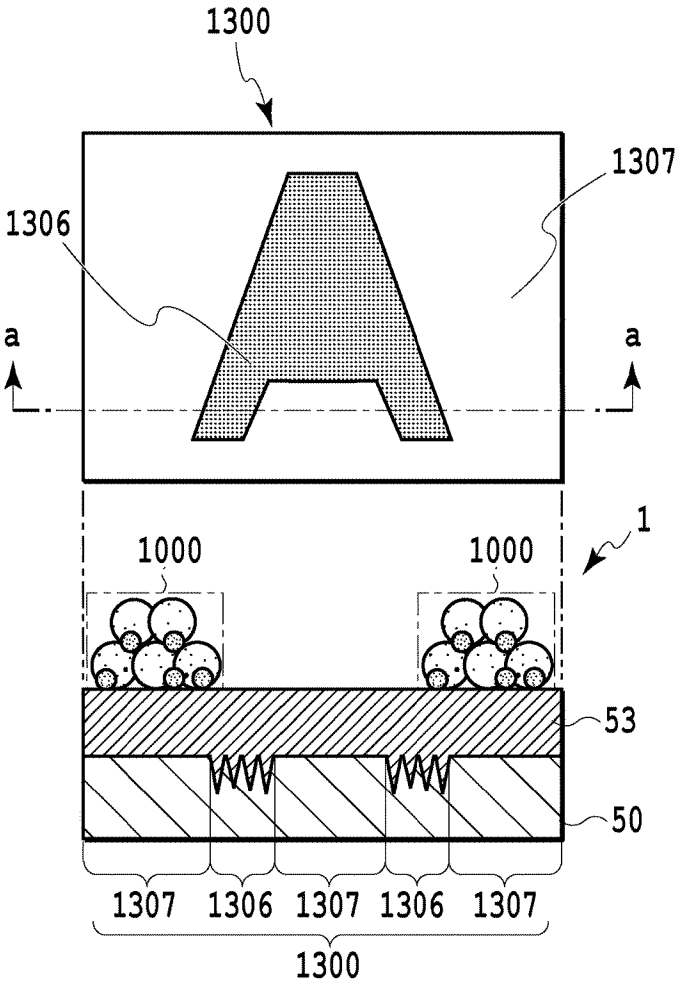

The three-dimensional image includes all of the image expressed by the recesses and protrusions in the ink receiving layer. For example, the three-dimensional image 1300 includes an image expressed by recessed and protruding portions 1306 and flat portions 1307 as depicted in FIG. 10A and an image in which the recessed and protruding portions 1306 in FIG. 10A are interchanged with the flat portions 1307 in FIG. 10A. Thus, the three-dimensional image may include the flat portions 1307 in addition to the recessed and protruding portions 1306. An upper portion of FIG. 10A is a plan view of the three-dimensional image 1300, and a lower portion of FIG. 10A is a cross-sectional view of the transfer material taken along line a-a in the upper portion. Likewise, an upper portion of FIG. 10B is a plan view of the three-dimensional image 1300, and a lower portion of FIG. 10B is a cross-sectional view of the transfer material taken along line b-b in the upper portion.

Figure 11B:
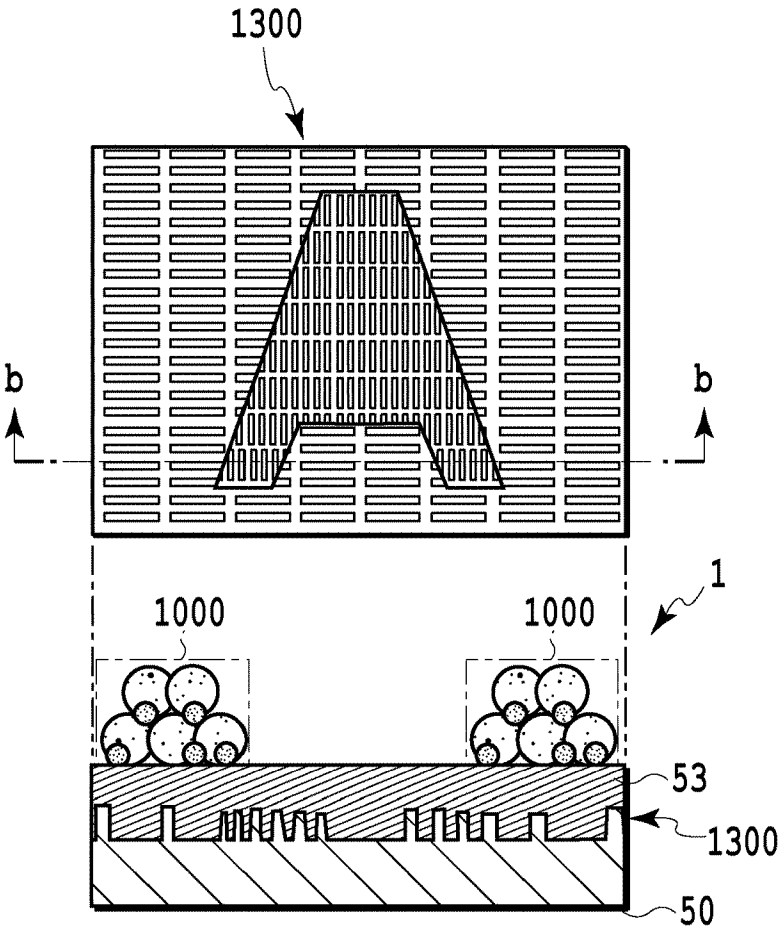
FIG. 11A and FIG. 11B are diagrams illustrating further different configuration examples of the image based on the three-dimensional micro-structure.
Figure 11A:
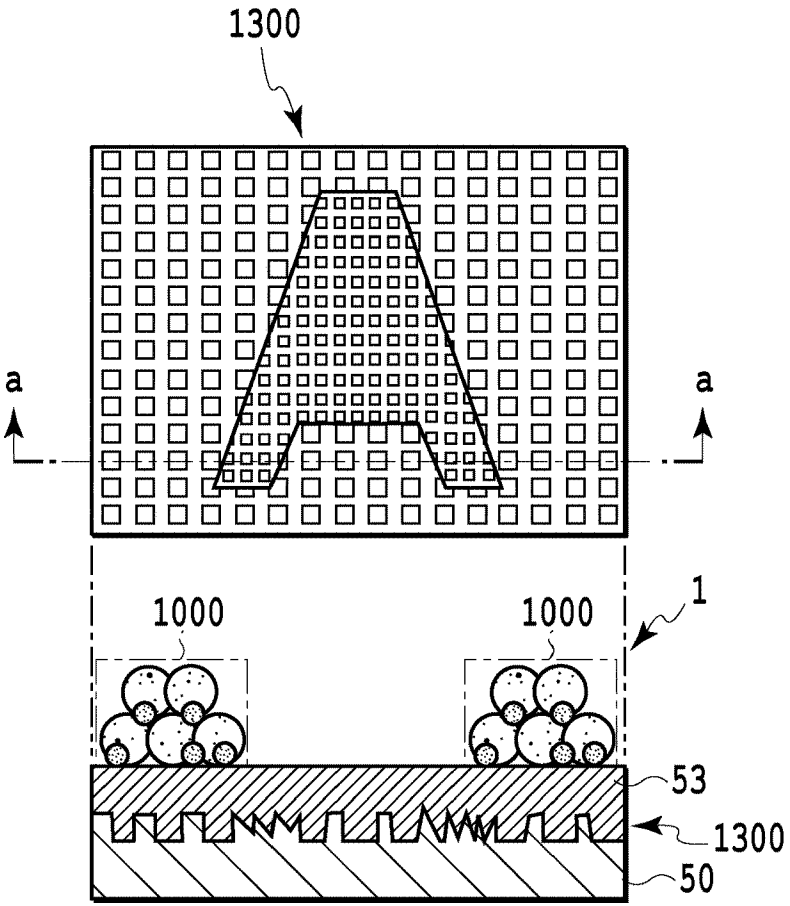
Figure 12B:
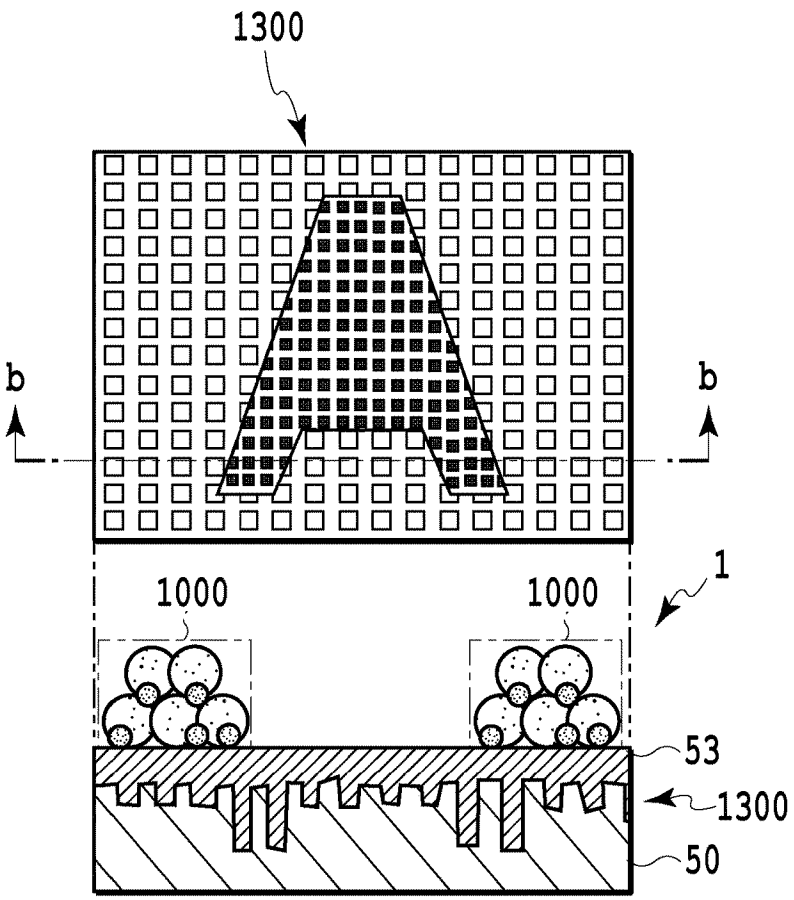
FIG. 12A and FIG. 12B are diagrams illustrating further different configuration examples of the image based on the three-dimensional micro-structure.
Figure 12A:
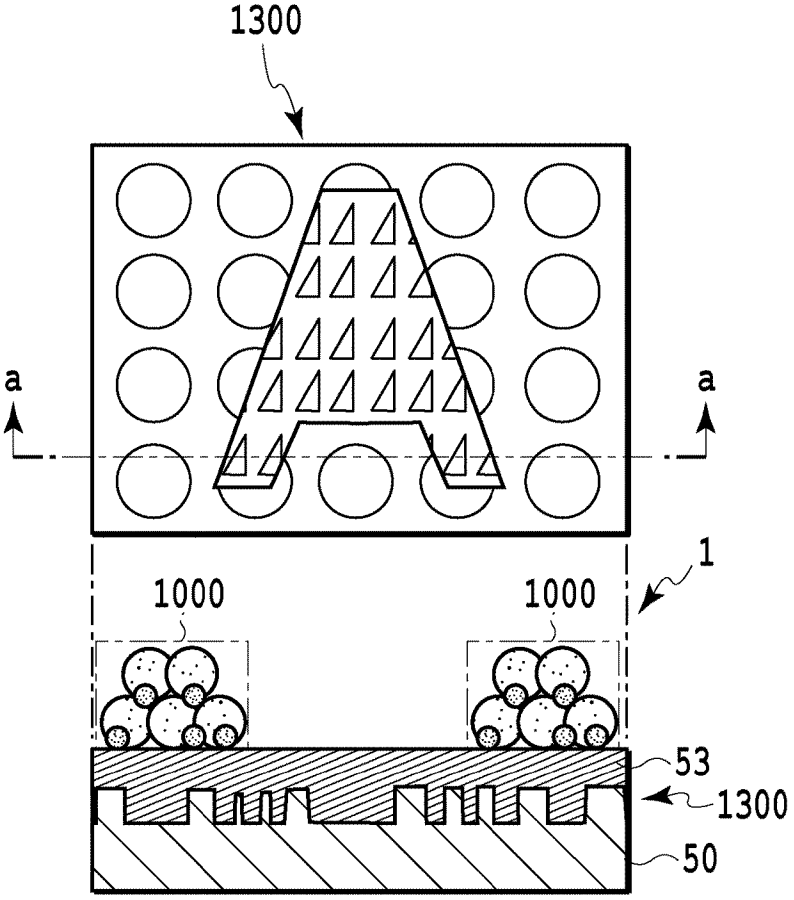

The three-dimensional image may be formed using a plurality of different recessed and protruding portions. The three-dimensional image may be formed using, for example, recessed and protruding portions with partly different cross-sectional shapes as depicted in FIG. 11A, recessed and protruding portions with different widths in a lateral direction as depicted in FIG. 11B and FIG. 12A, and recessed and protruding portions with different heights in an up-down direction as depicted in FIG. 12B.

Such a three-dimensional image is viewed based on a difference in optical refractive index between the substrate and the ink receiving layer, enabling prevention of forgery of the transfer material and the printed material. Moreover, the transfer material of the present embodiment allows an image (first image) to be printed on the front surface of the ink receiving layer opposite to the substrate using the ink jet method or the like, and can be bonded to the image support. Therefore, in the printed material to which the transfer material is transferred, the ink receiving layer functions as a protective layer for the first image to allow weatherability of the first image to be improved. In a case where the recessed and protruding portions of the three-dimensional image are positioned on a front surface of such a printed material and another image (second image) is printed on the front surface of the printed material using a pigment ink, the recessed and protruding portions of the three-dimensional image protect pigment particles to allow scratch resistance to be improved.

The three-dimensional image may be provided directly on the front surface of the ink receiving layer by cutting or the like, and a substrate with a flat front surface may be stuck to the printed material in order to ensure conveyance performance of the printed material. In such a case, a three-dimensional image may be formed on the ink receiving layer so as to have a height corresponding to the thickness of the ink receiving layer. The visibility of the three-dimensional image can be further improved by increasing the height of the three-dimensional image so as to increase the level of the recesses and the protrusions.

A recessed and protruding three-dimensional image may be provided on a boundary surface between the substrate and the ink receiving layer by forming the recessed and protruding three-dimensional image on the substrate and coating and laminating the ink receiving layer on and to the substrate to transfer the three-dimensional image on the substrate to the front surface of the ink receiving layer. The three-dimensional image formed on the substrate is inverted, and the inverted image is transferred to the front surface of the ink receiving layer. Thus, in a case where the ink receiving layer-side three-dimensional image is used as a reference, the substrate-side three-dimensional image corresponds to the inverted ink receiving layer-side three-dimensional image (an image based on a three-dimensional micro-structure for inversion). Thus, in a case where the three-dimensional image is transferred to the ink receiving layer, compared to a case where a three-dimensional image is formed directly on the ink receiving layer, the three-dimensional image can be easily formed simply by application of a coating liquid for the ink receiving layer without entraining, in the ink receiving layer, impurities such as dirt and dust resulting from cutting. This results in improved productivity of the transfer material and enhanced stability of performance of the transfer material. Basically, the three-dimensional image needs to be able to be formed on the surface of the ink receiving layer that contacts the substrate. In an example in FIG. 4, after a three-dimensional image 1300 is provided on the front surface of the substrate 50 using a formation apparatus 1308, the ink receiving layer 53 is coated on the substrate 50 using a die coater 655A, and then, the bonding layer 1012 is coated on the ink receiving layer 53 using a die coater 655B.

The three-dimensional image is visible based on a difference in optical refractive index between two layers forming a boundary between the front surface of the three-dimensional image and an opposite surface in contact with the front surface. Therefore, in order to make the three-dimensional image visible, the two layers forming the boundary need to be configured using members with different optical refractive indices. For example, in a case where the recessed and protruding three-dimensional image 1300 provided on the substrate 50 is covered with the ink receiving layer 53 of the air gap absorption type, the substrate 50 and the ink receiving layer 53 are the two layers forming the boundary for the three-dimensional image. The difference in optical refractive index between the substrate and the ink receiving layer makes the three-dimensional image visible. The transfer material of the present invention makes the three-dimensional image visible both in a state before transfer to the image support and in a state after transfer to the image support. Thus, before an image is printed using the ink jet method or the like, the three-dimensional image is viewed to determine the appropriate transfer material corresponding to the intended purpose to enable avoidance of misuse of an inappropriate transfer material.

To improve visibility of the three-dimensional image, the two layers forming the boundary for the three-dimensional image preferably differ sufficiently in refractive index. In a transfer material from which the substrate is not peeled off or a transfer material from which a part of the substrate is peeled off, the ink receiving layer and the substrate preferably differ sufficiently in optical refractive index. In a transfer material from which the substrate is peeled off, the ink receiving layer and an air layer are the two layers forming the boundary for the three-dimensional image, and thus, the ink receiving layer and air preferably differ sufficiently in optical refractive index.

More specifically, in a case where a human being views a three-dimensional image with the naked eye, the difference in optical refractive index between the ink receiving layer and another layer, which form the boundary for the three-dimensional image, is preferably 0.1 or more and more preferably 0.15 or more. The optical refractive index of the ink receiving layer may be controlled so as to meet such a condition. Setting the difference in refractive index within such a range improves the visibility of the three-dimensional image regardless of whether or not the substrate is peeled off. In a case where the difference in optical refractive index is less than 0.1, the three-dimensional image is very difficult to view to the naked eye. The preferable range of the difference in refractive index may be selected as needed according to a method for viewing the image and the like.

A printed material may be obtained by printing an image (first image) on the transfer material of the present embodiment, transferring the transfer material to the image support, and then peeling off the substrate or at least a part of the substrate. The recessed and protruding three-dimensional image may be provided directly on the ink receiving layer, or the recessed and protruding three-dimensional image provided on the substrate may be transferred to the ink receiving layer. In a case where a transfer material is used from which the substrate is peeled off, the recessed and protruding three-dimensional image on the substrate is transferred to the ink receiving layer in an inverted form, resulting in a printed material with the ink receiving layer provided with the recessed and protruding three-dimensional image. That is, the protruding portions of the three-dimensional image on the substrate correspond to the recessed portions of the three-dimensional image on the ink receiving layer, while the recessed portions of the three-dimensional image on the substrate correspond to the protruding portions of the three-dimensional image on the ink receiving layer. The recessed and protruding three-dimensional image transferred to the ink receiving layer of the printed material is visible based on the difference in optical refractive index between the air and the ink receiving layer. Although depending on the materials of the substrate and the ink receiving layer, the three-dimensional image on the substrate side is transferred to the ink receiving layer with the recessed and protruding shape and the dimensions of the image maintained.

In such a printed material, an image (second image) may be additionally printed on the front surface of the ink receiving layer with the recessed and protruding three-dimensional image using the ink jet method or the like. In that case, the three-dimensional image on the ink receiving layer improves the scratch resistance of the second image. In general, the pigment ink is susceptible to solid-liquid separation, and pigment particles are likely to remain on the front surface of the ink receiving layer. Thus, images printed with the pigment ink offer only low scratch resistance. On the other hand, in a case where the second image is additionally printed on the ink receiving layer with the three-dimensional image using the pigment ink, the pigment particles are housed in the recessed portions of the three-dimensional image and protected by the protruding portions during scratching. Thus, a scratching object is unlikely to come into contact with the pigment particles, allowing the scratch resistance of the second image to be improved. Therefore, as the pigment ink with which the second image is printed, a pigment ink with a color material itself having high weatherability may be suitably used.

To improve the scratch resistance of the second image, it is important to set the volume of the recessed portions of the three-dimensional image on the ink receiving layer equal to or more than the volume of the color material of the ink with which the second image is printed. The thus set volume of the recessed portions of the three-dimensional image allows most of the pigment of the pigment ink to be housed in the recessed portions, improving the scratch resistance. In a case where the volume of the recessed portions of the three-dimensional image is less than the volume of the color material of the ink, the pigment of the pigment ink may stick out from the protruding portions of the three-dimensional image to reduce the scratch resistance. The volume of the recessed portions of the three-dimensional image on the ink receiving layer is equal to the volume of the protruding portions of the three-dimensional image on the substrate. Therefore, the scratch resistance of the printed material can be improved by adjusting the volume of the protruding portions of the three-dimensional image on the substrate according to the amount of ink ejected and the amount of the color material.

In such a printed material, it is difficult to print (additionally print) accurately an image (second image) on the front surface of the ink receiving layer with the three-dimensional image using a contact printing method such as thermal transfer. For example, in a case where an attempt is made to print an additional image by thermal transfer, the recessed and protruding portions of the ink receiving layer preclude the print head from contacting the entire surface of the ink receiving layer, making accurate image printing difficult. Thus, it is difficult to print an image on the front surface of the ink receiving layer with the three-dimensional image using a method other than non-contact methods such as the ink jet method. In other words, the transfer material of the present invention limits the printing method in a case where the second image is additionally printed. This makes the printed material with the second image printed on the ink receiving layer with the three-dimensional image difficult to forge and duplicate, improving the security of the printed material to an advanced level.

Furthermore, in such a printed material, the three-dimensional image provided on the ink receiving layer allows the front surface of the ink receiving layer to be prevented from being sticky. The three-dimensional image enables the texture of the substrate to be transferred to the ink receiving layer. For example, the front surface of the ink receiving layer may be provided with a paper-grain texture or a wood-grain texture by forming a paper-grain image, a wood-grain image, or the like on the substrate as a three-dimensional image and transferring the three-dimensional image to the ink receiving layer covering the substrate. The texture of the substrate may also be expressed on the ink receiving layer by transferring the whole front surface of the substrate to the front surface of the ink receiving layer.

Moreover, the texture of a member with a desired texture may be transferred to the front surface of the printed material by pressing the member against the front surface of the printed material for embossing. For example, a heated die is pressed directly against the ink receiving layer to provide the ink receiving layer with the texture of the die. Alternatively, the substrate may be provided with a protective layer contacting the ink receiving layer and formed of a resin that is cured by ultraviolet rays, heat, or the like and a conveyance layer allowing the transfer material to be smoothly conveyed. Then, the conveyance layer may be peeled off, and subsequently, a member with a desired texture may be pressed against the front surface of the protective layer for embossing.

The three-dimensional image may be formed on a variety of substrates. The substrate may not be peeled off or may be peelable. The substrate may be partly peelable or may have a multilayer structure in which a conveyance layer and a functional layer having a function other than conveyance are laminated. The functional layer may be a protective layer in order to protect the three-dimensional image on the printed material. In order to improve further the designability and visibility of the three-dimensional image, the functional layer may be a semi-transmissive/semi-reflective light transmission regulating layer formed of a thin metal film with light transmittance adjusted and an anchor layer serving to enhance the bonding capability. Any other substrate that is suitable for the purpose may be selected from well-known substrates and used to form a three-dimensional image.

Figure 8A:
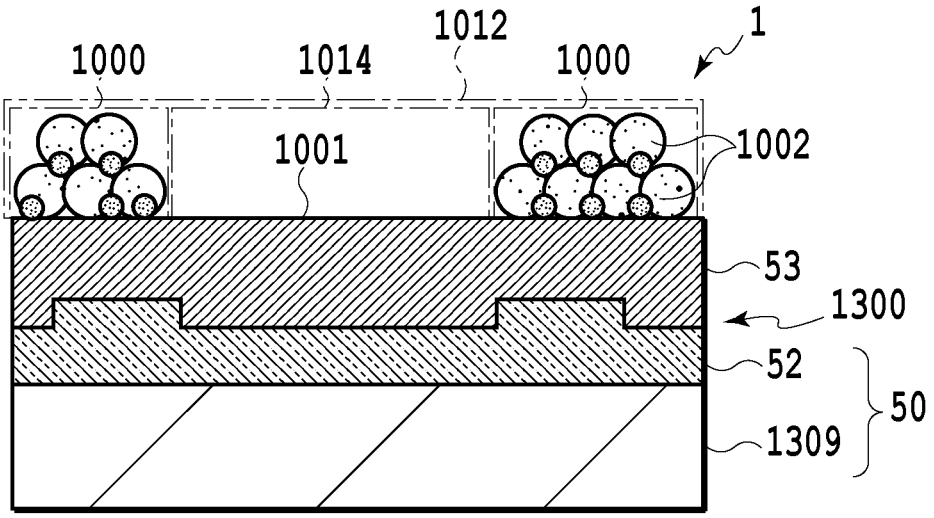
FIG. 8A and FIG. 8B are cross-sectional views each illustrating yet another embodiment of the transfer material.
Figure 8B:
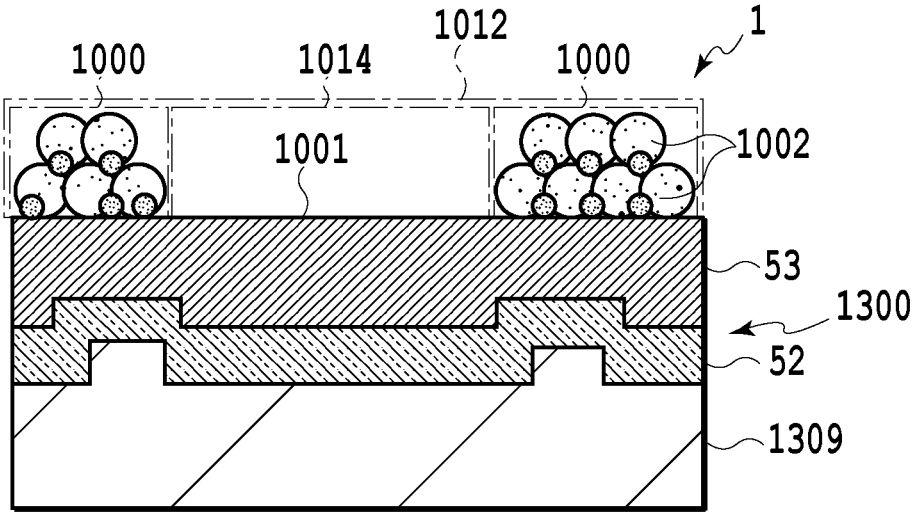
Figure 9A:
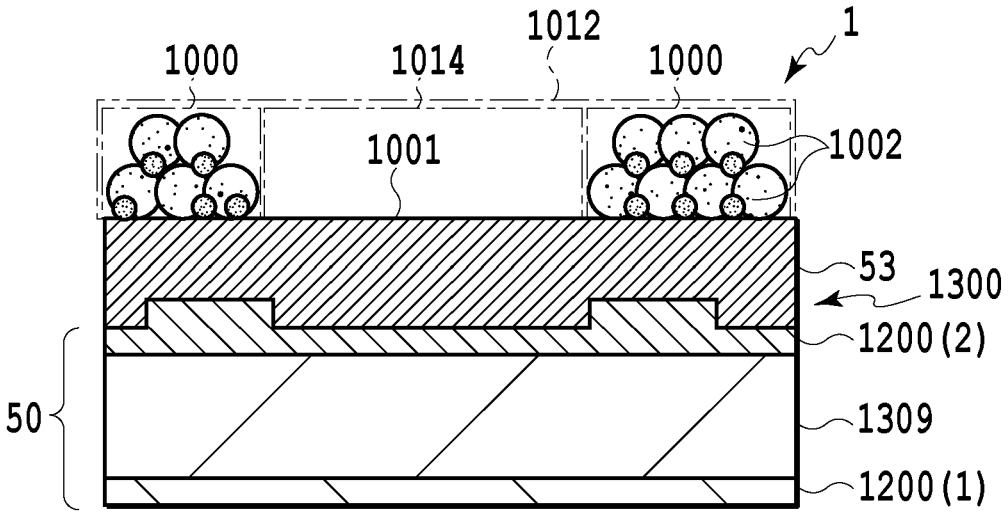
FIG. 9A and FIG. 9B are cross-sectional views each illustrating still another embodiment of the transfer material.
Figure 9B:
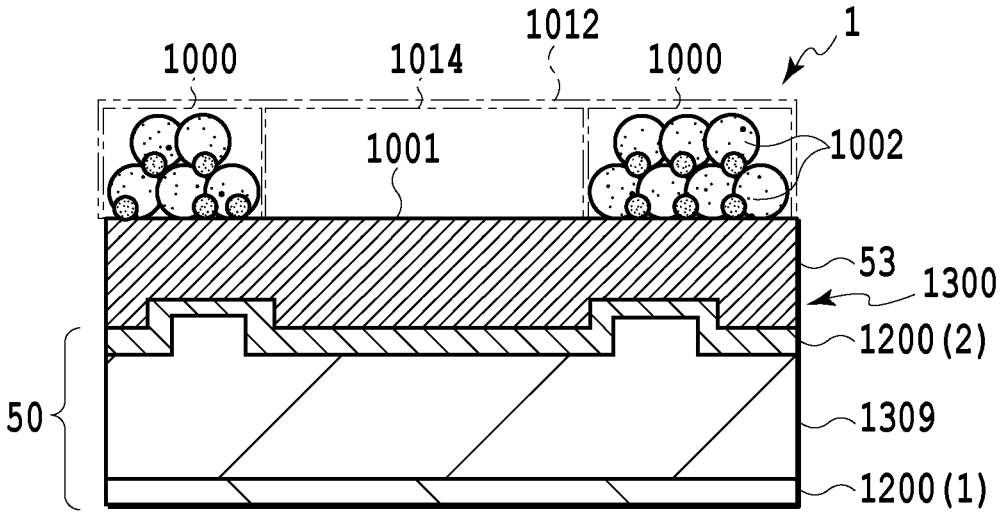

The recessed and protruding three-dimensional image is provided on the boundary surface between the substrate and the ink receiving layer in order to provide various functions. That is, the recessed and protruding three-dimensional image is at least provided on the front surface of the substrate contacting the ink receiving layer for any of transfer materials from which the substrate is peeled off after transfer, transfer materials from which the substrate is not peeled off after transfer, and transfer materials from which the substrate is partly peeled off after transfer. For example, for transfer materials from which the substrate is not peeled off and transfer materials from which the substrate is peeled off, the three-dimensional image 1300 may be provided on the front surface of the substrate 50 contacting the ink receiving layer 53 as depicted in FIG. 1. As depicted in FIG. 9A and FIG. 9B, for the transfer material in which the heat seal layers 1200 are provided on respective layers of a conveyance layer 1309 of the substrate 50 and from which the conveyance layer 1309 is not peeled off, the three-dimensional image 1300 may be provided on the front surface of the heat seal layer 1200, which is in contact with the ink receiving layer 53. As depicted in FIG. 8A and FIG. 8B, for the transfer material 1 in which the substrate 50 is formed of the conveyance layer 1309 and only the conveyance layer 1309 is peeled off, the three-dimensional image 1300 may be provided on a front surface of a protective layer 52 that is in contact with the ink receiving layer 53. For a transfer material in which the substrate is formed of a conveyance layer, a light transmission regulating layer, and an anchor layer and from which only the conveyance layer is peeled off, the three-dimensional image may be provided on the front surface of the protective layer, which is in contact with the ink receiving layer. Basically, the three-dimensional image needs to be provided on the substrate so that when the ink receiving layer is laminated on the substrate, the recessed portions and the protruding portions of the three-dimensional image are formed on the ink receiving layer.

[2-1] Recessed and Protruding Shape of the Three-Dimensional Image

Figure 13:
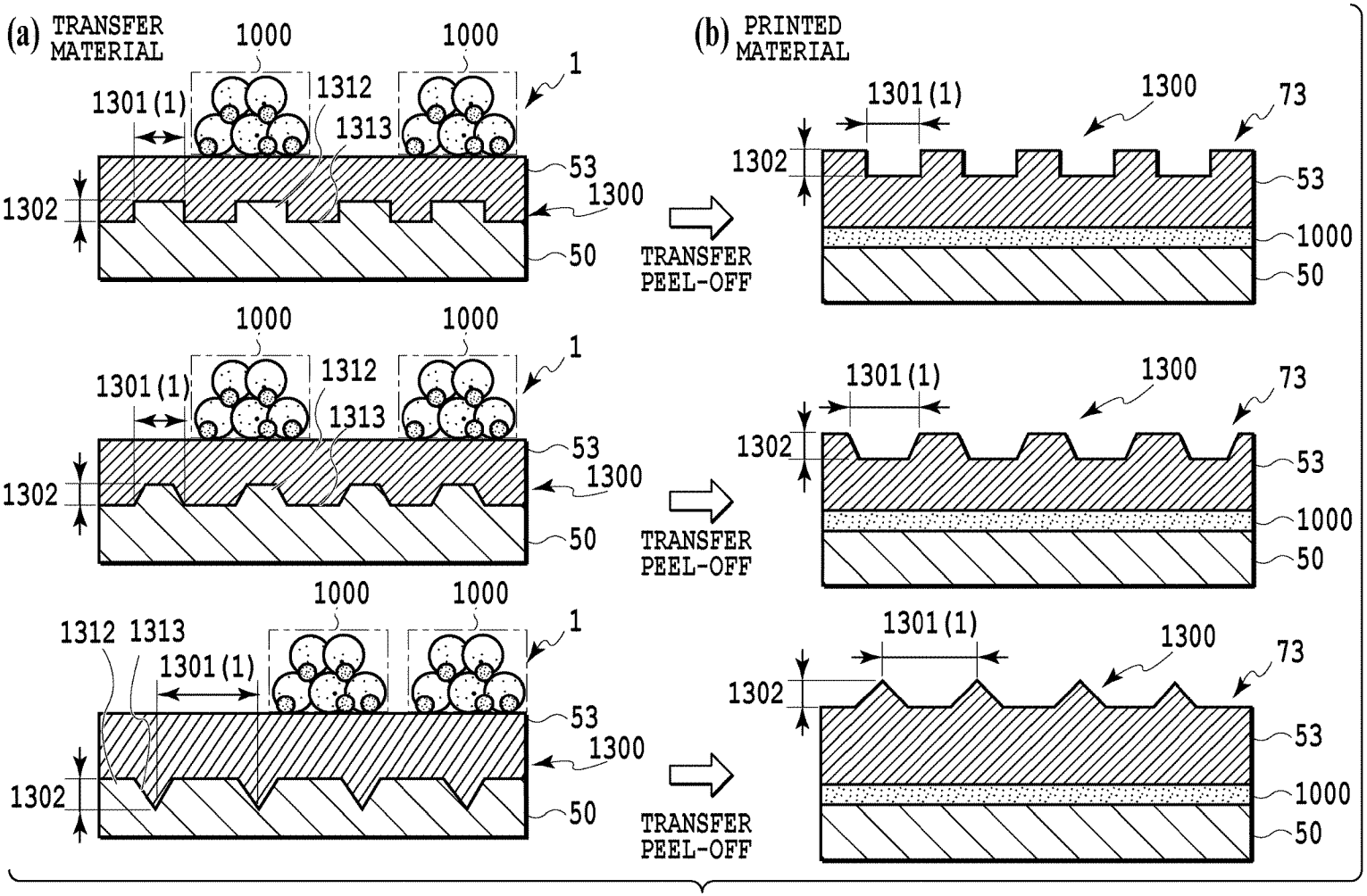
FIG. 13 is a diagram illustrating a different recessed and protruding shape of the image based on the three-dimensional micro-structure.
Figure 14:
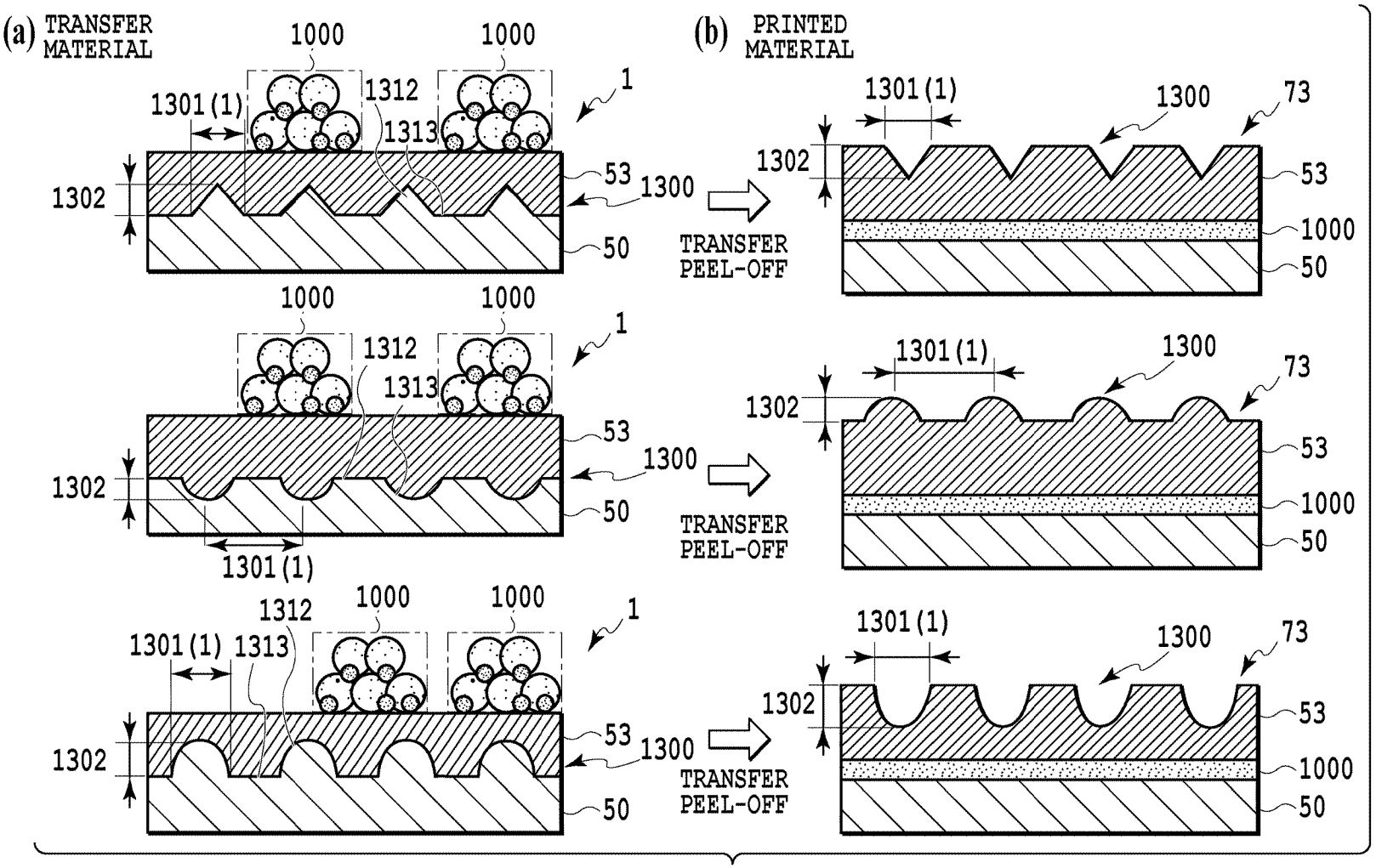
FIG. 14 is a diagram illustrating a further different recessed and protruding shape of the image based on the three-dimensional micro-structure.

The recessed and protruding shape of the three-dimensional image may be selected according to the intended purpose. For example, as depicted in FIG. 13 and FIG. 14, the protruding portions of the three-dimensional image 1300 on the ink receiving layer 53 may be shaped like polyhedrons such as triangular pyramids, quadrangular pyramids, cones, cylinders, or cubes, or semi-spheres. The recessed portions of the three-dimensional image 1300 in the ink receiving layer 53 may be shaped like polyhedrons such as triangular pyramids, quadrangular pyramids, cones, cylinders, or cubes, or semi-spheres. The three-dimensional image may include one type of such recessed portions and protruding portions or a combination of a plurality of types of recessed portions and protruding portions.

Figure 15:
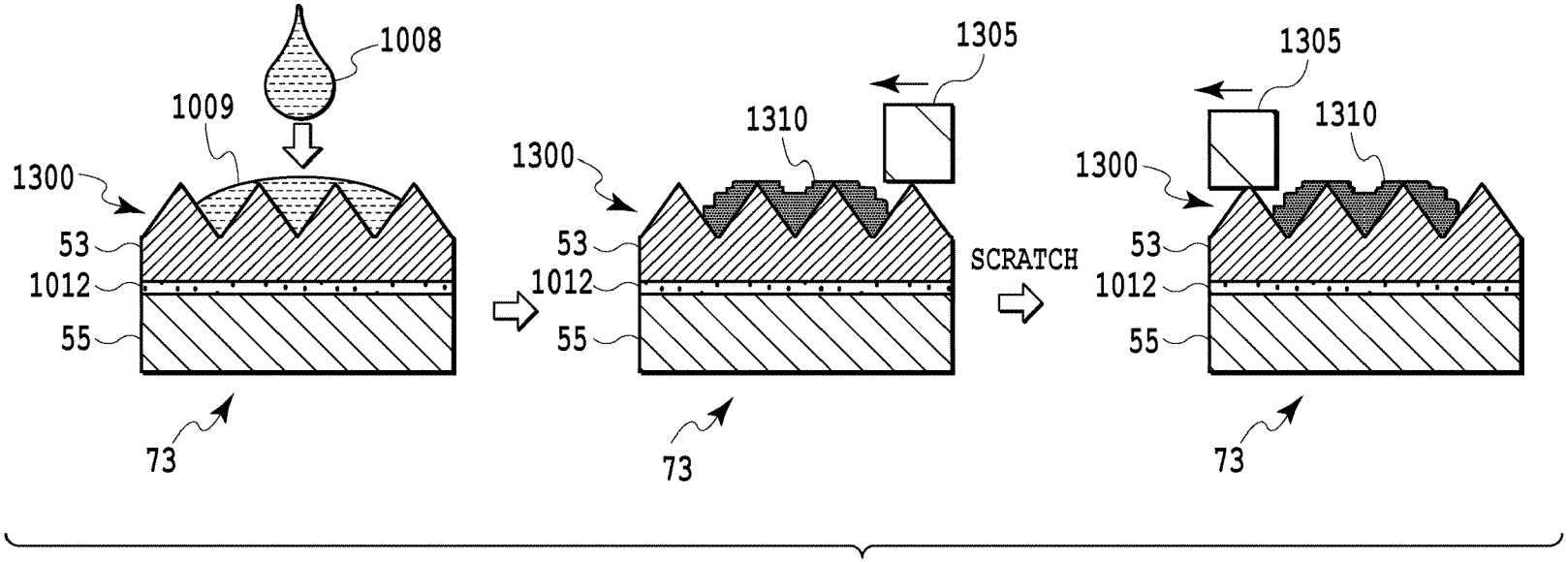
FIG. 15 is a diagram illustrating a relation between an example of the recessed and protruding shape of the image based on the three-dimensional micro-structure and scratch resistance of the image.
Figure 16:
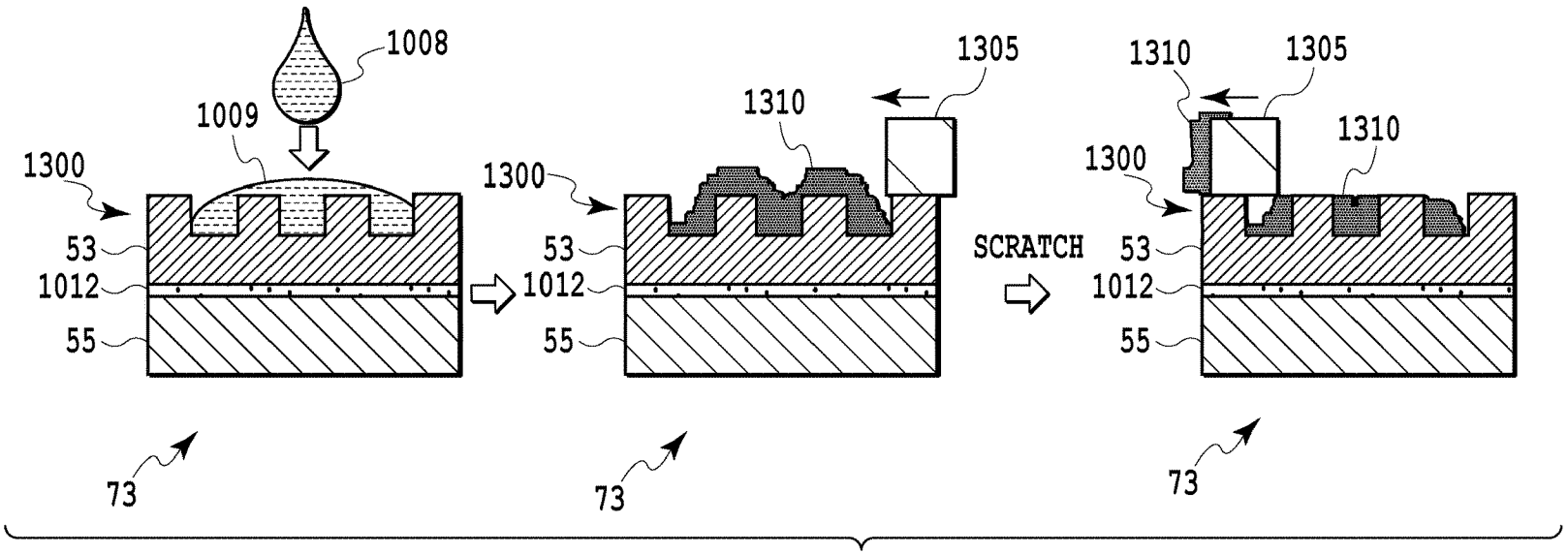
FIG. 16 is a diagram illustrating a relation between another example of the recessed and protruding shape of the image based on the three-dimensional micro-structure and the scratch resistance of the image.

In a case where an image is printed on the ink receiving layer with the three-dimensional image, the recessed portions of the three-dimensional image are preferably sized to accommodate all of the pigment in order to improve the scratch resistance of the printed image. The protruding portions of the three-dimensional image are preferably inclined so as to facilitate housing of the pigment particles in the recessed portions. In a case where the protruding portions of the three-dimensional image on the ink receiving layer, which has a high ink absorption speed, are inclined as described above, ink applied to the protruding portions can be allowed to flow quickly into the recessed portions so that most of the ink can be housed in the recessed portions. As depicted in FIG. 15, this makes pigment particles 1310 of ink 1008 positioned at the recessed and protruding portion of the three-dimensional image 1300 less likely to come into contact with an external scratching object 1305, improving the scratch resistance of the image. Such a recessed and protruding portion with a certain level of inclination also allows the ink receiving layer 53 to be restrained from being sticky. On the other hand, in a case where the protruding portions of the three-dimensional image 1300 are not inclined and have flat top surfaces as depicted in FIG. 16, the pigment particles 1310 may be likely to remain on the top surfaces of the protruding portions, reducing the scratch resistance. Depending on the material of the ink receiving layer and conditions of scratching, the ink receiving layer itself may be likely to be scraped by scratching. In such a case, the shape of the recessed and protruding portion of the three-dimensional image may be set with the strength of the ink receiving layer, the conditions of scratching, and the like taken into account. For example, a shape with inclined protruding portions or a shape with protruding portions with flat top surfaces may be selected.

[2-2] Width of the Protruding Portion of the Three-Dimensional Image

The width of each of the protruding portions of the three-dimensional image is a length (width) 1301(1) from one base point to the other base point of a protruding portion (substrate-side protruding portion) 1312 of the three-dimensional image on the substrate 50 side as depicted in FIG. 1. As depicted in FIG. 13 and FIG. 14, the protruding portion 1312 corresponds to the width of each of the recessed portions (ink receiving layer-side recessed portions) of the three-dimensional image on the ink receiving layer 53 side. The width of the protruding portion as described above is not particularly limited and may be selected according to the image expressed by the three-dimensional image. The width is set so as to make the image easily visible. For example, the width of the protruding portion that is visible to the naked eye is approximately 10 μm, and thus, setting the width to 10 μm or more allows the visibility of the three-dimensional image to be improved.

Moreover, in order to improve the scratch resistance of the image printed using the pigment ink, the widths of the recesses and protrusions of the three-dimensional image are preferably set so as to make an external scratching object less likely to come into contact with the pigment particles forming the image. That is, the width of each substrate-side protruding portion is preferably set larger than the average particle size of the pigment particles so as to allow the pigment particles to enter the ink receiving layer-side recessed portions. The pigment ink that can be ejected using an ink jet printing method has an average particle size of 100 nm or more, and thus, setting the width of each protruding portion to 500 nm or more allows the pigment particles to be housed in the ink receiving layer-side recessed portions, improving the scratch resistance. More preferably, setting the width of each protruding portion to 10 μm or more allows the pigment particles to be sufficiently housed in the ink receiving layer-side recessed portions, further improving the scratch resistance.

If the width of each protruding portion is less than 500 nm, the pigment particles are less likely to enter the ink receiving layer-side recessed portions and may remain on the front surface of the ink receiving layer, reducing the scratch resistance. On the other hand, in a case where each protruding portion has an excessively large width, even in a case where the pigment particles are protected in the ink receiving layer-side recessed portions, the scratching object enters the recessed portion to come into contact with the pigment particles, which are likely to be scraped off. Therefore, in order to improve the scratch resistance of the image printed with the pigment ink, the width of each protruding portion needs to be set to make the scratching object 1305 less likely to come into contact with the pigment particles as depicted in FIG. 15.

The results of the inventors' examinations indicate that, given a flat scratching object that is formed of a material such as general plastics and that is relatively hard and unlikely to be deformed, the each protruding portion preferably has a width of 100 μm or less. Given a scratching object such as the finger which has a relatively soft surface, each protruding portion preferably has a width of 50 μm or less because the surface of the scratching object is likely to be deformed to allow the scratching object to enter the recessed portions.

Consequently, the scratch resistance of the image printed with the pigment ink can be improved by setting the width of each substrate-side protruding portion preferably to 500 nm or more and 10 μm or less and more preferably to 10 μm or more and 50 μm or less. Furthermore, setting the width of each protruding portion to 10 μm or more allows the visibility of the three-dimensional image to be improved. The preferred width of the protruding portion depends on the method for viewing the three-dimensional image, the average particle size and viscosity of the pigment particles, the material, shape, surface roughness, and flexibility of the scratching object, and may thus be set as needed taking these factors into account. The width of the protruding portion can be checked using a microscope.

[2-3] Width of the Recessed Portion of the Three-Dimensional Image

The width of each of the recessed portions of the three-dimensional image on the substrate side is a length (width) 1301(2) from one base point to the other base point of a protruding portion 1313 as depicted in FIG. 1. As depicted in FIG. 13 and FIG. 14, the recessed portion 1313 corresponds to the width of each protruding portion of the three-dimensional image on the ink receiving layer 53 side. The width of the recessed portion as described above is not particularly limited and may be selected according to the image expressed by the three-dimensional image. The width is set so as to make the image easily visible. The width of the recessed portion is preferably 500 nm or more and 100 μm or less. For example, the width of the recessed portion that is visible to the naked eye is approximately 10 μm, and thus, setting the width to 10 μm or more and 50 μm or less allows the visibility of the three-dimensional image to be improved.

The width of the substrate-side recessed portion is preferably set so as to inhibit the ink receiving layer-side protruding portions from being destroyed during scratching. In a case where a transfer material from which the substrate is peeled off is used, the recessed and protruding three-dimensional image on the substrate is transferred to the ink receiving layer in an inverted form, and thus, the substrate-side recessed portions of the transfer material correspond to the ink receiving layer-side protruding portions. A reduced width of the substrate-side recessed portion decreases the width and the strength of the ink receiving layer-side protruding portion. Thus, in a case where the image printed on the front surface of the ink receiving layer is scratched, the protruding portions may be broken, precluding the pigment particles from being protected. This may reduce the scratch resistance. An excessively large width of the ink receiving layer-side protruding portion may make the pigment particles likely to remain on the protruding portions, reducing the scratch resistance. The width of the ink receiving layer-side recessed portion is preferably set to a magnitude at which the pigment particles are likely to enter the inside the recessed portion.

The width of the ink receiving layer-side recessed portion is set, for example, smaller than the expected length of each side of a print pixel in the ink jet printing method. Consequently, at least a portion of the ink having landed on the bonding layer is inevitably housed in the ink receiving layer-side recessed portion, improving the scratch resistance. Basically, the width of the substrate-side recessed portion needs to be set according to the intended purpose of the printed material and required scratch resistance. In order to increase the strength of the ink receiving layer-side protruding portion, the substrate-side recessed portions are preferably inclined like valleys so as to incline the ink receiving layer-side protruding portions like mountains.

[2-4] Height of the Recessed and Protruding Portion of the Three-Dimensional Image The height of the recessed and protruding portion of the three-dimensional image on the substrate side (the height from the deepest portion of each recessed portion to the top of each protruding portion) is a length 1302 from the deepest portion of the recessed portion to the top of the protruding portion as depicted in FIG. 1 (see FIG. 13 and FIG. 14). The height 1302 of the recessed and protruding portion is not particularly limited and may be selected according to the image expressed by the three-dimensional image. The width is set so as to make the image easily visible.

The height of the recessed and protruding portion of the three-dimensional image is preferably set larger than the average particle size of the pigment ink so as to allow the pigment ink to be completely housed in the ink receiving layer-side recessed portions. This allows the pigment ink to be housed in the ink receiving layer-side recessed portions without sticking out from the recessed and protruding portion of the three-dimensional image, enabling the pigment particles to be protected by the ink receiving layer-side protruding portions to improve the scratch resistance. Specifically, in a case where the pigment ink that can be ejected using the ink jet printing method is assumed to have an average particle size of approximately 100 nm, the recessed and protruding portion preferably has a height of 500 nm or more and more preferably 1 μm or more. In a case where the height of the recessed and protruding portion of the three-dimensional image is less than 500 nm and smaller than the average particle size of the pigment particles, the pigment particles may stick out from the recessed and protruding portion to reduce the scratch resistance.

[2-5] Relation Between the Thickness of the Ink Receiving Layer and the Height of the Recessed and Protruding Portion of the Three-Dimensional Image As depicted in FIG. 1, a thickness 1303 of the ink receiving layer 53 is preferably larger than the height 1302 of the recessed and protruding portion of the three-dimensional image 1300. This makes the front surface of the ink receiving layer 53 flat and allows the pieces of the adhesive 1002 of the bonding layer 1012 to be discretely provided on the front surface of the ink receiving layer 53 without being affected by the recessed and protruding portion of the three-dimensional image 1300. Therefore, in a case where an image (first image) is printed on the ink receiving layer 53, the ink is absorbed through the front surface of the exposed portions of the ink receiving layer, which has a high ink absorption speed, suppressing possible image bleeding.

Figure 17:
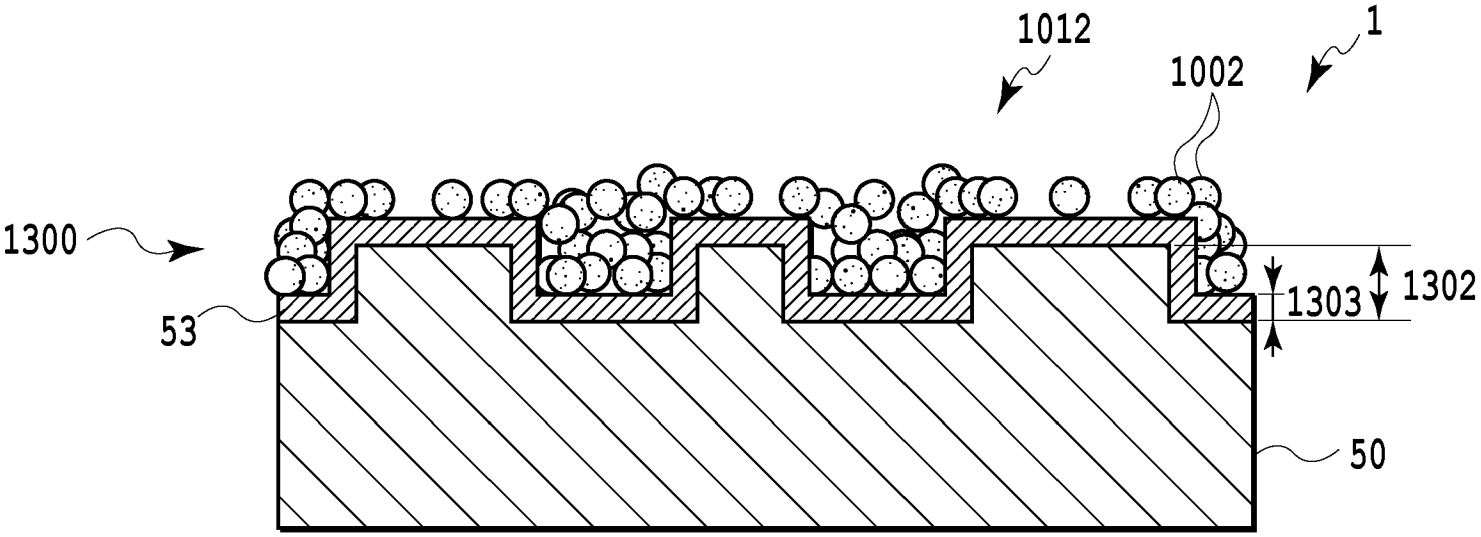
FIG. 17 is a diagram illustrating a relation between the thickness of the image based on the three-dimensional micro-structure and the bonding layer.

In a case where the height 1302 of the recessed and protruding portion of the three-dimensional image is larger than the thickness 1303 of the ink receiving layer 53 as depicted in FIG. 17, the recessed and protruding shape of the three-dimensional image 1300 appears on the front surface of the ink receiving layer 53. In a case where the pieces of the adhesive are discretely provided on the front surface of the ink receiving layer 53, much of the adhesive 1002 is distributed in the recessed portions of the three-dimensional image. Thus, the thickness of the bonding layer 1012 varies more significantly, resulting in an increased thickness of parts of the bonding layer 1012 corresponding to the recessed portions of the three-dimensional image 1300. The adhesive has a low ink absorption speed, and thus, ink having landed on thicker parts of the adhesive is less likely to reach the ink receiving layer. Therefore, the ink absorptivity may vary between parts of the adhesive corresponding to the protruding portions of the three-dimensional image 1300 and parts of the adhesive corresponding to the recessed portions of the three-dimensional image 1300, leading to degradation of the print characteristics such as the likelihood of image bleeding.

The height of the recessed and protruding portion of the three-dimensional image is preferably set to improve the print characteristics of the transfer material. An excessively large height of the three-dimensional image leads to a local variation in the thickness of the ink receiving layer. The thickness of the ink receiving layer locally varies significantly. In a case where an image is printed on the ink receiving layer as described above, ink absorption capacity varies significantly between the thick parts and the thin parts of the ink receiving layer. The thin parts of the ink receiving layer have only a small absorption capacity, and a portion of the ink that has failed to be absorbed into the thin parts flows to the thick parts of the ink receiving layer, where the portion of the ink is absorbed. Thus, image bleeding may occur in the thin parts of the ink receiving layer, and image density may vary between the thick parts and the thin parts of the ink receiving layer, resulting in degraded print characteristics. Specifically, in a case where the ink receiving layer is assumed to have a thickness of 15 μm, the recessed and protruding portion of the three-dimensional image preferably has a height of approximately 10 μm or less and more preferably approximately 5 μm or less. Setting the height of the recessed and protruding portion within this range allows suppression of a variation in the absorption capacity of the ink receiving layer, improving the print characteristics. Basically, the height of the recessed and protruding portion of the three-dimensional image needs to be controlled according to the thickness of the ink receiving layer and the like so as to allow the print characteristics of the transfer material to be maintained.

The height of the recessed and protruding portion of the three-dimensional image is preferably selected so as not to degrade the conveyance performance and curl resistance of the transfer material and the curl resistance of the printed material. Given a substrate of a general PET film, the height of the recessed and protruding portion is equal to or smaller than approximately half of the thickness of the substrate and more preferably equal to or smaller than one-third of the thickness of the substrate. Specifically, in a case where the substrate has a thickness of 19 μm, the recessed and protruding portion preferably has a height of 10 μm or less and more preferably 5 μm or less. In a case where the height of the recessed and protruding portion is set equal to or smaller than half of the thickness of the substrate, the substrate may be provided with the three-dimensional image with the strength of the substrate maintained and without degradation of the conveyance performance and the curl resistance, which are the original properties of the substrate.

In a case where the height of the recessed and protruding portion of the three-dimensional image is larger than half of the thickness of the substrate, the recessed and protruding portion may contribute to reducing the stiffness and the strength of the substrate and degrading the conveyance performance and the curl resistance of the transfer material. An excessively large depth of the recessed portions of the three-dimensional image may cause defects during coating of the ink receiving layer. However, even in a case where the height of the recessed and protruding portion is larger than half of the thickness of the substrate, the conveyance performance may be delivered by increasing the thickness of the substrate or using a harder material for the substrate. Basically, the height of the recessed and protruding portion needs to be adjusted so as to allow the conveyance performance of the transfer material to be maintained.

As described above, the height of the recessed and protruding portion of the three-dimensional image is preferably equal to or smaller than the thickness of the ink receiving layer. In a case where the substrate is assumed to have a thickness of 19 μm, the height of the recessed and protruding portion is preferably 50 nm or more and 10 μm or less and more preferably 1 μm or more and 5 μm or less. Setting the height of the recessed and protruding portion as described above allows suppression of image distortion caused by local bleeding of the ink to enhance the conveyance performance of the transfer material and enables improvement of the scratch resistance of the image printed with the pigment ink. The height of the recessed and protruding portion of the three-dimensional image may be set as needed according to the method for viewing the three-dimensional image, the average particle size and viscosity of the pigment particles of the ink, the material, shape, surface roughness, and flexibility of the scratching object. The height of the recessed and protruding portion of the three-dimensional image can be determined by measuring an arithmetic mean height Sa of the recessed and protruding portion using a method compliant with a standard (international standard ISO 25178) specifying a method for evaluating the surface roughness.

[2-6] Other Configurations

Figure 19:
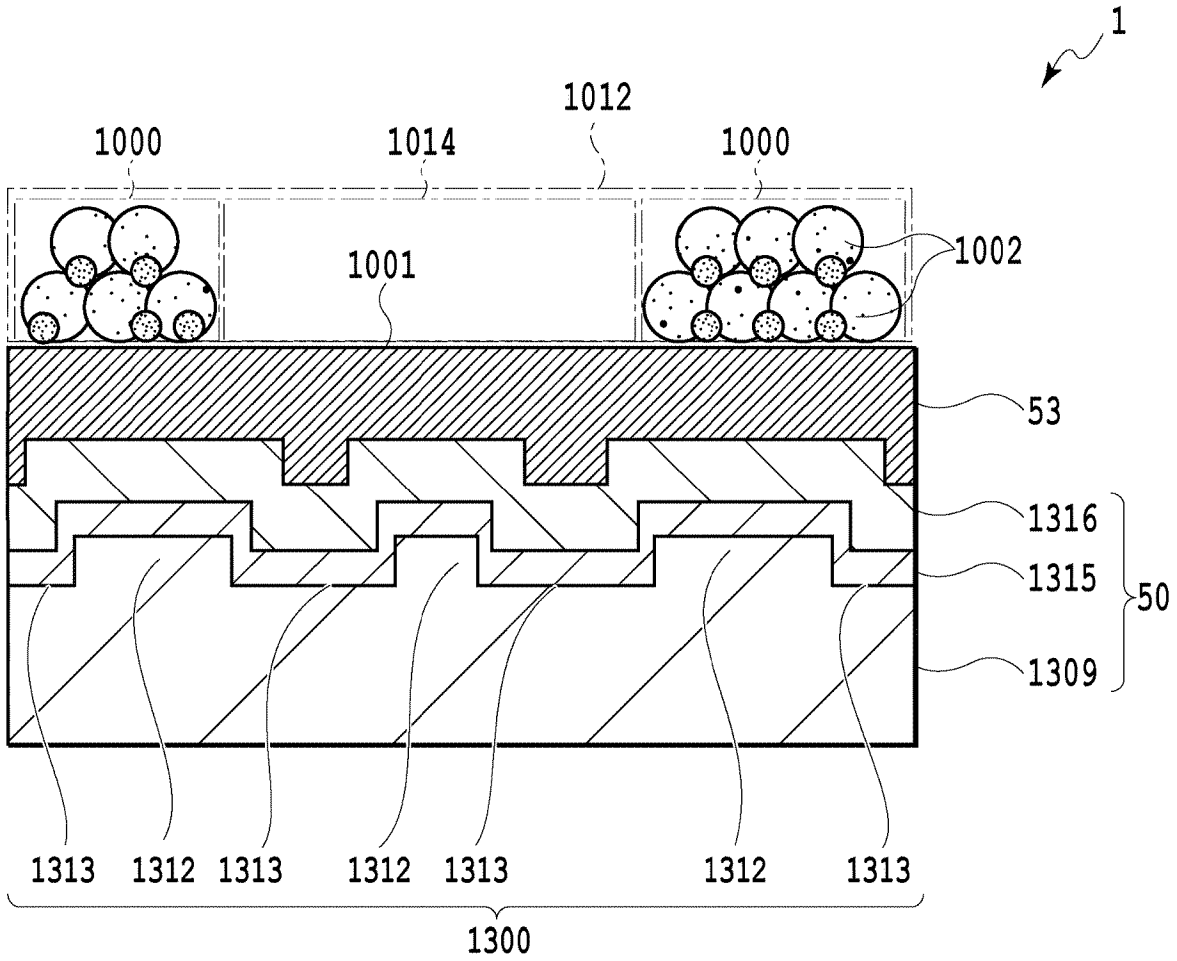
FIG. 19 is a cross-sectional view of a transfer material including a light transmission regulating layer and an anchor layer.

The visibility of the three-dimensional image is further improved in a case where the difference in optical refractive index between the ink receiving layer with an externally exposed three-dimensional image and the air layer in contact with the ink receiving layer is greater than the difference in optical refractive index between the ink receiving layer and the substrate. Furthermore, in order to improve further the designability and visibility of the three-dimensional image, a semi-transmissive/semi-reflective light transmission regulating layer 1315 may be provided on the recessed and protruding three-dimensional image 1310 on the substrate 50 as depicted in FIG. 19. In this case, the ink receiving layer 53 and the bonding layer 1012 may be provided via the anchor layer 1316 on the light transmission regulating layer 1315 in the substrate 50 including the conveyance layer 1309. However, in a case where an image is additionally printed on the recessed and protruding front surface of the ink receiving layer 53 corresponding to the three-dimensional image 1300 of the substrate 50 after the transfer material as described above is transferred to the image support, action is taken to inhibit air gaps in the front surface of the ink receiving layer 53 from being occluded by the light transmission regulating layer 1315, the anchor layer 1316, and the like. To achieve this, the film strength, film thickness, and bonding strength of each of the layers are adjusted in a balanced manner, and conditions for heating and pressurization during transfer are finely adjusted.

In order to improve the security and the designability of the three-dimensional image, various well-known lens effects and hologram effects and the like may be utilized. Utilization of these effects allows the ink receiving layer to be used as a hologram layer. The hologram may be, for example, a planar hologram or a volume holograph, and as the planar hologram, a relief hologram is preferable in terms of mass productivity and costs.

Other available examples of the hologram include laser reconstruction holograms such as a Fresnel hologram, a hologram, a lensless Fourier transform hologram, and an image hologram, and white light reconstruction holograms such as a rainbow hologram. Moreover, the present embodiment allows the use of a color hologram, a computer hologram, a hologram display, a multiplex hologram, a holographic stereogram, a holographic grating, and the like which utilize the principles of the above-described holograms.

[3] Substrate

[3-1] Functions of the Substrate

The substrate 50 is a sheet serving as a support for the ink receiving layer 53 and the bonding layer 1012 as depicted in FIG. 1. The substrate 50 functions as a conveyance layer configured to enhance the conveyance performance of the transfer material 1 by restraining curling of the transfer material 1 when an image is printed on the transfer material 1 before bonding (transfer) and when the transfer material 1 and the printed material are bonded together. The recessed and protruding portion three-dimensional image 1300 may be provided on the surface of the substrate that is in contact with the ink receiving layer 53. The three-dimensional image on the substrate may be covered with the ink receiving layer of the air gap absorption type to improve the visibility of the three-dimensional image to allow the ink receiving layer to function as a hologram layer. To improve further the visibility of the three-dimensional image, a thin metal film may be formed on the hologram layer before the ink receiving layer is provided. In a case where the substrate is peeled off after the transfer material is bonded (transferred) to the image support, the three-dimensional image on the substrate is transferred to the ink receiving layer in an inverted form, and thus, the substrate functions as a platen for the three-dimensional image for the ink receiving layer. An image (second image) may be additionally printed, using the ink jet method or the like, on the front surface of the three-dimensional image on the ink receiving layer that has been exposed as a result of peel-off of the substrate.

The substrate may have other functions. For example, after a printed material is manufactured by printing an image on the transfer material and executing a bonding (transfer) process on the transfer material, (1) the conveyance layer of the substrate is left on the printed material instead of being peeled off so that the substrate functions as a protective layer for the printed image on the printed material. After the bonding process on the transfer material, (2) all of the substrate including the conveyance layer is peeled off so that the substrate functions as a separator. (3) In a case where the substrate includes the function of a protective layer, a preliminary print layer, or the like, only the conveyance layer is peeled off (a part of the substrate is peeled off) after the bonding process on the transfer material so that the conveyance layer (a part of the substrate) in the substrate functions as a separator, while the remaining part of the substrate functions as a protective layer or a security layer for the printed image. As described above, the conveyance layer of the substrate may or may not be peeled off, and either a "case where the conveyance layer of the substrate is not peeled off" or a "case where the conveyance layer of the substrate is peeled off" may be selected depending on the intended purpose of the transfer material and the printed material. The "case where the conveyance layer of the substrate is peeled off" may be described as "peel-off of all or a part of the substrate".

In a case where the conveyance layer of the substrate is peeled off, the conveyance layer may include a release layer in order to allow a peel-off function to be properly fulfilled. The release layer is formed of a composition containing a release agent and is provided in the conveyance layer. Provision of the release layer allows the conveyance layer to be easily peeled off. In a case where the release layer is provided in the substrate and the substrate is allowed to function as a platen for the three-dimensional image, the release layer is formed to a small thickness so as not to fill the recessed portions of the recessed and protruding three-dimensional image. The thickness of the release layer may be controlled to allow the three-dimensional image on the substrate to be transferred to the ink receiving layer. An excessively thick release layer fills the recessed portions of the three-dimensional image on the substrate to flatten the three-dimensional image, which is thus difficult to view. This may further inhibit the three-dimensional image from being transferred to the ink receiving layer. The thickness of the release layer may be set with the bonding conditions for the transfer material and the like taken into account so as to allow the three-dimensional image on the substrate to be formed on the ink receiving layer.

[3-2] Case where the Conveying Layer of the Substrate is not Peeled Off

A printed material will be described which is manufactured using a transfer material from which the conveyance layer of the substrate is not peeled off. The substrate described below in [3-2] to [3-3-5] has a protruding and recessed three-dimensional image on a surface thereof to function as a platen for the three-dimensional image that allows the three-dimensional image to be transferred to the ink receiving layer.

Figure 4:
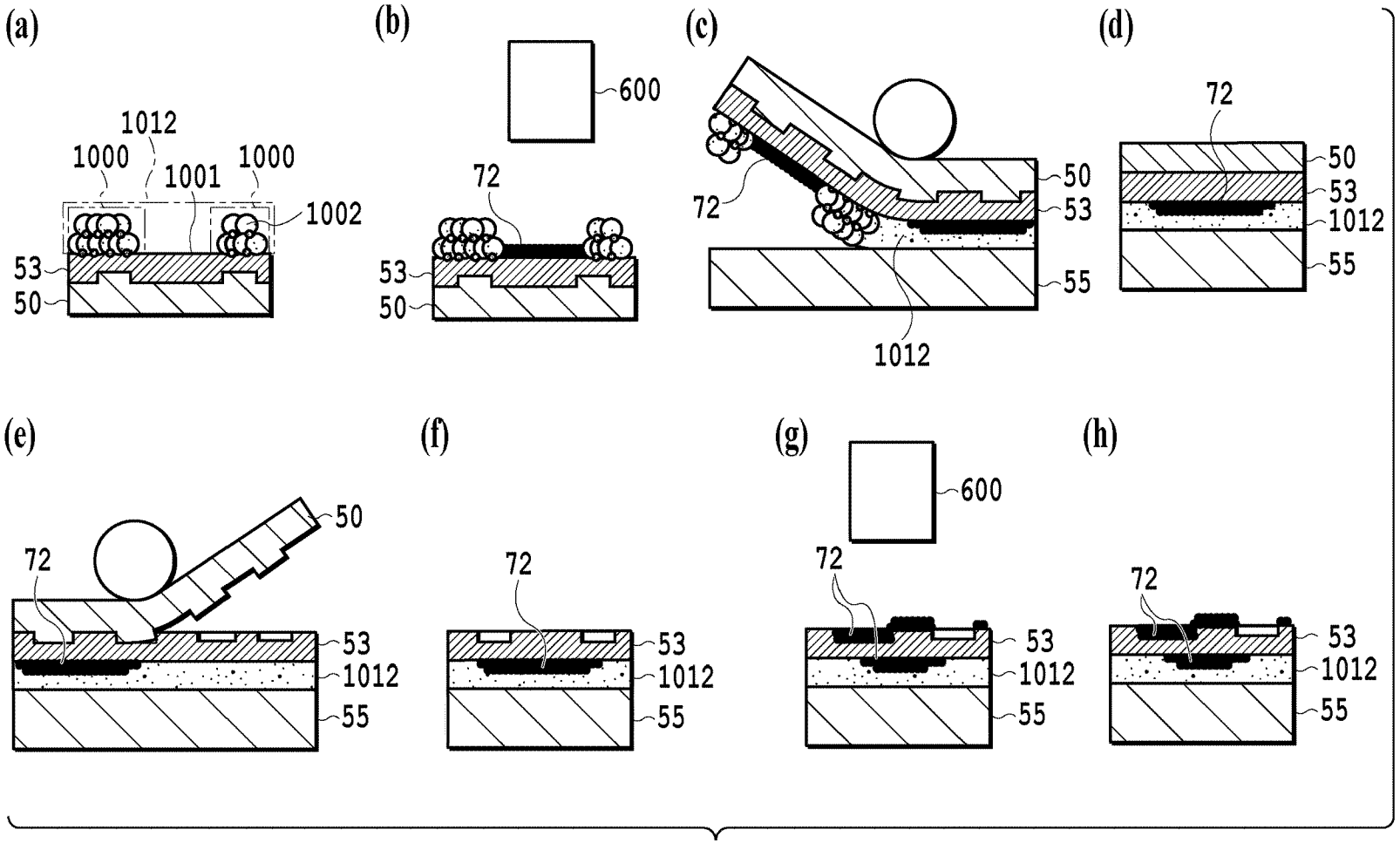
FIG. 4 is a process diagram illustrating a manufacturing method for a printed material.

[3-2-1] Printed Material Manufactured Using the Transfer Material from which the Substrate is not Peeled Off The transfer material from which the conveyance layer of the substrate is not peeled off is configured by providing the ink receiving layer 53 of the air gap absorption type on the substrate 50 provided with the protruding and recessed three-dimensional image, and discretely providing aggregates of pieces of the adhesive 1002 included in the bonding layer 1012 on the front surface of the ink receiving layer 53 as depicted in a part (a) of FIG. 4. As is the case with the transfer material 1 in FIG. 1, the front surface of the ink receiving layer 53 is provided with areas where the bonding portions 1000 of the bonding layer 1012 are positioned and the exposed portions 1001 not including the adhesive 1002. The transfer material 1 in the part (a) of FIG. 4 enables the three-dimensional image positioned between the ink receiving layer 53 and the transparent substrate 50 to be viewed based on the difference in optical refractive index between the ink receiving layer 53 and the transparent substrate 50. To allow the transfer material suitable for the intended purpose to be selected for use, the transfer material is identified from the three-dimensional image before an image is formed on the transfer material 1. This allows avoidance of inconveniences such as the misuse of a hologram image.

To manufacture a printed material, first, ink is applied to a print surface of the transfer material 1 via a print head 600 to print a first image 72 as depicted in a part (b) of FIG. 4. At this time, as described above, a portion of the ink passes through the space between the bonding portions 1000 to come into contact with the exposed portion 1001 of the ink receiving layer 53. Consequently, the ink is drawn and absorbed into the ink receiving layer 53 without passing through the bonding layers 1000. Then, as depicted in a part (c) of FIG. 4, the ink receiving layer 53 is bonded (transferred) to the image support 55 with the discretely arranged aggregates of pieces of the adhesive 1002 to provide a printed material as depicted in a part (d) of FIG. 4.

The printed material is configured such that the bonding layer 1012, the ink receiving layer 53, and the substrate 50 with the three-dimensional image provided thereon are sequentially laminated. The protruding and recessed portion of the three-dimensional image provided on the substrate has the visibility thereof improved by being covered with the ink receiving layer, which has an optical refractive index different from that of the three-dimensional image. The substrate and the ink receiving layer function as a protective layer for the printed image to allow the weatherability of the printed image to be improved. In a case where the image support has no breatherability and the substrate covering the ink receiving layer has only low moisture permeability, the color material of the printed image may re-diffuse due to residual moisture of the ink resulting from image printing and moisture absorption during storage of the printed material, leading to image bleeding. Thus, particularly in a case where an image is printed from the bonding layer side using a dye ink and the ink jet method, the substrate covering the ink receiving layer is preferably formed of a material with a certain level of moisture permeability.

In a case where at least one of the substrate 50 and the image support 55 is transparent, the printed image 72 is visible from the transparent substrate 50 side or the image support 55 side. The transfer material from which the conveyance layer of the substrate is not peeled off may preferably be used to manufacture a printed material used for a construction material, wallpaper, and the like. In a case where an image is viewed from the transparent substrate side, an inverted image is printed as the image. On the other hand, in a case where an image is viewed from the image support side, a normal image is printed as the image. Similarly, in a case where a three-dimensional image is viewed from the transparent substrate side, an inverted image of the three-dimensional image is printed on the substrate. On the other hand, in a case where a three-dimensional image is viewed from the image support side, a normal image of the three-dimensional image is printed on the substrate. The three-dimensional image is viewed based on the difference in optical refractive index between the substrate and the ink receiving layer. Therefore, in a case where the substrate is not peeled off after transfer, it is important to increase sufficiently the difference between the optical refractive index of the substrate and the optical refractive index of the ink receiving layer, in order to improve the visibility of the three-dimensional image.

Figure 2B:
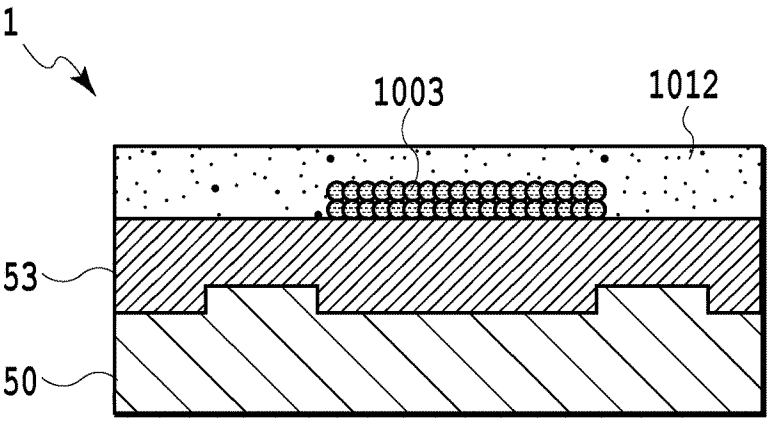
FIG. 2A and FIG. 2B are diagrams each illustrating an adhesive of a self melt bonding type.
Figure 2A:
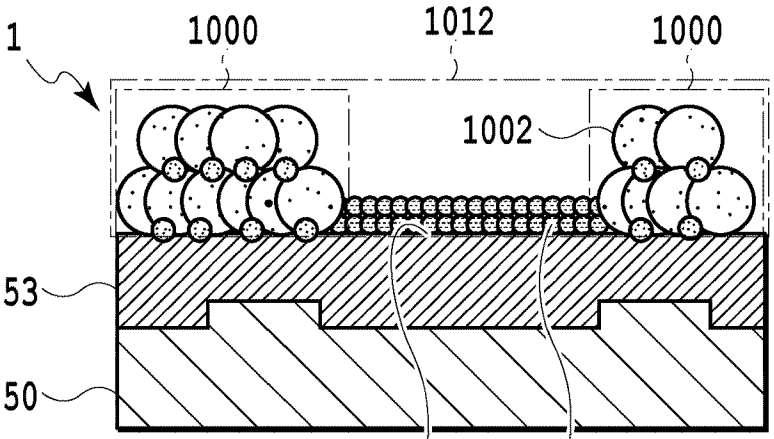

[3-2-2] Printed Material Manufactured Using a Self-Melt Transfer Material from which the Conveying Layer of the Substrate is not Peeled Off A self-melt transfer material from which the conveyance layer of the substrate is not peeled off is configured as depicted in FIG. 2A. That is, the self-melt transfer material from which the conveyance layer of the substrate is not peeled off is configured by providing the ink receiving layer 53 of the air gap absorption type on the substrate 50 provided with the protruding and recessed three-dimensional image, and discretely providing aggregates of the self-melt adhesive 1002 included in the bonding layer 1012. As is the case with the transfer material 1 in FIG. 1, the front surface of the ink receiving layer 53 is provided with areas where the bonding portions 1000 of the bonding layer 1012 are positioned and the exposed portions 1001 not including the adhesive 1002.

In a case where the printed material is manufactured, ink 1003 is applied to the print surface of the transfer material 1 to print an image as depicted in FIG. 2A, and then, the discretely arranged aggregates of pieces of the adhesive 1002 are self-melted to bond the adjacent aggregates of pieces of the adhesive 1002 together. As described above, the printed material is manufactured by forming a film of the adhesive 1002 on the front surface of the ink receiving layer 53. The self-melt transfer material as described above may preferably be used to manufacture a printed material for sign display plate and poster applications and the like.

As described above, the aggregates of the self-melt adhesive discretely provided on the front surface of the ink receiving layer are self-melted on heating after image printing, so as to bond the adjacent aggregates of pieces of the adhesive together. Consequently, the front surface of the ink receiving layer is coated with the film of the adhesive. The adhesive forms a firm film to function as a protective film for the image. In particular, in a case where the ink is a pigment ink, the pigment, which is the color material of the ink, is likely to remain on the front surfaces of the exposed portions of the ink receiving layer, and may have difficulty infiltrating into the ink receiving layer. In this case, the bonding between the ink receiving layer and the pigment ink on the front surface of the ink receiving layer is weak, and thus, the front surface of the ink receiving layer is likely to fall off as a result of scratching or the like. However, as depicted in FIG. 2B, thermal treatment using the self-melt adhesive allows the color material of the pigment ink remaining on the front surfaces of the exposed portions of the ink receiving layer to be coated with the melted adhesive, which thus functions as a protective film for the pigment ink.

In a case where an image is viewed from the transparent substrate side, an inverted image is printed as the image. On the other hand, in a case where an image is viewed from the image support side, a normal image is printed as the image. Similarly, in a case where a three-dimensional image is viewed from the transparent substrate side, an inverted image of the three-dimensional image is printed on the substrate. On the other hand, in a case where a three-dimensional image is viewed from the image support side, a normal image of the three-dimensional image is printed on the substrate. For a self-melt transfer material from which the substrate is not peeled off after transfer, it is important to set a sufficiently great difference between the optical refractive index of the substrate and the optical refractive index of the ink receiving layer in order to improve the visibility of the three-dimensional image.

Figure 3A:
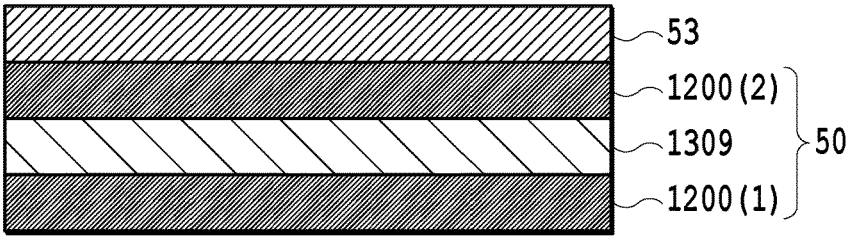
FIG. 3A, FIG. 3B, FIG. 3C, and FIG. 3D are cross-sectional views each illustrating another embodiment of the transfer material.

[3-2-3] Printed Material Manufactured Using a Transfer Material with Heat Seal Layers on the Respective Surfaces of the Substrate FIG. 3A is a cross-sectional view of a transfer material with heat seal layers 1200(1), 1200(2) on the respective surfaces of the substrate 50. The substrate 50 provided with a protruding and recessed three-dimensional image not depicted in the drawings includes the heat seal layer 1200(1) provided on the surface of the substrate 50 opposite to the ink receiving layer 53 and having an excellent bonding capability. The heat seal layer 1200(2) between the substrate 50 and the ink receiving layer 53 is not necessarily provided. In a case where the heat seal layer 1200(2) is provided, a three-dimensional image is preferably provided on the heat seal layer 1200(2) as depicted in FIG. 9A and FIG. 9B.

The transfer material is configured by providing the ink receiving layer 53 of the air gap absorption type on the substrate 50 having the three-dimensional image as described above and discretely providing the front surface of the ink receiving layer 53 with aggregates of the self-melt adhesive 1002 included in the bonding layer 1012. As is the case with the transfer material 1 in FIG. 1, the front surface of the ink receiving layer 53 is provided with areas where the bonding portions 1000 of the bonding layer 1012 are positioned and the exposed portions 1001 not including the adhesive 1002. The printed material is manufactured by applying the ink to the print surface of the transfer material as described above to print the image.

Figure 3B:
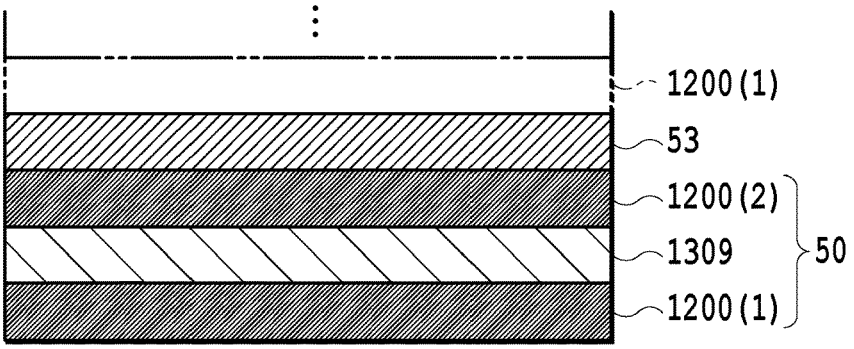
Figure 3C:
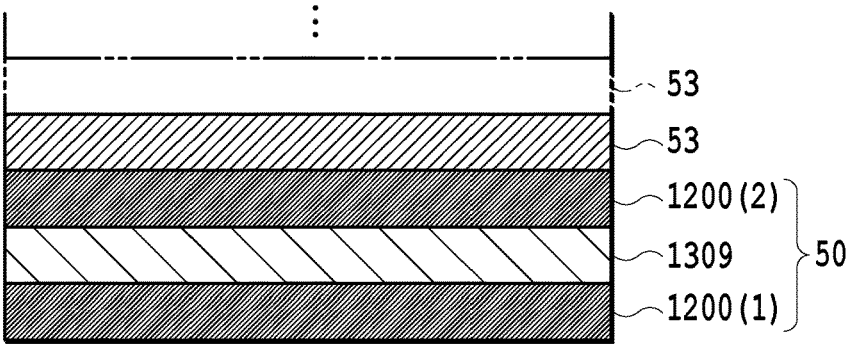
Figure 3D:
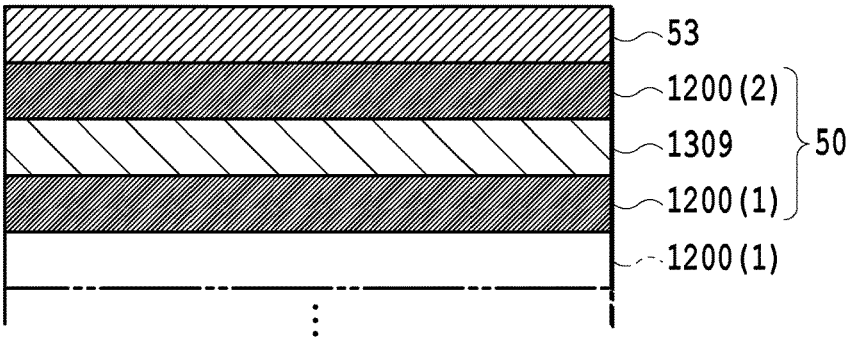

For example, the transfer material may be folded back onto the printed material as described above to allow any other layer or a member such as another transfer material or printed material to be bonded to the printed material via the aggregates of pieces of the adhesive discretely arranged on the front surface of the ink receiving layer 53. For example, the heat seal layer 1200(1) can be bonded to the ink receiving layer 53 as depicted in FIG. 3B, or another ink receiving layer 53 can be bonded to the ink receiving layer 53. Alternatively, as depicted in FIG. 3D, another heat seal layer 1200(1) can be bonded to the heat seal layer 1200(1).

The transfer material and the printed material as described above may preferably be used for applications such as wrapping of boxes or the like in packaging materials. In a case where the transfer material or the printed material is used as a packaging material, the substrate functions not only as a protective layer for the printed image but also as a protective layer for a box wrapped in the packaging material. The heat seal layer 1200(2) may be provided between the substrate 50 and the ink receiving layer 53. In that case, a recessed and protruding three-dimensional image is preferably provided on the heat seal layer 1200(2) formed on the conveyance layer 1309 of the substrate 50 to a large thickness as depicted in FIG. 9A. In a case where the recessed portions of the three-dimensional image are filled with the heat seal layer 1200(2) provided on the three-dimensional image on the conveyance layer 1309 as depicted in FIG. 9B, the functions of the three-dimensional image may be impaired. Therefore, in a case where the heat seal layer 1200(2) is provided on the three-dimensional image, the heat seal layer 1200(2) may be formed to have a reduced thickness so as not to fill the recessed portions of the three-dimensional image. Basically, the thickness of the heat seal layer 1200(2) needs to be set with the bonding conditions and the like taken into account so as to allow the recessed and protruding shape of the three-dimensional image on the substrate to be also formed on the ink receiving layer.

In a case where an image is viewed from the heat seal layer 1200(2) side, an inverted image of the three-dimensional image is printed on the substrate. On the other hand, in a case where an image is viewed from the ink receiving layer side, a normal image of the three-dimensional image is printed on the substrate. For a transfer material with the heat seal layers provided on the respective surfaces of the substrate, the three-dimensional image is viewed based on the difference in optical refractive index between the heat seal layer provided on the front surface of the substrate and the ink receiving layer.

[3-3] Case where the Conveying Layer of the Substrate is Peeled Off

Description will be given that relates to a transfer material from which all of the substrate including the conveyance layer is peeled off and a printed material produced using the transfer material.

[3-3-1] Printed Material in which the Ink Receiving Layer with an Image Printed Thereon is Laminated on the Image Support A transfer material from which all of the substrate including the conveyance layer is peeled off is configured by providing the ink receiving layer 53 of the air gap absorption type on the substrate 50 having the protruding and recessed three-dimensional image and discretely providing the front surface of the ink receiving layer 53 with aggregates of pieces of the adhesive 1002 included in the bonding layer 1012 as depicted in the part (a) of FIG. 4. The front surface of the ink receiving layer 53 is provided with areas where the bonding portions 1000 of the bonding layer 1012 are positioned and the exposed portions 1001 not including the adhesive 1002.

To produce a printed material, first, an inverted image 72 may be printed on the print surface of the transfer material with ink ejected from the ink jet print head 600 as depicted in the part (b) of FIG. 4. At this time, a portion of the ink passes through the space between the bonding portions 1000 to come into contact with the exposed portion 1001 of the ink receiving layer 53. Consequently, the ink is drawn and absorbed into the ink receiving layer 53. Then, as depicted in the part (c) of FIG. 4, the transfer material 1 is bonded (transferred) to the image support 55 with the discretely arranged aggregates of pieces of the adhesive 1002. Subsequently, the conveyance layer (in the present example, all of the substrate 50) is peeled off as depicted in a part (e) of FIG. 4 to provide a printed material as depicted in a part (f) of FIG. 4. At this time, the three-dimensional image provided on the substrate 50 is transferred to the ink receiving layer 53. The visibility of the three-dimensional image is further improved by setting the difference in optical refractive index between the ink receiving layer with the externally exposed three-dimensional image and the air layer contacting the ink receiving layer larger than the difference in optical refractive index between the ink receiving layer and the substrate. The transfer material from which all of the substrate including the conveyance layer as described above may preferably be used for printed material applications such as notification for public documents such as ID cards, employee ID cards, Social Security and Tax Number System cards, and passports.

In the thus produced printed material, the uppermost layer is the ink receiving layer 53 as depicted in the part (f) of FIG. 4, and thus, an image (second image) is additionally printed on the front surface of the printed material. As described above, the ink receiving layer of the air gap absorption type maintains the air gaps after transfer. Therefore, after the inverted image (first image) 72 including secure text information or the like is printed on the printed material as depicted in the part (b) of FIG. 4*a* to produce a printed material as depicted in the part (f) of FIG. 4, a normal image (second image) 72 may also be printed on the front surface of the printed material. The additional printing of the second image is achieved by ink jet printing using the print head 600 as depicted in a part (g) of FIG. 4 or by additional writing, seal affixation, or the like.

In a case where the second image is additionally printed on the front surface of the ink receiving layer to which the three-dimensional image on the substrate has been transferred, the color material of the ink positioned in the recessed portions of the ink receiving layer is less likely to be scratched, improving the scratch resistance of the second image. The scratch resistance of the second image is improved as described above, and thus, the second image is preferably printed using a pigment ink containing a color material itself having high weatherability. As described above, in order to improve further the designability and visibility of the three-dimensional image transferred to the ink receiving layer, the semi-transmissive and/or semi-reflective light transmission regulating layer 1315 and the anchor layer 1316 may be provided for the three-dimensional image 1300 on the substrate 50.

[3-3-2] Multilayer Printed Material

As the printed material, a multilayer printed material may be produced in which multiple ink receiving layers are formed on the image support.

Figure 5:
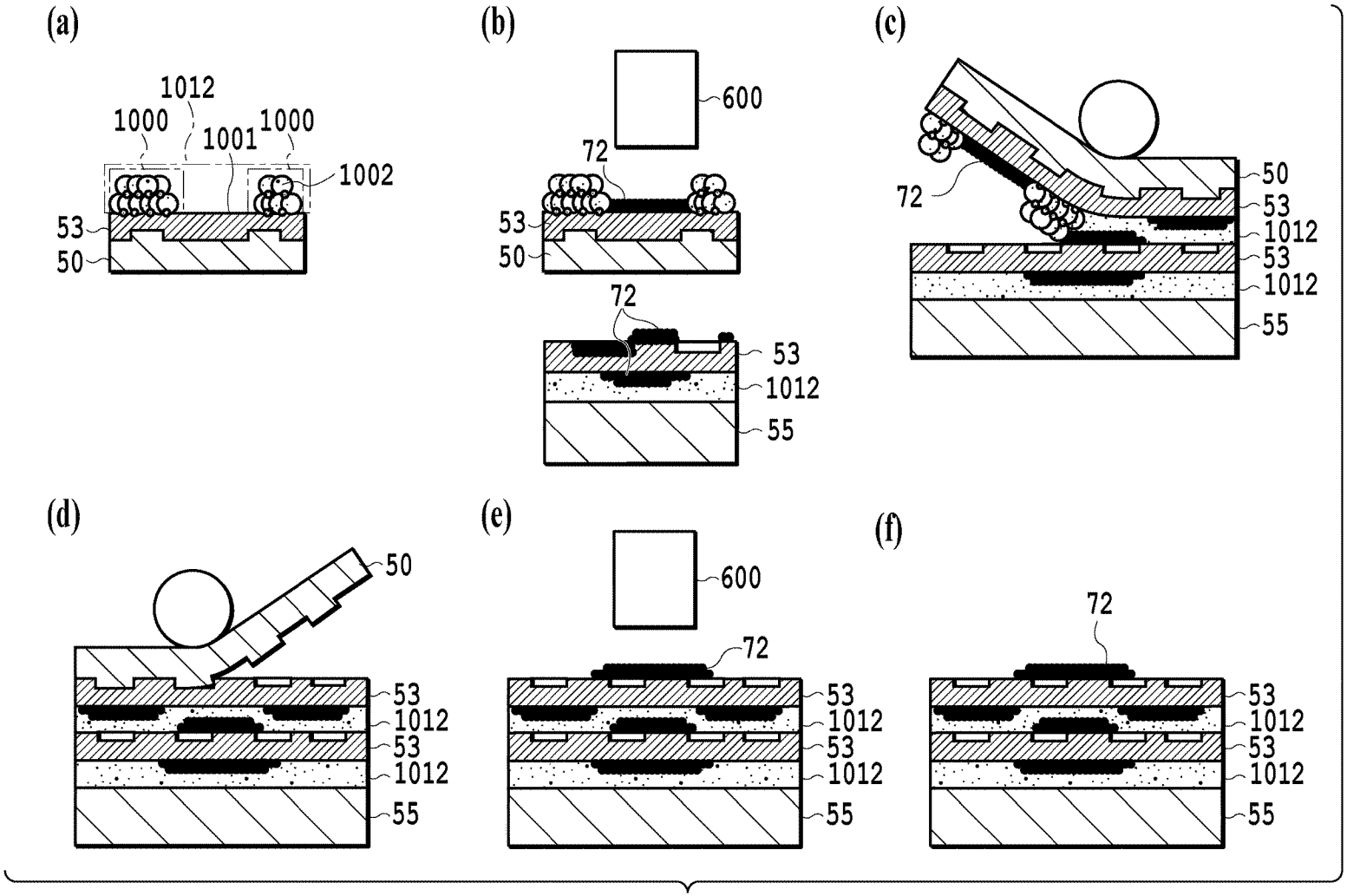
FIG. 5 is a process diagram illustrating another example of the manufacturing method for a printed material.

That is, a transfer material similar to the transfer material in FIG. 1 is prepared as depicted in a part (a) of FIG. 5, and an inverted image 72 is printed on the transfer material with the ink ejected from the print head 600 as depicted in a part (b) of FIG. 5. Then, the transfer material with the inverted image 72 printed thereon is bonded (transferred) to the printed material in the part (h) of FIG. 4 with the aggregates of pieces of the adhesive 1002 discretely arranged on the transfer material (parts (b) and (c) of FIG. 5). For enhanced bonding capability, the thickness of the bonding layer 1002 of the transfer material is preferably set equal to or larger than the thickness of the recessed and protruding portion of the three-dimensional image on the ink receiving layer of the printed material so as to allow the recessed and protruding portion to be absorbed.

Since the aggregates of pieces of the adhesive are discretely provided in the bonding layer 1002, in the bonding portions 100 with the adhesive present therein, the ink receiving layer of the transfer material is bonded to the ink receiving layer of the printed material via the adhesive. On the other hand, in the exposed portions 1001 with no adhesive present therein, the ink receiving layer of the transfer material and the ink receiving layer of the printed material are directly laminated. In a case where the ink receiving layers with the same optical refractive index overlap each other, the three-dimensional image is inhibited from being viewed, bringing the three-dimensional image on the printed material side (the lower layer-side three-dimensional image in the part (c) of FIG. 5) apparently into a grayout state. The lower layer-side three-dimensional image can be made substantially invisible by further reducing the amount of the adhesive. The three-dimensional image can also be additionally printed by transferring the transfer material having a new three-dimensional image (the upper layer-side three-dimensional image in the part (c) of FIG. 5) so as to make the lower layer-side three-dimensional image substantially invisible.

On the other hand, the amount of the adhesive may be increased so that, during transfer, the adhesive is melted to form a uniform layer, to allow the visibility of the lower layer-side three-dimensional image to be maintained based on the difference in optical refractive index between the bonding layer and the ink receiving layer. Three-dimensional images on all the layers can be viewed by configuring the layers so as to inhibit the recessed and protruding portions of the three-dimensional images from being collapsed by pressure applied during transfer. The visibility of the lower layer-side three-dimensional image can be regulated by adjusting the amount of the adhesive according to the intended purpose. As described above, in the printed material in the part (h) of FIG. 4, the transfer material with the first image printed thereon is transferred to the image support, and the second image is additionally printed on the ink receiving layer on the front surface of the transfer material as needed.

After the transfer material is transferred to the printed material, the conveyance layer (in the present example, all of the substrate 50) is peeled off as depicted in the part (d) of FIG. 5. Then, a multilayer printed material provided with multiple ink receiving layers can be produced on the image support 55. The three-dimensional image provided on the substrate 50 is transferred to the ink receiving layer 53 on the front surface side of the printed material. The visibility of the three-dimensional image is further improved by setting the difference in optical refractive index between the ink receiving layer 53 with the thus externally exposed three-dimensional image and the air layer contacting the ink receiving layer larger than the difference in optical refractive index between the ink receiving layer 53 and the substrate 50. Repetition of the transfer of the transfer material as described above allows the ink receiving layer to be formed on the image support as many times as needed. That is, multiple ink receiving layers may be formed on the image support.

In a case where a transfer material is used in which only the ink receiving layer of the air gap absorption type is provided on the substrate, with no bonding layer provided on the front surface of the ink receiving layer, the transfer material has difficulty being laminated onto a printed material in which a material similar to the transfer material has been transferred to the image support. In other words, it is difficult to obtain a multilayer structure by laminating the ink receiving layer of the transfer material and the ink receiving layer of the printed material. General ink receiving layers contain approximately 90% inorganic particulates and approximately 10% water-soluble resin functioning as a binder that binds the inorganic particulates together. The amount of water-soluble resin is thus set substantially smaller than the amount of inorganic particulates to form a large number of air gaps in the ink receiving layer, thus achieving sufficient ink absorptivity. On the front surface of the ink receiving layer of the air gap absorption type as described above, a countless number of recessed portions and protruding portions are formed by the inorganic particulates, which themselves have no bindability. As described above, a countless number of recessed portions and protruding portions are formed on each of the transfer material-side ink receiving layer and the printed material-side ink receiving layer. To allow the ink receiving layers to be bonded together, resin components of a binder for the ink receiving layers need to be melted to flow at a temperature higher than melting temperatures (Tg) of the resin components when the ink receiving layers adhering to each other are thermocompression bonded together.

However, only a small amount of water-soluble resin is melted to flow in the printed material-side ink receiving layer and the transfer material-side ink receiving layer, and thus, it is difficult to fill sufficiently, with the water-soluble resin components, spaces between bonding surfaces of the ink receiving layers formed by the recessed and protruding portions of the front surfaces of the ink receiving layers. This may inhibit an excellent bonding capability from being achieved. In a case where the amount of the water-soluble resin is increased to improve the bonding capability, the air gaps between the inorganic particulates are likely to be filled with the resin to reduce the ink absorptivity of the ink receiving layers, hindering excellent image print characteristics from being achieved.

In a case where a multilayer printed material is manufactured using a transfer material in which only the ink receiving layer of the air gap absorption type is provided on the substrate, with no bonding layer provided on the front surface of the ink receiving layer, the visibility of the lower layer-side three-dimensional image is reduced. That is, since the ink receiving layers with the same refractive index are laminated, the lower layer-side three-dimensional image has reduced visibility. The transfer material of the present invention allows the visibility of the lower layer-side three-dimensional image to be regulated by adjusting the amount of the adhesive. That is, the lower layer-side three-dimensional image can be brought into a grayout state, a substantially invisible state, or a visibility maintained state.

The use of the transfer material of the present embodiment allows the discretely provided aggregates of pieces of the adhesive to be easily melted by thermocompression bonding to fill the spaces formed between the printed material-side ink receiving layer and the transfer material-side ink receiving layer. As a result, a multilayer printed material can be produced in which the ink receiving layers of the air gap absorption type are bonded together to form multiple ink receiving layers on the image support as described above.

The printed material thus provided with multiple ink receiving layers has a front surface formed of the ink receiving layer, enabling the second image (normal image) 72 to be additionally printed using the print head 600 as depicted in the parts (e) and (f) of FIG. 5. In this case, since the ink receiving layer on the front surface of the printed material has a recessed and protruding three-dimensional image, it may be difficult to print adequately the second image using a contact printing method such as additional writing, seal affixation, or thermal transfer. Thus, the ink jet printing method, which is a non-contact method, is preferably used. In a case where it is desirable to print additionally the second image properly using the contact method, a transfer material from which a part of the substrate is peeled off is effectively used as described above. That is, the second image can be additionally printed properly using the contact method by peeling off a part of the substrate to flatten the front surface of the functional layer corresponding to the remaining part of the substrate.

[3-3-3] Printed Material Including a Partly Peeled-Off Transfer Material

Higher durability and security are required for various security cards such as credit cards, passports, and the like which are printed materials manufactured using a transfer material from which only the conveyance layer (a part of the substrate) of the substrate is peeled off. In such a printed material, the substrate may be provided with one or more of a protective layer, a print layer on which an image is pre-printed, and a functional layer (any of the light transmission regulating layer, the anchor layer, and the like). In this case, the three-dimensional image is preferably configured on the front surface of the protective layer, the print layer on which the image is pre-printed, and the functional layer. For example, the heat seal layers 1200(1), 1200(2) may be provided as the functional layer as depicted in FIG. 9A and FIG. 9B. The functional layer (heat seal layer 1200(2)) may be provided on the substrate 50 to a large thickness so as to have a flat front surface as depicted in FIG. 9B to allow the second image to be additionally printed using even the contact method such as thermal transfer after the transfer material is transferred.

Figure 6:
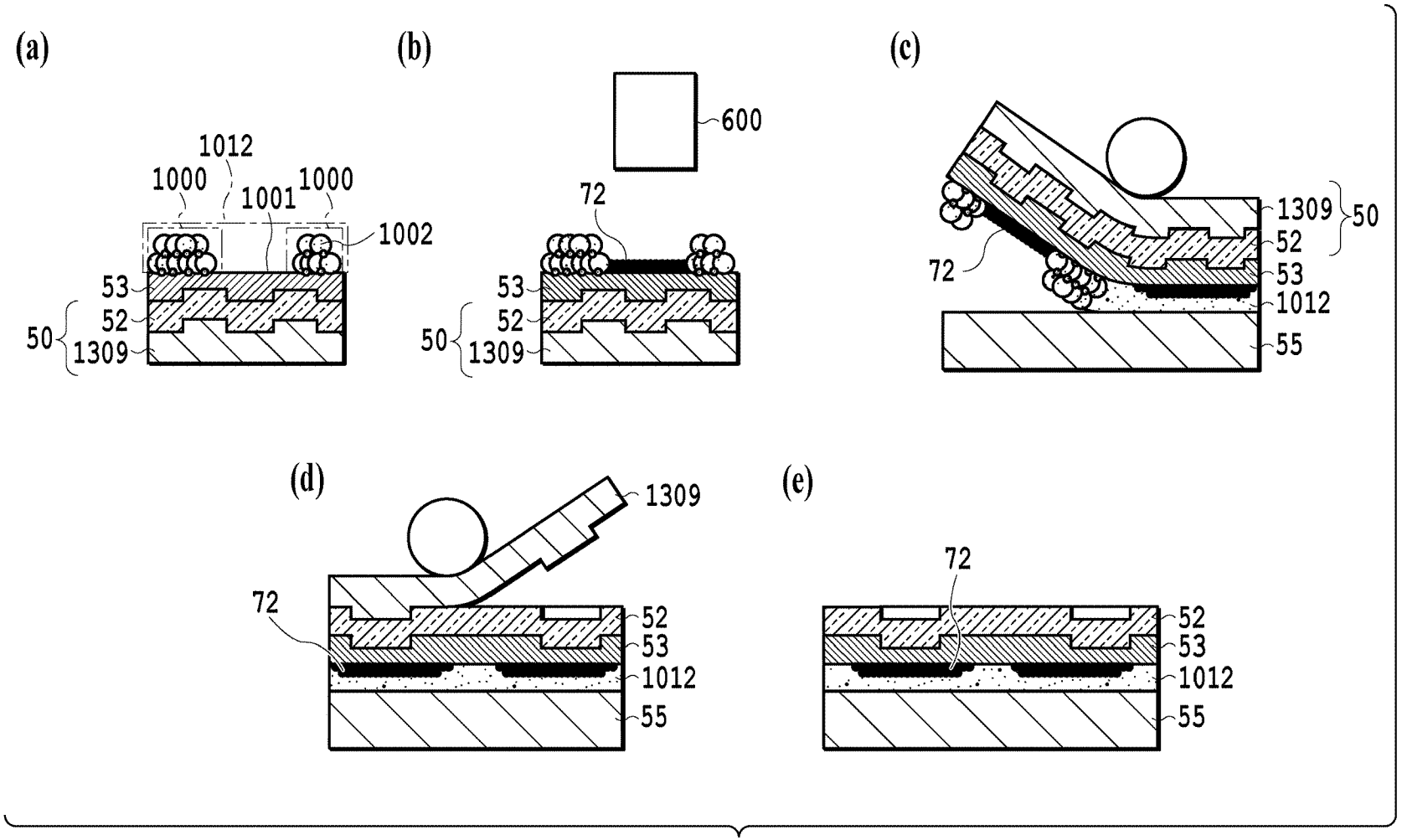
FIG. 6 is a process diagram illustrating yet another example of the manufacturing method for a printed material.
Figure 7:
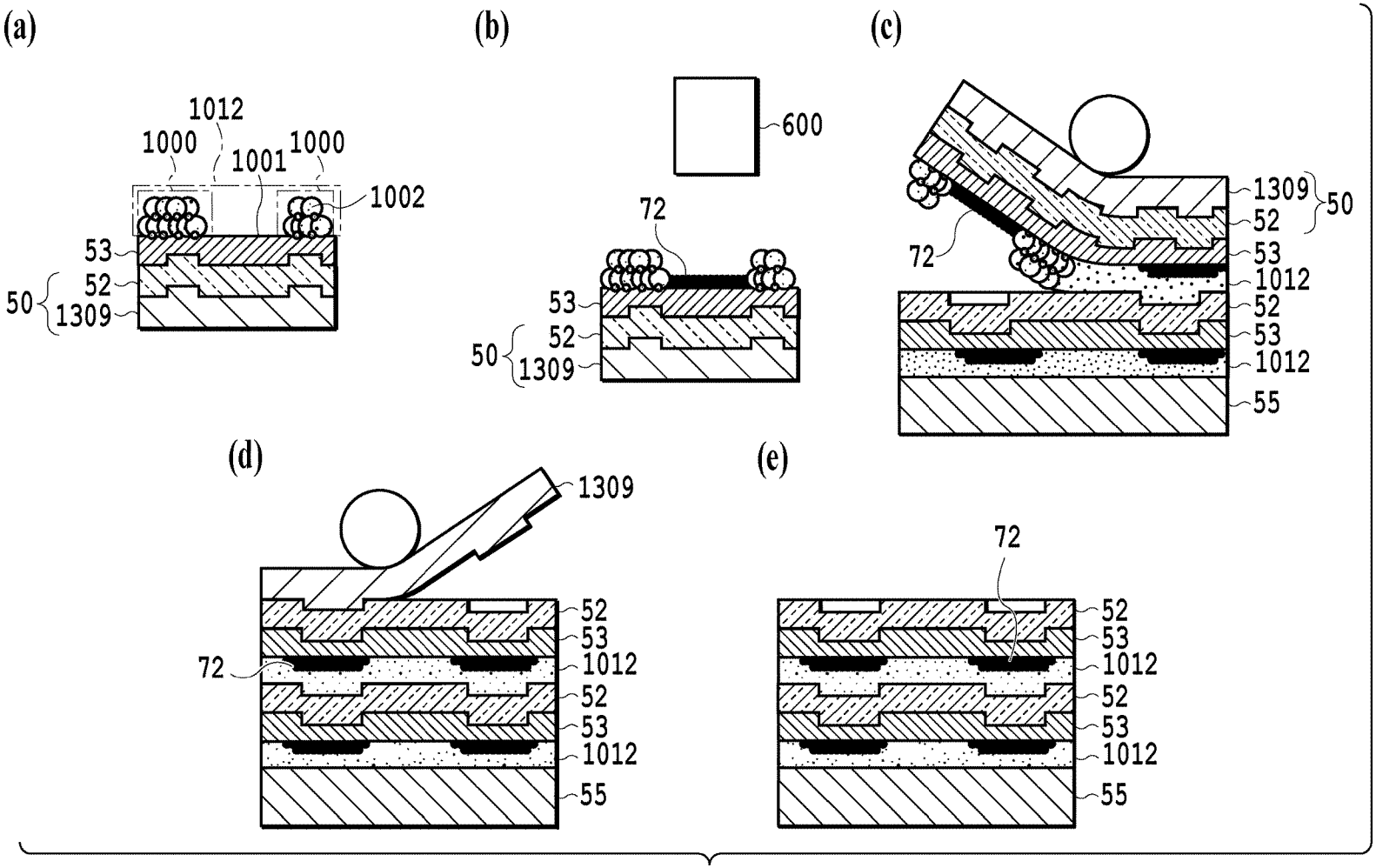
FIG. 7 is a process diagram illustrating yet another example of the manufacturing method for a printed material.

The substrate 50 of the transfer material in a part (a) of FIG. 6 includes the conveyance layer 1309 with a three-dimensional image and the functional layer (a protective layer, a hologram layer, a print layer, or the like) 52 with a three-dimensional image. The ink receiving layer 53 of the air gap absorption type is provided on the functional layer 52, and the aggregates of pieces of the adhesive 1002 included in the bonding layer 1012 is provided on the front surface of the ink receiving layer 53. As is the case with the transfer material 1 in FIG. 1, the front surface of the ink receiving layer 53 is provided with areas where the bonding portions 1000 of the bonding layer 1012 are positioned and the exposed portions 1001 not including the adhesive 1002. The functional layer 52 is, for example, a protective layer or a print layer with an image pre-printed thereon, and a three-dimensional image is formed on the surface of the functional layer 52 that is in contact with the ink receiving layer 53. The three-dimensional image is viewed based on the difference in optical refractive index between the functional layer 52 and the ink receiving layer 53.

To produce a printed material, first, an inverted image 72 is printed on the print surface of the transfer material with ink ejected from the ink jet print head 600 as depicted in a part (b) of FIG. 6. At this time, as described above, a portion of the ink passes through the space between the bonding portions 1000 to come into contact with the exposed portion 1001 of the ink receiving layer 53. Consequently, the ink is drawn and absorbed into the ink receiving layer 53 without passing through the bonding layers 1000. Then, the ink receiving layer 53 is bonded (transferred) to the image support 55 with the adhesive 1002 as depicted in a part (c) of FIG. 6, and then, only a part of the substrate (conveyance layer) is peeled off as depicted in a part (d) of FIG. 6. Consequently, a printed material with the functional layer (a protective layer, a print layer, or the like) 52 laminated on the ink receiving layer 53 is produced as depicted in a part (e) of FIG. 6. Such a printed material includes, as the uppermost layer, the functional layer 52 such as a protective layer, a hologram layer, a print layer, or the like, thus achieving high durability and security.

[3-3-3-1] Protective Layer

The substrate of the transfer material may include a protective layer serving as a functional layer in order to improve the weatherability, scratch resistance, and chemical resistance of the print surface of the image and to protect the three-dimensional image. The protective layer is measured in compliance with the standard "Determination of total luminous transmittance and reflectance based on measurement method B" (Japanese Industrial Standards), which is a part of standards regarding optical characteristics test methods for plastics. Specifically, the protective layer corresponds to a sheet with a total luminous transmittance of 50% or more and preferably 90% or more. Therefore, examples of the protective layer include a translucent protective layer and a colored, transparent protective layer in addition to a colorless, transparent protective layer.

The type of the protective layer is not particularly limited. The preferred protective layer is a sheet or a film formed of a material that is excellent in weatherability, scratch resistance, and chemical resistance and that is compatible with the ink receiving layer.

[3-3-3-2] Print Layer

In order to improve the security of the printed material, the substrate may include a print layer on which an image has been printed and which is not peeled off. An auxiliary, functional image may be pre-printed on the substrate to improve further the security of the printed material.

[3-3-3-3] Light Transmission Regulating Layer and Anchor Layer

In order to improve further the designability and visibility of the three-dimensional image, the protruding and recessed three-dimensional image on the substrate may include a semi-transmissive and/or semi-reflective light transmission regulating layer. For example, as depicted in FIG. 19, the light transmission regulating layer 1315 and the anchor layer 1316 may be provided on the conveyance layer 1309 of the substrate 50. The ink receiving layer 53 of the air gap absorption type and the bonding layer may be provided on the anchor layer 1316, with the bonding layer shaped like the sea and islands as needed. In a case where an image is additionally printed on the recessed and protruding front surface of the ink receiving layer after bonding (transfer) of the transfer material as described above, action is taken to inhibit the air gaps in the front surface of the ink receiving layer from being occluded by the light transmission regulating layer, the anchor layer, and the like. To achieve this, the film strength, film thickness, and bonding strength of each of the layers are adjusted in a balanced manner, and the conditions for heating and pressurization during transfer are finely adjusted. The thicknesses of the light transmission regulating layer and the anchor layer are set so as to inhibit the front surfaces of the light transmission regulating layer and the anchor layer from being flattened as a result of filling of the recessed and protruding portion of the three-dimensional image on the conveyance layer of the substrate with the light transmission regulating layer and the anchor layer. Basically, the light transmission regulating layer and the anchor layer need to be provided so as to form also a recessed and protruding portion on the ink receiving layer.

[4] Materials

[4-1] Ink Receiving Layer of the Air Gap Absorption Type

The ink receiving layer is a layer that receives ink applied using the ink jet printing method. The ink receiving layer in the present embodiment is of the air gap absorption type.

The ink receiving layer of the air gap absorption type allows the visibility of the three-dimensional image thereon to be improved based on the difference in optical refractive index between the ink receiving layer and a layer adjacent thereto at the boundary of the three-dimensional image. The adjacent layer is a layer of the substrate such as the conveyance layer, the functional layer, or the heat seal layer under a condition where the substrate is peeled off, or the air layer under a condition where the substrate has been peeled off, or the bonding layer in a case where the lower layer-side three-dimensional image on the multilayer printed material is assumed. Importantly, the air gaps in the ink receiving layer are maintained in order to improve the visibility of the three-dimensional image on the printed material.

On the other hand, in a case where the ink receiving layer used is of a swelling absorption type, the ink receiving layer of the swelling absorption type absorbs ink and the corresponding part of the ink receiving layer may swell. In such a case, a recessed and protruding portion may be formed on the front surface of the bonding layer to reduce the bonding capability. Furthermore, although the absorption capacity of the ink receiving layer of the swelling absorption type can be increased even with a reduced thickness thereof, the ink receiving layer of the swelling absorption type has a low ink absorption speed due to absorption of the ink between molecules. Thus, even in a case where a portion of the ink comes into contact with the ink receiving layer, only a weak force is exerted by the portion of the ink to draw the remaining portion of the ink continuous with that portion into the ink receiving layer. The ink may remain on the front surface of the bonding layer, leading to improper bonding.

Since the ink receiving layer of the swelling absorption type has a low absorption speed, a speed at which the ink spreads over the front surface of the ink receiving layer 53 is higher than a speed at which the ink is absorbed into the ink receiving layer. Thus, the ink spreads over the front surface of the ink receiving layer, resulting in misalignment of the image and thus the likelihood of image distortion.

In this regard, the ink receiving layer of the air gap absorption type is preferably used. In many cases, the layer adjacent to the ink receiving layer at the boundary of the three-dimensional image is mainly formed of resin. In a case where such a layer and the ink receiving layer of the swelling absorption type also mainly formed of resin are laminated, the difference in optical refractive index between the layers is small, leading to reduced visibility of the three-dimensional image. In a case where a three-dimensional image is formed on the ink receiving layer of the swelling absorption type and an image is printed on the surface of the ink receiving layer on which the three-dimensional image is positioned, a part of the ink receiving layer that has absorbed the ink may swell to reduce significantly the visibility of the three-dimensional image. Consequently, the ink receiving layer of the air gap absorption type is preferably used also in terms of visibility of the three-dimensional image.

The ink receiving layer of the air gap absorption type has air gaps through which the ink is absorbed. The ink receiving layer of the air gap absorption type is formed of, for example, diatomaceous earth, a sponge, microfibers, a water absorptive polymer, a set of resin particles and water-soluble resin, or a set of inorganic particulates and water-soluble resin. The speed at which the ink receiving layer formed of such a material absorbs the ink is higher than the speed at which the adhesive absorbs the ink. Consequently, in a case where a portion of the ink comes into contact with the exposed portion of the ink receiving layer, the ink present on the front surface of the bonding layer or inside the bonding layer can be quickly drawn into the ink receiving layer. In order to improve the visibility of the three-dimensional image, the ink receiving layer is set so as to increase the difference in optical refractive index between the ink receiving layer and the layer adjacent to the ink receiving layer at the boundary of the three-dimensional image.

The ink receiving layer of the air gap absorption type preferably contains inorganic particulates and a water-soluble resin so as to form a fine air gap structure that receives the ink. In the ink receiving layer of the air gap absorption type formed of inorganic particulates and a water-soluble resin, the air gaps through which the ink is absorbed are formed between the inorganic particulates bound together with the water-soluble resin so that a large amount of ink can be absorbed through the air gaps. The air gaps between the inorganic particulates bound together with the water-soluble resin may be substantially uniformly arranged throughout the ink receiving layer to allow the ink to infiltrate substantially isotropically through the ink receiving layer.

In the ink receiving layer of the air gap absorption type formed of inorganic particulates and a water-soluble resin, the structure of the ink receiving layer is easily controlled so as to prevent bonding (transfer) of the transfer material from being hindered by a large amount of ink absorbed into the ink receiving layer. In a case where the air gap structure of the ink receiving layer is destroyed during bonding (transfer) of the transfer material, liquid components of the ink may seep out on the front surface of the ink receiving layer and may be formed into a film, or may be subjected to bumping to generate an air layer or the like on the bonding surface between the ink receiving layer and the image support. In such a case, bonding of the transfer material is hindered. However, in the ink receiving layer of the air gap absorption type formed of the inorganic particulates and the water-soluble resin, the structure of the ink receiving layer is easily controlled so as to inhibit substantially disruption of the air gap structure of the ink receiving layer during transfer.

In the ink receiving layer in which the air gaps are formed by binding the inorganic particulates with the binder of the water-soluble resin, the inorganic particulates are formed of a very hard material, and thus, the air gap structure is unlikely to be destroyed by pressure or heat, and can be substantially maintained even after bonding of the transfer material. Such an ink receiving layer allows the absorbed ink to be held inside even in a case where the adhesive and the binder are melted, and also enables possible vapor to be trapped inside, leading to an excellent bonding capability. The air gap structure is maintained in spite of heat during thermocompression bonding, and thus, even in a case where the liquid components of the ink are subjected to bumping to generate vapor, the vapor can be trapped in each of the air gaps to inhibit formation of an air layer on the bonding surface between the ink receiving layer and the image support. Consequently, an excellent bonding capability can be achieved. The air gap structure is substantially maintained in spite of pressure during thermocompression bonding, and thus, an excellent bonding capability can be achieved without causing a main solvent such as water, which is a liquid component of the ink, and a nonvolatile solvent to seep out on the front surface. The ink receiving layer of the air gap absorption type formed of the inorganic particulates and the water-soluble resin can be produced without the need for any special orientation treatment and thus has high productivity.

Also in terms of the visibility of the three-dimensional image, an ink receiving layer of the air gap absorption type is preferable that is mainly formed of inorganic particulates having an optical refractive index significantly different from the optical refractive index of general resins. Of course, an ink receiving layer of the air gap absorption type mainly formed of resin may be used so long as the ink receiving layer allows the visibility of the three-dimensional image to be improved. It is important to use a material having an optical refractive index significantly different from the optical refractive index of the adjacent layer. The ink receiving layer of the air gap absorption type mainly formed of resin can cause a difference in optical refractive index between the ink receiving layer and the adjacent layer based on the air contained in the air gaps. However, in a case where a transfer temperature is equal to or higher than a glass transition temperature of a resin for air gap formation, the resin is melted into a uniform resin layer. This may lead to no difference in optical refractive index between the two layers forming the boundary of the three-dimensional image, reducing the visibility of the three-dimensional image. Therefore, the transfer temperature is preferably controlled to the glass transition temperature or lower. Basically, action needs to be taken to make a sufficiently great difference in optical refractive index between the ink receiving layer and the adjacent layer at the boundary of the three-dimensional image.

The inventors' examinations indicate that the ink receiving layer of the air gap absorption type formed of the inorganic particulates and the water-soluble resin had an air gap capacity of approximately 0.1 $cm^3/g$ to approximately 3.0 $cm^3/g$. In a case where a pore volume is less than 0.1 $cm^3/g$, sufficient ink absorption performance may fail to be delivered, and the ink may overflow, with unabsorbed ink remaining in the ink receiving layer. In a case where the pore volume is more than 30 $cm^3/g$, the ink receiving layer has a reduced strength, and cracking and falloff of oily powder is likely to occur in the ink receiving layer. Furthermore, during multilayer printing, the recessed and protruding three-dimensional image on the ink receiving layer may be likely to be collapsed. Basically, the air gap capacity needs to be set such that, after a portion of the ink having landed on the bonding layer passes through the space between the bonding portions of the bonding layer in a bypassing manner to come into contact with the front surface of the ink receiving layer, when the remaining portion of the ink is drawn and absorbed into the ink receiving layer, the absorbed ink can be held inside the ink receiving layer. The air gap capacity may allow the state before transfer to be substantially maintained even in a case where the transfer is based on thermocompression bonding.

In a case where the ink receiving layer of the air gap absorption type formed of the inorganic particulates and the water-soluble resin had the above-described air gap capacity, the ink receiving layer had a porosity of approximately 60% to approximately 90%. In a case where the ink receiving layer has a porosity of 60% or less, sufficient ink absorption performance fails to be delivered, and the ink may overflow, with unabsorbed ink remaining in the ink receiving layer. In a case where the ink receiving layer has a porosity of more than 90%, the ink receiving layer has a reduced strength, and cracking and falloff of oily powder is likely to occur in the ink receiving layer. Furthermore, during multilayer printing, the recessed and protruding three-dimensional image on the ink receiving layer may be likely to be collapsed. Basically, the porosity needs to be set such that, after a portion of the ink having landed on the bonding layer passes through the space between the bonding portions of the bonding layer in a bypassing manner to come into contact with the front surface of the ink receiving layer, when the remaining portion of the ink is drawn and absorbed into the ink receiving layer, the absorbed ink can be held inside the ink receiving layer. The porosity may allow the state before transfer to be substantially maintained even in a case where the transfer is based on thermocompression bonding.

The inventors' examinations indicate that the ink receiving layer of the air gap absorption type formed of the inorganic particulates and the water-soluble resin had an average pore diameter of approximately 10 nm to approximately 60 nm. In a case where the ink receiving layer has an average pore diameter of less than 10 nm, sufficient ink absorption performance fails to be delivered, and the ink may overflow, with unabsorbed ink remaining in the ink receiving layer. In a case where the ink receiving layer has an average pore diameter of 60 m or more, the coloring capability and resolution of the image are insufficient, and the ink receiving layer has a reduced strength. Thus, cracking and falloff of oily powder may be likely to occur in the ink receiving layer. Basically, the average pore diameter needs to be set such that, after a portion of the ink having landed on the bonding layer passes through the space between the bonding portions of the bonding layer in a bypassing manner to come into contact with the front surface of the ink receiving layer, when the remaining portion of the ink is drawn and absorbed into the ink receiving layer, the absorbed ink can be held inside the ink receiving layer. The average pore diameter may allow the state before transfer to be substantially maintained even in a case where the transfer is based on thermocompression bonding.

In a case where the adhesive enters and fills the air gaps in the ink receiving layer, the ink absorptivity decreases. Thus, the average particle size of the adhesive and the average pore diameter of the ink receiving layer are preferably set so as to inhibit the average particle size of the adhesive from being smaller than the air gap diameter of the ink receiving layer. Furthermore, the diameter of each of the pores formed by the inorganic particulates and the water-soluble resin increases consistently with the particle size of each of the inorganic particulates. To increase the particle size of each inorganic particulate, the amount of the binder formed of the water-soluble resin to immobilize the inorganic particulates may be increased in order to provide the ink receiving layer with the appropriate strength. That is, the amount of the binder may be adjusted according to the particle size of each inorganic particulate to set the average diameter of the pores so that the ink is drawn and absorbed into the ink receiving layer, with the absorbed ink held inside the ink receiving layer.

In a case where the color material of the ink is a pigment and the average particle size of the color material is set larger than the average pore diameter of the ink receiving layer, the color material component is likely to remain on the front surfaces of the exposed portions of the ink receiving layer. A water component and a solvent component in the ink permeate the inside of the ink receiving layer, and thus, the color material component of the pigment is separated from moisture and the solvent component as a result of solid-liquid separation. The color material is likely to remain on the front surface of the ink receiving layer. In such a case, the thickness of the adhesive may be adjusted according to the density of the pigment ink. That is, all of the color material of the pigment may be housed in the exposed portions of the ink receiving layer to inhibit the color material remaining on the front surface from acting as hindrance to bonding.

For example, the pigment, which is a color material, is assumed to be subjected to solid-liquid separation on the front surface of the ink receiving layer so that all of the pigment remains on the front surface of the ink receiving layer. For the weight density of solids such as a pigment in an aqueous ink that can be stably ejected using the ink jet method, the pigment density of the ink is assumed to be appropriately 5%. In such a case, the thickness of the bonding layer may be set equal to approximately three-hundredths to approximately half of the thickness of the ink receiving layer to inhibit the color material from protruding beyond the height of the adhesive and to prevent the color material remaining on the front surface of the ink receiving layer from acting as hindrance to bonding. As a result, an excellent bonding capability can be achieved. A sufficient amount of adhesive melted during thermal transfer can cover the color material remaining on the front surface of the ink receiving layer to form the melted adhesive into a bonding film between the color material and the image support, allowing further higher bonding capability to be achieved. For example, in a case where each ink droplet has a volume of 2 pl to 4 pl, the ink receiving layer of the air gap absorption type has a porosity of 80%, and the printed image is a color image, then preferably the ink receiving layer has a thickness of approximately 8 μm to approximately 16 μm and the bonding portion has a thickness of approximately 0.3 μm to approximately 8 μm. With an environmental variation in the volume of the ink droplet and a manufacturing variation in the porosity of the ink receiving layer taken into account, the bonding portion preferably has a thickness of 0.5 μm to 5 μm.

On the other hand, the air gap diameter of the ink receiving layer may be set larger than the expected average particle size of the pigment color material to allow some of solid components such as the pigment to permeate the inside of the ink receiving layer, enabling a reduction in the thickness of the bonding layer. However, in a case where the air gap diameter of the ink receiving layer is much larger the average particle size of the pigment and the air gaps of the ink receiving layer are filled with the liquid components of the ink to some degree, image bleeding (color material migration) may be induced depending on storage conditions for the printed material. That is, in addition to the liquid components of the remaining ink, the pigment component, which is a color material, may gradually infiltrate and diffuse into the ink receiving layer. Therefore, the permeability of the pigment in the ink receiving layer can be controlled by setting the air gap diameter of the ink receiving layer slightly larger than the average particle size of the pigment, which is a color material, or slightly larger than the particle size of each secondary particle or composite particle. As a result, a print material may be provided that is excellent in print characteristics and storage stability.

Much attention needs to be paid to the above-described color material migration for the dye ink, which has no solids because the color material is dissolved into the ink. For example, in a case where a portion of the ink absorbed once into the air gaps in the ink receiving layer is even slightly dried, the ink is separated into portions in the respective the air gaps, and the length of each of the connections between the air gaps is reduced to facilitate isolation of the portions of the ink remaining in the air gaps from one another.

Immediately after the dye ink is absorbed into the air gaps in the ink receiving layer of the air gap absorption type formed of the inorganic particulates and the water-soluble resin, not all the air gaps in the ink receiving layer are substituted with the ink, with air remaining in some of the air gaps. In a case where a portion of the ink even slightly vaporizes, a portion of the remaining air migrates to the connections between the air gaps, resulting in formation of an air layer. The continuous ink having permeated the inside of the air gaps is separated into portions by the air layer, and the portions of the ink in the respective air gaps are isolated from one another. The portions of the ink resulting from the separation and isolation by the air layer have difficulty migrating because the air layer offers resistance. These actions allow possible image bleeding (color material migration) to be suppressed even in a case where the dye ink is used.

Specifically, the connections between the air gaps in the ink receiving layer preferably each have a smaller length so that the portions of the ink remaining in the air gaps as a result of the separation of the ink are likely to be isolated from one another. In the ink receiving layer of the air gap absorption type formed of inorganic particulates 1501 and the water-soluble resin, the inorganic particulates are often shaped like spheres or flat plates or have a spindle structure. Thus, in a case where the ink receiving layer is formed, the inorganic particulates are irregularly oriented and are likely to reduce the length of each of the connections between the air gaps in the ink receiving layer. As a result, when the ink is separated into portions in the respective air gaps, the portions of the ink remaining in the air gaps are likely to be isolated.

In the present invention, the gap capacity, the porosity, and the pore diameter of each air gap can be calculated using a BET method. The "BET method" is a measuring method for the surface area of powder based on gas phase adsorption, and involves measuring the total surface area of a 1-g sample based on an adsorption isotherm. A pore volume is the volume of a pore with a radius of 0.7 nm to 100 nm calculated based on a BJH method using a nitrogen desorption isotherm. An average pore diameter is a diameter corresponding to a half of the cumulated value of the pore volume corresponding to a pore radius of 0.7 nm to 100 nm in a cumulated pore volume distribution curve determined based on the BJH method using a nitrogen desorption isotherm. The porosity is the ratio of the pore volume to the total pore volume. Nitrogen gas is normally often used as an adsorption gas, and a method is most often used in which the adsorption amount is measured based on a variation in the pressure or volume of the adsorption target gas. The BET method (Brunauer, Emmett, and Teller Equation) is known as a method for representing an isotherm of multi-molecular adsorption, and is widely used to determine a specific surface area.

The ink receiving layer provided with air gaps may be formed by using, instead of the inorganic particulates, resin particles having a melting temperature Tg higher than the transfer temperature so as to make the ink receiving layer unlikely to be melted and deformed during thermocompression bonding, and binding the resin particles together with a binder resin. However, in this case, it is important to use a material having an optical refractive index significantly different from the optical refractive index of the adjacent layer at the boundary of the three-dimensional image so as to improve the visibility of the three-dimensional image. The ink receiving layer of the air gap absorption type mainly formed of resin can cause a difference in optical refractive index between the ink receiving layer and the adjacent layer based on the air contained in the air gaps. However, in a case where the transfer temperature is equal to or higher than the glass transition temperature of the resin, the resin may be melted into a uniform resin layer to eliminate a difference in optical refractive index between the two layers forming the boundary of the three-dimensional image, reducing the visibility of the three-dimensional image. Therefore, the transfer temperature is preferably controlled to the glass transition temperature of the resin for air gap formation or higher. Basically, a sufficiently great difference in optical refractive index needs to be set between the ink receiving layer and another layer adjacent thereto at the boundary of the three-dimensional image so as to improve the visibility of the three-dimensional image.

The resin particles having a melting temperature Tg higher than the transfer temperature maintain the particle structure in spite of the heat during transfer, and are thus inhibited from being melted by heat during transfer to collapse the air gaps. In many cases, the resin particles having a melting temperature higher than the transfer temperature, that is, the high-Tg resin particles, generally have rigid molecule structure forming the resin particles, and are relatively hard. Thus, the air gaps are inhibited from being collapsed by pressure. As described above, the air gaps are inhibited from being collapsed by pressure or melted on heating to prevent the main solvent such as water, which is a liquid component of the ink, and the nonvolatile solvent from seeping out on the front surface, resulting in an excellent bonding capability.

In the present invention, the surface of the ink receiving layer on which a three-dimensional image is provided is preferably smooth compared to the height of the recesses and protrusions of the three-dimensional image. For example, an arithmetic mean height (Sat) determined by a method compliant with a standard (international standard ISO 25178) specifying an evaluation method for surface roughness is preferably 0.5 μm or less and more preferably 0.3 μm or less. The visibility of the three-dimensional image can be improved by setting the value of Sa; to 0.5 μm or less and also smaller than the height (Sa) of the recesses and protrusions of the three-dimensional image. As an example of the ink receiving layer of the air gap absorption type, constituent materials of the ink receiving layer containing the water-soluble resin and at least the inorganic particulates will be described in detail.

[4-1-1] Inorganic Particulates

The inorganic particulates are particulates formed of an inorganic material. The inorganic particulates have a function to form, in the ink receiving layer, air gaps that receive the color material.

The type of the inorganic material forming the inorganic particulates is not particularly limited. However, the inorganic material preferably has high ink absorptivity and an excellent coloring capability and enables high-quality images to be formed. Examples of the inorganic material include calcium carbonate, magnesium carbonate, kaolin, clay, talc, hydrotalcite, aluminum silicate, calcium silicate, magnesium silicate, diatomaceous earth, alumina, colliodal alumina, aluminum hydroxide, an alumina hydrate of boehmite structure, an alumina hydrate of pseudo-boehmite structure, lithopone (a mixture of barium sulfate and zinc sulfide), and zeolite.

Among the inorganic particulates formed of any of these inorganic materials, alumina particulates are preferable which are formed of at least one type of material selected from a group consisting of alumina and alumina hydrates. Examples of the alumina hydrate include an alumina hydrate of boehmite structure and an alumina hydrate of pseudo-boehmite structure. The alumina, the alumina hydrate of a boehmite structure, and the alumina hydrate of pseudo-boehmite structure are preferable in that these materials allow enhancement of the transparency of the ink receiving layer, the print density of images, and the visibility of three-dimensional images. The alumina hydrate has an optical refractive index of 1.77, which is significantly different from the refractive index of the adjacent layer at the boundary of the expected three-dimensional image (the conveyance layer (PET=1.58), the protective layer (acrylic=1.49, urethane=1.49), the heat seal layer (polyolefin=1.53), allowing the visibility of the three-dimensional image to be improved.

The alumina hydrate of boehmite structure may be obtained by adding an acid to long chain aluminum alkoxide for hydrolysis and peptization (see Japanese Patent Laid-Open No. S56-120508(1981)). Pepization may involve either an organic acid or an inorganic acid. However, a nitric acid is preferably used The use of the nitric acid enables reaction efficiency of hydrolysis to be enhanced to provide an alumina hydrate with the shape thereof controlled and a dispersion liquid that allows the alumina hydrate to be properly dispersed.

Preferably, the inorganic particulates are shaped like spheres or flat plates and have an average aspect ratio of 1 or more and 10 or less. The "average aspect ratio" may be determined using a method described in Japanese Patent Publication No. H05-016015(1993). That is, the average aspect ratio is represented by the ratio of the "diameter" to the "thickness" of a particle. The "diameter" as used herein refers to the diameter of a circle having an area equal to the projected area of a particle in a case where the inorganic particulates are observed with a microscope or an electron microscope. The use of inorganic particulates with an average aspect ratio of 1 reduces the range of pore distribution in the ink receiving layer to shape the inorganic particulates like cilia, depending on the constituent materials of the ink receiving layer. Thus, the inorganic particulates are likely to be regularly oriented, and the pore size of the ink receiving layer may be small enough to hinder the ink absorptivity. The use of inorganic particulates with an average aspect ratio of more than 10 makes manufacture of inorganic particulates with a uniform particle size difficult.

In the present invention, the average aspect ratio is set to 1 or more and 10 or less, and thus, the inorganic particulates are likely to be irregularly oriented during formation of the ink receiving layer, and the pore size of the ink receiving layer is inhibited from being small enough to hinder the ink absorptivity. That is, the connections between the air gaps in the ink receiving layer are each likely to have a narrower shape and allow the ink to be separated into portions corresponding to the respective air gaps so that the portions of the ink remaining in the respective air gaps are likely to be isolated from one another. This is effective for migration.

The inorganic particulates preferably have the average particle size thereof precisely controlled. Since the minimum width and minimum height of each recess and each protrusion of the transferred three-dimensional image may be set according to the particle size of each inorganic particulate, the particle size of each inorganic particulate may be controlled according to the width of each recess and each protrusion on the desired three-dimensional image. A reduced average particle size of the inorganic particulates allows light scattering to be suppressed to improve the transparency of the ink receiving layer. For example, in a case where a transfer material including a protective layer and that can be bonded for transfer is used to allow an image to be viewed from the protective layer side, typically the protective layer, which is a part of the substrate, needs to have sufficient transparency and the ink receiving layer itself also needs to have a certain level of transparency. Thus, the ink receiving layer effectively contains inorganic particulates with a small average particle size. A reduced average particle size of the inorganic particulates reduces the air gap diameter of the ink receiving layer and thus the ink absorption capacity, and thus, the ink receiving layer needs to have a sufficiently large thickness.

On the other hand, an increased average particle size of the ink receiving layer allows the air gap diameter of the ink receiving layer to be increased. Thus, in a case where the pigment ink is used, some of the solid components such as the pigment can be allowed to permeate the inside of the ink receiving layer. The ink receiving layer has the transparency thereof reduced by light scattering caused by the inorganic particulates, and thus, an increased particle size of each inorganic particulate is effective in a case where print information is desired to be masked. On the other hand, an increased particle size of each inorganic particulate reduces the strength of the ink receiving layer. In such a case, the amount of the binder of the water-soluble resin, which immobilizes the inorganic particulates, may be increased in order to provide the ink receiving layer with the appropriate strength. As described above, the average particle size of the inorganic particulates may be optimally selected according to the intended use of the transfer material and the printed material with the absorptivity of the ink receiving layer and the transparency of the ink receiving layer. The average particle size of the inorganic particulates is preferably 120 nm to 10 μm, more preferably 120 nm to 1 μm, and most preferably 140 nm to 200 nm.

The average particle size and a polydisperity index can be determined by analyzing values measured by a dynamic light scattering method using a cumulant method described in "Structure of Polymer (2) Scattering Experiments and Morphological Observations, Chapter 1 Light Scattering" (published by KYORITSU SHUPPAN CO., LTD. and edited by The Society of Polymer Science, Japan) or J. Chem. Phys., 70(8), 15 April 3965 (1979). The average particle size and the polydisperity index defined in the present embodiment can be easily measured using a laser particle size analysis apparatus PARIII (manufactured by OTSUKA ELECTRONICS Co, LTD.).

One type of inorganic particulates may be solely used or two or more types of inorganic particulates may be mixed together. The phrase "Two or more types" means not only inorganic particulates of different materials but also inorganic particulates with different characteristics such as different average particle sizes and different polydisperity indices.

[4-1-2] Water-Soluble Resin

The water-soluble resin is a resin that adequately mixes with water or that has a solubility of 1 (g/10 g) or more with respect to water, at 25° C. For the air gap absorption type, the water-soluble resin functions as a binder that binds the inorganic particulates together. In a case where the transfer material and the image support are bonded together, the water-soluble resin is, during bonding, melted at the glass transition temperature or higher and bonded to the image support.

Examples of the water-soluble resin include starch, gelatin, casein, and modified materials thereof; cellulose derivatives such as methylcellulose, carboxymethylcellulose, and hydroxyethylcellulose; polyvinyl alcohols (completely saponified polyvinyl alcohol, partially saponified polyvinyl alcohol, low saponified polyvinyl alcohol, or the like) and modified resins thereof (cation modified resin, anion modified resin, modified resin, and the like); and resins such as urine-based resin, melamine-based resin, epoxy-based resin, epichlorohydrin-based resin, polyurethane-based resin, polyethyleneimine-based resin, polyamide-based resin, polyvinyl pyrrolidone-based resin, polyvinyl butyral-based resin, poly (meth)acrylic acid or copolymer resin thereof, acrylamid-based resin, maleic anhydride-based copolymer resin, and polyester-based resin.

Among the water-soluble resins, saponified polyvinyl alcohol is preferable which is obtained by hydrolyzing (saponifying) polyvinyl alcohol, particularly polyvinyl acetate. The polyvinyl alcohol can be bonded to the image support by being melted during bonding. In particular, a vinyl acetate group forming the polyvinyl alcohol is expected to contribute to the bonding, and in a case where the water-soluble resin and the image support are melted by heat during transfer, the water-soluble resin and the image support have enhanced affinity for each other, allowing the water-soluble resin to be firmly bonded to the image support. In a case where the image support is PVC or PET-G, the polyvinyl alcohol is particularly preferably used because of the capability of enhancing the adhesion between the image support and the ink receiving layer (transfer performance).

The ink receiving layer is preferably formed of a composition containing polyvinyl alcohol with a degree of saponification of 70 mol % to 100 mol %. The saponification means the percentage of the amount by mole of a hydroxyl group relative to the total amount by mole of an acetate group and the hydroxyl group.

Setting the degree of saponification preferably to 70 mol % or more and more preferably to 86 mol % or more allows the ink receiving layer to be provided with the appropriate hardness. In particular, in a printed material including the substrate from which the conveyance layer can be peeled off and from which the functional layer such as the protective layer is not peed off, the foil cutting capability of the ink receiving layer during the peeling step is improved, allowing suppression of possible burrs at the ends of the ink receiving layer. This also enables a reduction in the viscosity of a coating liquid containing inorganic particulates and polyvinyl alcohol. Therefore, the coating liquid can be easily applied to the protective layer, allowing the printed material to be more effectively and efficiently produced. Setting the degree of saponification preferably to 100 mol % or less and more preferably to 90 mol % provides the ink receiving layer with appropriate flexibility. In particular, in the printed material including the substrate from which the conveyance layer can be peeled off and from which the functional layer such as the protective layer is not peed off, the strength of the bonding between the protective layer and the ink receiving layer is improved to allow suppression of peel-off of the ink receiving layer from the protective layer due to an insufficient bonding strength. Furthermore, the ink receiving layer can be provided with appropriate hydrophilicity, facilitating absorption of ink. Therefore, a high-quality image can be printed on the ink receiving layer.

Examples of the saponified polyvinyl alcohol having a degree of saponification falling within the appropriate range of values include completely saponified polyvinyl alcohol (a degree of saponification of 98 mol % to 99 mol %), partially saponified polyvinyl alcohol (a degree of saponification of 87 mol % to 89 mol %), and low-saponification polyvinyl alcohol (a degree of saponification of 78 mol % to 82 mol %). In particular, partially saponified polyvinyl alcohol is preferable.

The ink receiving layer is preferably a composition containing polyvinyl alcohol with an average degree of polymerization of 2,000 to 5,000.

The ink receiving layer can be provided with appropriate flexibility by setting the average degree of polymerization preferably to 2,000 or more and more preferably to 3,000 or more. Therefore, the foil cutting capability of the receiving layer during the peel-off step is improved, allowing suppression of possible burrs at the ends of the ink receiving layer. The ink receiving layer can be provided with appropriate hardness by setting the average degree of polymerization preferably to 5,000 or less and more preferably to 4,500 or less. This improves the strength of the bonding between the protective layer and the ink receiving layer to allow suppression of peel-off of the ink receiving layer from the protective layer due to insufficient adhesive strength. This also enables a reduction in the viscosity of a coating liquid containing inorganic particulates and polyvinyl alcohol. Therefore, the coating liquid can be easily applied to the transparent protective layer, allowing the transfer material to be more effectively and efficiently produced. Furthermore, the pores in the ink receiving layer can be prevented from being filled and can be appropriately kept open, facilitating absorption of ink. Therefore, a high-quality image can be printed on the ink receiving layer.

The value of the average degree of polymerization is a value calculated in compliance with a method described in a standard (Japanese Industrial Standards) specifying a test method for polyvinyl alcohol with a degree of saponification of approximately 70 (mol %) or more.

One type of water-soluble resin may be used alone or two or more types of water-soluble resins may be mixed together. "Two or more types" of water-soluble resins include water-soluble resins with different characteristics such as different degrees of saponification or different average degrees of polymerization.

The amount of the water-soluble resin is preferably 3.3 to 20 pts·wt. relative to 100 pts·wt. inorganic particulates. In a case where the amount of the water-soluble resin is preferably 3.3 pts·wt. or more and more preferably 5 pts·wt. or more, an ink receiving layer with an appropriate strength can be formed in which the air gaps are prevented from being collapsed by pressure or heat. In a case where the amount of the water-soluble resin is preferably 20 pts·wt. or less and more preferably 15 pts·wt. or less, an optimal amount of binder is provided for the air gaps in the ink receiving layer. Thus, the ink absorptivity can be improved, and the air gaps between the inorganic particulates bound together with the water-soluble resin can be substantially uniformly arranged throughout the ink receiving layer, allowing substantially isotropic permeation of the ink. In a case where the amount of the water-soluble resin is 3.3 pts·wt. or less, only a small amount of binder binding the inorganic particulates together is provided. Thus, the strength of the ink receiving layer is reduced, possibly causing fissuring and falloff of oily powder in the ink receiving layer. This is not preferable. On the other hand, in a case where the amount of the water-soluble resin is 20 pts·wt. or more, a larger amount of water-soluble resin is provided and fills the air gaps in the ink receiving layer, resulting in inappropriate ink absorptivity. This is not preferable.

[4-2] Material of the Adhesive

The adhesive of the bonding layer is preferably an adhesive that absorbs substantially no ink or that absorbs ink but only at a low absorption speed. The adhesive is not directly involved in the absorption of the ink, and thus, the material of the adhesive is not related to the ink and may be selected with focus placed on the bonding capability to the image support. Therefore, the transfer material of the present embodiment can be bonded to various image supports. Specifically, a user may select any of well-known adhesives that is excellent in bonding capability to a particular image support to which the transfer material is to be bonded, according to the material of the image support. For example, the adhesive may be PET, PVC, PET-G; acrylic, polycarbonate, POM, ABS, PE, PP, or the like which is excellent in bonding capability to the particular image support such as plastics, paper, glass, wood, or metal.

One or more types of adhesives may be selected. As is the case with the adhesive 1002 in FIG. 1, it is preferable to select an adhesive 1002(1) that is excellent in bonding capability to the particular image support and an adhesive 1002(2) that is excellent in bonding capability to the ink receiving layer. Consequently, the adhesive can be properly bonded both to the image support and to the ink receiving layer.

The adhesive that bonds excellently to a particular image support may be of a stimulation activated type that is made by external stimulation to exhibit the capability of bonding to the particular image support. The stimulation activated adhesive is not particularly limited but a well-known stimulation activated adhesive may be used. For example, stimulation activated adhesives may be used for which heat, pressure, water, light, a reactant, or the like is used as an external stimulation.

For example, the stimulation activated adhesive may be a heat-sensitive adhesive for which heat is used as external stimulation and which contains, as a main component, thermoplastic resin that is melted to exhibit the capability of bonding to the image support in a case where the thermoplastic resin is heated at the glass transition temperature thereof or higher. Alternatively, the stimulation activated adhesive may be a pressure-sensitive adhesive for which pressure is used as external stimulation and which can be bonded to the image support simply by applying a slight pressure to the adhesive at normal temperature for a short time. Alternatively, the stimulation activated adhesive may be a water activation adhesive, that is, a remoistening adhesive, for which water is used as external stimulation and which is made to exhibit the bonding capability by applying water to the adhesive in a dry state. However, in a case where the water activation adhesive is used, water adheres to the bonding surface in a case where the print medium is bonded to the image support. Thus, the color material of the ink preferably offers water resistance and may be, for example, a waterproof dye and more preferably a pigment.

In a case where the transfer material is not bonded to the image support, a self-melt bonding adhesive may be used in order to protect the print surface subjected to ink jet printing. The self-melt bonding adhesive is an adhesive that is provided on the ink receiving layer and melted such that adjacent aggregates of pieces of the adhesive are bonded together. In a case where the self-melt adhesive is used, the adhesive provided on the ink receiving layer is melted such that adjacent aggregates of pieces of the adhesive are bonded together while covering the print surface subjected to ink jet printing. Consequently, the print surface subjected to ink jet printing is protected by the self-melt bonding adhesive, improving the scratch resistance of the printed material.

The color and transparency of the adhesive may be determined according to the intended use of the transfer material and the printed material. The adhesive may be transparent, translucent, or opaque or may be colored. For example, in a case where print contents are made visible from both the substrate side and the bonding layer side, the adhesive may be transparent. In a case where the print contents are made visible from the substrate side, the adhesive may be transparent. In a case where the print contents are made visible from the bonding layer side, the adhesive may be transparent or may be colored so as to produce a background color. As described below, the adhesive may be white in order to mask the print information, and in that case, each piece of the adhesive may have a particle size larger than a visible light wavelength.

[4-3] Material of the Substrate

The material of the substrate is not particularly limited. The material of the substrate may be selected according to the intended use of the transfer material and the printed material. The preferred material allows a three-dimensional image to be formed on the substrate. However, given high-speed printing, the heat of rollers needs to be transmitted through the transfer material in a short time to heat and melt the bonding layer, and thus, it is important to reduce heat transfer loss in the substrate. The inventors' examinations indicate that the ink receiving layer is, in spite of its large film thickness, likely to transfer heat due to inclusion of the inorganic particulates having a high heat conductivity. On the other hand, heat is approximately 10- to 20-fold less likely to be transferred through the substrate than through the ink receiving layer, and the substrate accounts for most of the heat transfer losses in the transfer material. Therefore, in order to reduce the heat transfer loss to deal with high-speed printing, the substrate is preferably formed of a material that delivers excellent conveyance performance and that has a high heat conductivity. In contrast, given low-speed printing, the material of the substrate may be selected to have a high strength, high dimensional stability, and low costs. As described above, the preferred material may be selected according to the desired print conditions.

Examples of the material of the resin film forming the substrate include polyester resins such as polyethylene terephthalate, polybutylene terephthalate, and a polyethylene terephthalate/isophthalate copolymer; polyolefin resins such as polyethylene, polypropylene, and polymethylpentene; polyethylene fluoride-based resins such as polyvinyl fluoride, polyvinylidene fluoride, polytetrafluoroethylene, and an ethylene-tetrafluoroethylene copolymer; aliphatic poplyamide resins such as nylon 6 and nylon 6, 6; vinyl polymer resins such as polyvinyl chloride, a vinyl chloride/vinyl acetate copolymer, an ethylene/vinyl acetate copolymer, an ethylene/vinyl alcohol copolymer, a polyvinyl alcohol, and vinylon; cellulose-based resins such as cellulose triacetate and cellophane; aclyric-based resins such as polymethyl methacrylate, polyethyl methacrylate, polyethyl acrylate, and polybutyl acrylate; and any other synthetic resin such as polystyrene, polycarbonate, polyarylate, or polyimide.

For example, a polyamide-based resin may be used as the resin film, and an example of a commercially available material is Microtron manufacture by Torey Industries, Inc. One type of resin film may be solely used or two or more types of resin films may be combined or laminated. Besides, glass, a metal plate, or wood may be used. A resin may be used to which a filler such as silica, alumina, or graphite is added to improve heat conductivity. Well-known fillers other than those described above may be used. Among the above-described materials, given high-speed printing, the polyamide-based resin may be preferably used due to its high heat conductivity and excellent strength and dimensional stability. For example, among commercially available materials, Microtron (trade name) manufacture by Torey Industries, Inc. is preferably used. Given low-speed printing, polyethylene terephthalate or the like is preferably used due to its low price and excellent strength and dimensional stability.

To allow protrusions and recesses of the three-dimensional image to be formed by exposure, the substrate may be formed of a photosensitive material. The photosensitive material may be similar to a well-known photosensitive material for hologram formation. Examples of a photosensitive material for hologram formation that is used to print interference fringes include silver halidet, dichlomated gelatin, thermoplastics, diazo-based photosensitive material photoresist, ferroelectrics, photochromic materials, and chalcogen glass.

In a case where the substrate includes a release layer formed of a composition containing a release agent, the type of the release agent is not particularly limited. Preferably, the release agent is formed of a material that is excellent in releasability and that is not easily melted by the heat of heat rollers or heat generated by the ink jet print head (particularly a thermal ink jet print head including elecrothermal transducing elements (heaters) as ejection energy generating elements). For example, silicone-based materials such as a silicone wax and a silicone resin which are typified by waxes such as a silicone wax and fluorine-based materials such as a fluorine resin are preferable in view of high releasability.

[4-3-1] Material of the Substrate from which the Conveying Layer is not Peeled Off In a case where the transfer material from which the conveyance layer of the substrate is not peeled off is used to produce a construction material, a poster, wallpaper, a sign display plate, or the like, among the above-described substrate materials, PET, acrylic, polycarbonate, ROM, and the like are preferably used. For an ink jet image printed from the bonding layer side, the substrate and the ink receiving layer serve as a protective layer to enable the weatherability of the ink jet image to be improved. In a case where the transfer material is bonded to the image support with no breatherability for transfer and the substrate covering the ink receiving layer as a protective layer has poor moisture permeability, the color material of the printed image may re-diffuse due to residual moisture of the ink resulting from the ink jet printing and moisture absorption during storage of the printed material, leading to image bleeding. Thus, particularly in a case where ink jet printing is performed from the bonding layer side using a dye ink, the substrate covering the front surface of the ink receiving layer is preferably formed of a material having a certain level of moisture permeability.

In a case where the transfer material is used as a packaging material, among the above-described substrates, the resin film formed of a polypropylene-based resin is preferably used.

Furthermore, in a case where the transfer material is used as a packaging material, the substrate may include a heat seal layer on the surface thereof opposite to the surface thereof on which the ink receiving layer is formed. At least one of a polyethylene-based resin and a polypropylene-based resin is preferably used as a heat sealing resin material forming the heat seal layer.

The thickness of the heat seal layer is not particularly limited. However, the thickness of the heat seal layer is preferably 0.5 μm or more and 40 μm or less. In a case where the thickness of the heat seal layer is 0.5 μm or more and more preferably 1 μm or more, a high heat conductivity can be achieved during thermocompression bonding, and the bonding between the ink receiving layer and the heat seal layer can further be enhanced.

[4-3-2] Material of the Substrate from which the Conveying Layer is Peeled Off

The transfer material from which the conveyance layer of the substrate is peeled off may be used in the fields of various security cards such as ID cards, employee ID cards, and credit cards, in the fields of delivered public documents such as my number cards and passports, and in the fields of pharmacology and pathology for embedding cassettes. For such applications, PET is preferable as the material of the substrate. The peelable substrate may include a protective layer or a hologram layer.

[4-3-3] Material of the Protective Layer

Constituent materials of the protective layer will be described. The protective layer may be formed using one or more types of resins. Preferably, the protective layer contains two types of resins (a resin E1 and a resin E2) having different glass transition temperatures, and the resin E2 is in a particle state, whereas the resin E1 is in a film state.

As a material of the resin E1, an acrylic-based resin that may be formed into a film at relatively low temperature is preferably used in that the coating film has high transparency and also has a high affinity for saponified polyvinyl alcohol contained in the ink receiving layer as a water-soluble resin, allowing adhesion to be enhanced.

A material of the resin E2, resin and preferably a urethane-based resin may be used to allow application of appropriate softness and suppression of stickiness. Such a material allows elimination of brittleness of the film and improvement of dissolution of the film into chemicals to make the film less likely to be subjected to breakage, peel-off, and the like even in a case where the film is immersed in a chemical such as alcohol.

The protective layer may contain a water swelling resin and include a mechanism that discharges moisture to the outside of the system in order to prevent the protective layer from being fissured in a case where the ink jet printed material is immersed in water for a long time. Examples of the water swelling resin include water-soluble resins that are a type to be swollen with and dissolved into water and water absorbing resins that are a type insoluble to water.

The type of the water-soluble resin is not particularly limited. For example, the same water-soluble resin as that included in the above-described ink receiving layer may be used. Among such water-soluble resins, the following are particularly preferably used: polyvinyl alcohols such as completely saponified polyvinyl alcohol, partially saponified polyvinyl alcohol, low saponified polyvinyl alcohol, or the like, and modified resins thereof (cation modified resin, anion modified resin, silanol modified resin, and the like). In particular, saponified polyvinyl alcohol is preferable which is obtained by hydrolyzing (saponifying) polyvinyl acetate.

The polyvinyl alcohol is preferably formed of a composition containing polyvinyl alcohol with a degree of saponification of 75 mol % to 100 mol %. In a case where the degree of saponification is preferably set to 86 mol % or more and more preferably set to 98 mol % or more, the amount by which the polyvinyl alcohol is swollen by water absorption can be optimized to allow moisture to vaporize through the front surface of the transparent protective layer, more properly suppressing possible fissuring. This setting further restrains the moisture absorption speed to allow print information to be prevented from being contaminated as a result of liquid contamination.

The protective layer is preferably formed of a composition containing polyvinyl alcohol with an average degree of polymerization of 1,500 to 5,000. In a case where the average degree of polymerization is preferably set to 1,500 or more and more preferably to 2,000 or more, the amount by which the polyvinyl alcohol is swollen by water absorption can be optimized to allow moisture to vaporize through the front surface of the protective layer, more properly suppressing possible fissuring. This setting further restrains the moisture absorption speed to allow print information to be prevented from being contaminated as a result of liquid contamination. On the other hand, in a case where the average degree of polymerization is preferably set to 5,000 or less and more preferably to 4,500 or less, the protective layer can be made, without being excessively hardened, less likely to fissure in a case where the protective layer is stressed. The value of the average degree of polymerization is a value calculated in compliance with a method described in the standard (Japanese Industrial Standards) specifying the test method for polyvinyl alcohol with a degree of saponification of approximately 70 (mol %) or more.

[4-3-4] Material of the Light Transmission Regulating Layer

Now, a material of the light transmission regulating layer will be described. The material of the light transmission regulating layer, which serves to improve the visibility of the three-dimensional image, preferably has a higher refractive index and is preferably transparent in terms of the visibility of the first image. Examples of such a material include ZnS, $TiO_2$, $Al_2O_3$, $Sb_2O_3$, SiO, $SnO_2$, and ITO. The preferred material is an oxide, a nitride, or a sulfide of metal. Specific examples of such a material may include an oxide, a nitride, or a sulfide of Be, Mg, Ca, Cr, Mn, Cu, Ag, Al, Sn, In, Te, Ti, Fe, Co, Zn, Ge, Pb, Cd, Bi, Se, Ga, Rb, Sb, Pb, Ni, Sr, Ba, La, Ce, or Au, or a mixture of two or more of these compounds. A common reflective thin metal film such as aluminum may be used because such a film exhibits transparency at a thickness of 20 nm or less.

[4-3-4] Material of the Anchor Layer

Now, a material of the anchor layer will be described. Any material may be used for the anchor layer so long as the material allows the ink receiving layer and the light transmission regulating layer to be properly bonded together, and as such a material, any well-known material for adhesives may be used. The available material of the anchor layer may be similar to the material described in [4-2], and the preferred material may be selected according to the materials of the ink receiving layer and the light transmission regulating layer.

[4-3-5] Thickness of the Substrate

The thickness of the substrate may be determined as needed with the conveyance performance and the material strengths taken into account and is not particularly limited. The substrate needs to enable formation of a three-dimensional image and maintenance of excellent conveyance performance, and preferably has a thickness of 5 μm to 300 μm.

In a case where the thickness of the substrate is preferably set to 5 μm or more and more preferably to 15 μm or more, even with a three-dimensional image formed on the substrate, the conveyance performance of the transfer material can be improved in a case where an image is printed on the transfer material and in a case where the transfer material is bonded to the image support after ink jet printing. In a case where the transfer material is formed into a cut sheet or a plate, the substrate needs to have a high strength and a high hardness and is preferably thick. In this case, the thickness of the substrate is preferably 30 μm or more. On the other hand, in a case where the thickness of the substrate is set to 300 μm or less, more preferably 100 μm or less, and most preferably 50 μm or less, an excellent heat transfer capability may be provided when the transfer material is bonded to the image support on heating after ink jet printing.

[4-4] Material of the Image Support

A material of the image support is not particularly limited. An example of the image support may be an image support including resin as a constituent material (resin-based support) or an image support including paper as a constituent material (paper-based support). The transfer material of the present invention enables an ink jet image to be transferred to various image supports of glass, metal, and the like. The resin forming the resin-based support may be selected as need according to the intended purpose of the image support and is not particularly limited. The resin may be similar to the material of the substrate.

[5] Manufacturing Method for the Transfer Material

Roughly two types of methods are available for forming a three-dimensional image (an image based on a three-dimensional micro-structure) on the ink receiving layer. One of the methods involves forming a three-dimensional image directly on the three-dimensional image. The other method involves forming a three-dimensional image on the substrate and providing an ink receiving layer on the three-dimensional image to transfer the substrate-side three-dimensional image to the ink receiving layer side.

In the latter method, a coating liquid containing the inorganic particulates and the water-soluble resin is applied onto the substrate with a protruding and recessed three-dimensional image provided thereon to form an ink receiving layer on the substrate. Consequently, the substrate-side three-dimensional image is transferred to the ink receiving layer to form a recessed and protruding three-dimensional image on the ink receiving layer. Then, the transfer material may be manufactured by further applying a coating liquid containing the adhesive onto the ink receiving layer as needed.

The above-described matters are omitted below and only matters unique to the manufacturing method will be described. First, a manufacturing method for forming a three-dimensional image on the substrate will be described.

[5-1] Manufacturing Method for the Substrate

The substrate may be configured such that, for example, the conveyance layer of the substrate is or is not peeled off, and may be manufactured using any well-known method.

[5-1-1] Formation of a Three-Dimensional Image on the Substrate

The three-dimensional image may be formed using a well-known recess and protrusion formation method. For example, the substrate with the three-dimensional image may be manufactured by extruding a melted resin for a film and executing film processing on the still molten resin while winding the film around an emboss roll. An alternative method may be adopted that involves pressing a roller provided with a recessed and protruding portion against the substrate to form a protruding and recessed portion on the substrate or scraping the front surface of the substrate by laser irradiation, sandblasting, or the like to form a protruding and recessed portion. Alternatively, the protruding and recessed portion may be formed by providing a material such as a photosensitive material on the front surface of the substrate and applying pattern exposure to the material. The protruding and recessed portion may also be formed on the substrate by coating the substrate with a UV curing resin, winding the substrate around a roller provided with recessed and protruding portion while the UV curing resin is still uncured, irradiating the uncured resin wound around the roller with UV rays to cure the resin, and then peeling the substrate off from the roller. The protruding and recessed portion may also be formed by using an ink jet apparatus that uses an UV curing ink to build up a resin contained in the UV curing ink on the substrate (film) so as to form a thick layer of the resin. Besides the above-described methods, any well-known methods allowing a recessed and protruding portion on the substrate may be used.

The three-dimensional image 1300 may be formed on the conveyance layer 1309 of the substrate 50 as depicted in FIG. 8B or on the functional layer 52 of the substrate as depicted in FIG. 8A. The three-dimensional image is preferably formed on the front surface of the functional layer. That is, preferably, the functional layer 52 is provided on the conveyance layer 1309 to a large thickness, and the recessed and protruding three-dimensional image 1300 is provided on the functional layer 52 as depicted in FIG. 8A. In a case where the recessed and protruding three-dimensional image 1300 is provided on the conveyance layer 1309 and the functional layer 52 is provided on the three-dimensional image 1300 to a small thickness as depicted in FIG. 8B, the grooves in the three-dimensional image 1300 may be filled with the functional layer 52 to impair the function of the three-dimensional image 1300. In such a case, the functional layer may be formed to a small thickness so as not fill the grooves in the recessed and protruding three-dimensional image with the functional layer. Basically, any configuration may be used where the recessed and protruding shape of the three-dimensional image on the substrate is also formed on the ink receiving layer, and the configuration of the substrate may be set as needed with the bonding conditions and the like taken into account. In a case where the functional layer is provided on the conveyance layer to a large thickness to flatten the front surface of the functional layer as depicted in FIG. 8A, the front surface of the printed material remains flat after transfer and an image can be additionally provided on the front surface using a contact-based printing method such as thermal transfer.

[5-1-2] Formation Method for the Protective Layer

Description will be given that relates to a formation method for the protective layer used in a case where the substrate includes the protective layer and only the conveyance layer of the substrate is peeled off after the bonding process (in a case where a part of the substrate is peeled off).

The protective layer may be formed by preparing a coating liquid for the protective layer, applying the coating liquid to the front surface of the substrate, and drying (heating) the coating liquid. The three-dimensional image may be formed by executing a method similar to the method described in [5-1-1] after formation of the protective layer. Such a method facilitates formation of the protective layer to a large thickness to allow protection performance of the protective layer to be enhanced. An alternative method for forming a three-dimensional image on the protective layer involves applying a coating liquid for the protective layer to the front surface of the substrate with the three-dimensional image described in [5-1-1] to form the three-dimensional image on the protective layer. However, in this case, the protective layer needs to be thin enough to avoid filling the grooves in the recessed and protruding three-dimensional image on the substrate. In a case where the grooves in the recessed and protruding three-dimensional image on the substrate are filled with the protective layer, in other words, the recessed and protruding portion of the three-dimensional image is coated with the protective layer, the substrate and the protective layer may exhibit substantially the same refractive index to inhibit the three-dimensional image from appearing. Basically, the recessed and protruding portion need to be formed on the front surface of the protective layer on which the ink receiving layer is formed, so as to form also the recessed and protruding portion of the three-dimensional image on the substrate, on the ink receiving layer.

As a medium for the coating liquid for the protective layer, an aqueous medium is preferably used. Examples of the aqueous medium may include water and a mixed solvent of water and a water-soluble organic solvent. Examples of the water-soluble organic solvent include alcohols such as methanol, ethanol, and propanol.

The coating liquid for the protective layer may contain various additives unless the additives hinder the effects of the present invention.

[5-1-2-1] Coating

The protective layer may be formed by applying a coating liquid containing a resin using gravure coating, roll coating, rod bar coating, spray coating, air knife coating, slot die coating, or the like, and then drying the coating liquid.

The coating amount of the coating liquid for the protect layer in terms of solid content is set preferably to 1 to 40 $g/m^2$, more preferably to 2 to 30 $g/m^2$, and much more preferably 4 to 20 $g/m^2$. In a case where the coating amount is set preferably to 1 $g/m^2$ or more, more preferably to 2 $g/m^2$ or more, and much more preferably to 4 $g/m^2$ or more, the protect layer can offer appropriate water resistance and appropriate scratch resistance. In a case where the coating amount is set preferably to 40 $g/m^2$ or less, more preferably 30 $g/m^2$ or less, and much more preferably to 20 $g/m^2$ or less, the transparency of the protect layer can be enhanced. Moreover, heat is more appropriately transmitted through the protect layer during thermocompression bonding to allow improvement of adhesion (transfer capability) between the protect layer and the ink receiving layer.

[5-1-2-2] Formation Method for the Light Transmission Regulating Layer

The light transmission regulating layer may be provided on the conveyance layer by vacuum thin film deposition such as deposition, sputtering, ion plating, or chemical vapor deposition (CVD). In particular, the CVD is preferable in view of its little thermal damage to the conveyance layer. The light transmission regulating layer may also be formed using any other well-known thin-film formation method. A reduced thickness of the light transmission regulating layer enables a reduction in thermal damage to the light transmission regulating layer. Importantly, the thickness of the light transmission regulating layer is controlled so as to inhibit the grooves in the recessed and protruding three-dimensional image on the conveyance layer from being filled with the light transmission regulating layer to flatten the front surface thereof. Basically, the light transmission regulating layer and the anchor layer need to be provided so as to form also a recessed and protruding portion on the ink receiving layer.

[5-1-2-3] Formation Method for the Anchor Layer

The anchor layer may be formed on the light transmission regulating layer provided on the conveyance layer by applying the coating liquid for the adhesive to the light transmission regulating layer. The anchor layer may be formed on the light transmission regulating layer by applying the coating liquid for the anchor layer to the light transmission regulating layer using a well-known method similar to the method for the protective layer.

[5-1-2-4] Miscellaneous

The substrate may be pre-subjected to surface modification. In a case where surface modification is performed to roughen the front surface of the substrate, the wettability of the substrate can be improved to enhance the adhesion between the substrate and the protect layer. A method for surface modification is not particularly limited. Examples of the surface modification method includes pre-executing a corona discharge treatment or a plasma discharge treatment on the front surface of the protect layer and coating the front surface of the substrate with an organic solvent such as IPA or aceton. These surface treatments allow the binding between the substrate and the protect layer to be enhanced to improve the strengths of the substrate and the protect layer. Thus, the protect layer can be restrained from peeling off from the substrate. Furthermore, in a case where the conveyance layer of the substrate is peeled off, a release layer may be formed on the conveyance layer of the substrate in order to improve the function to peel off the conveyance layer. The release layer may be formed by coating the substrate with a composition containing the above-described release agent using roll coating, rod bar coating, spray coating, air knife coating, slot die coating, or the like, and drying the composition.

[5-2] Formation of the Ink Receiving Layer

[5-2-1] Ink Jet Coating Liquid

The ink receiving layer may be formed by mixing at least the inorganic particulates and the water-soluble resin with the appropriate medium to prepare a coating liquid, applying the coating liquid to the front surface of the substrate with the three-dimensional image, and drying the coating liquid.

Examples of other additives may include a surfactant, a pigment dispersant, a thickener, a defoamer, an ink fixatative, a dot regulator, a colorant, a fluorescent whitening agent, an antioxidant, an ultraviolet absorber, a preservative, and a pH regulator.

The concentration of the inorganic particulates in the coating liquid may be determined as needed with coatability with the coating liquid and the like taken into account, and is not particularly limited. However, the weight percentage of the inorganic particulates in the total coating liquid is 10 wt % or more and 30 wt % or less.

[5-2-2] Coating with the Ink Jet Coating Liquid

The ink receiving layer may be formed by applying the coating liquid to the front surface of the substrate with the above-described three-dimensional image. After the application, the coating liquid is dried as needed.

Any well-known coating method may be used. Examples of the coating method include blade coating, air knife coating, curtain coating, slot die coating, bar coating, gravure coating, and roll coating.

The amount of coating liquid applied is preferably 10 $g/m^2$ or more and 40 $g/m^2$ or less in terms of solid content. In a case where the amount of coating liquid applied is 10 $g/m^2$ or more and preferably 15 $g/m^2$ or more, an ink receiving layer that is excellent in absorptivity of moisture in the ink may be formed. Consequently, a flow of the ink through the printed image and bleeding of the image can be suppressed. On the other hand, in a case where the amount of coating liquid applied is 40 $g/m^2$ or less and more preferably 20 $g/m^2$ or less, the transfer material is less likely to be curled in a case where a coating layer is dried.

[5-3] Formation of the Bonding Layer

[5-3-1] Coating Liquid for the Adhesive

In the transfer material of the present invention, a prepared coating liquid for the adhesive may be applied onto the front surface of the ink receiving layer of the air gap absorption type laminated on the substrate with the three-dimensional image to provide discretely the aggregates of pieces of the adhesive included in the bonding layer on the front surface of the ink receiving layer. Consequently, the transfer material is configured such that externally exposed portions remain on the front surface of the ink receiving layer.

The concentration of the adhesive in the coating liquid may be determined as needed with the coatability with the coating liquid and the like taken into account and is not particularly limited. The weight percentage of the adhesive in the total coating liquid is 2 wt % or more and 40 wt % or less.

[5-3-2] Coating of the Adhesive

The transfer material is formed, for example, by applying the coating liquid for the adhesive to the coating the front surface of the ink receiving layer formed on the substrate. After the application, the coating liquid is dried as needed.

The preferred coating method is gravure coating because of the need to provide discretely the aggregates of pieces of the adhesive included in the bonding layer on the front surface of the ink receiving layer of the air gap absorption type. In that case, the number of groove lines in a gravure roll is preferably 200, more preferably 300, and most preferably 600. More groove lines allow one or more exposed portions of the ink receiving layer of the air gap absorption type to be more easily formed in one pixel in the ink jet printed image.

[5-3-3] Drying During Formation

In a case where the coating liquid for the adhesive is applied to the front surface of the ink receiving layer formed on the substrate, the adhesive is preferably dried at the glass transition temperature at which the adhesive is melted, or lower. In a case where the adhesive is dried at the glass transition temperature or higher, the adhesive is melted to flow and the aggregates of pieces of the adhesive may bond to one another to cover the entire front surface of the ink receiving layer including the exposed portions thereof, degrading the ink absorptivity. The adhesive may contain a plurality of types of particles such that particles of one of these types provide both a function to serve as a binder for adhesive particles remaining in a particle form and a function to enhance the bonding between the ink receiving layer and the water-soluble resin. In such a case, the drying preferably takes place at the glass transition temperature of the adhesive functioning as a binder, or higher, and at the glass transition temperature of the adhesive particles remaining in a particle form, or lower. The drying temperature may be selected as needed according to the properties of the adhesive to allow both bonding capability and ink jet print characteristics to be achieved.

Moisture vaporizes from the coating liquid for the adhesive during the coating process, and thus, the coating liquid for the adhesive has an increased concentration during coating and film formation. Thus, before drying, the particles of the adhesive forming the coating liquid for the adhesive are dispersed substantially in the form of unitary particles, and in a case where the coating liquid for the adhesive has an increased concentration during the process of drying, the dispersion of the thermoplastic resin particles is likely to be disrupted. As a result, the particles of the adhesive collide against and merge with one another, and a plurality of particles is aggregated. The thermoplastic resin coating liquid for the adhesive is formed into a film with aggregates each of a plurality of particles as described above, allowing the particles of the adhesive included in the bonding layer to be discretely provided on the front surface of the ink receiving layer. Therefore, in a case where unitary particles of the adhesive are discretely provided, the concentration of the undried coating liquid for the adhesive may be reduced. In a case where aggregates each of a plurality of particles of the adhesive are discretely provided, the concentration of the undried coating liquid for the adhesive may be increased. As described above, the discrete state of the pieces of the adhesive included in the bonding layer during film formation can be regulated by adjusting the concentration of the undried coating liquid for the adhesive as needed. The discrete state of the particles of the adhesive included in the bonding layer can be controlled according to the intended purposes of the transfer material and the printed material.

Now, a manufacturing method for the transfer material will be described in which a three-dimensional image is formed directly on the ink receiving layer. For example, the transfer material may be manufactured by providing a recessed and protruding three-dimensional image directly on the ink receiving layer and then laminating the ink receiving layer to the substrate. The above-described matters are omitted below and only matters unique to the manufacturing method will be described.

Figure 20:
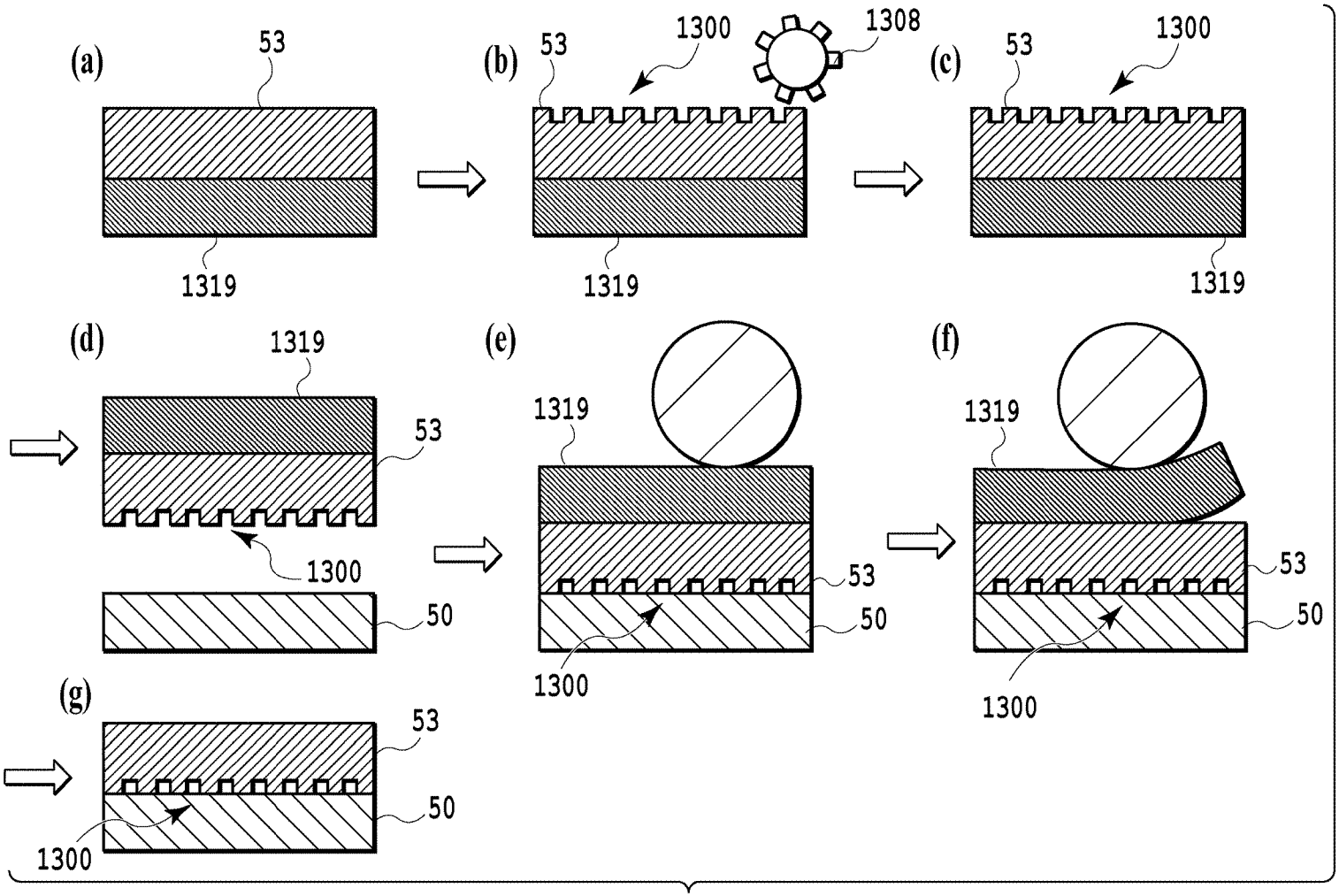
FIG. 20 is a diagram illustrating a manufacturing method for a transfer material in which the image based on the three-dimensional micro-structure is provided directly on an ink receiving layer.

For example, as depicted in FIG. 20, a three-dimensional image forming apparatus 1308 is used to provide the recessed and protruding three-dimensional image 1300 directly on the ink receiving layer 53 supported by a temporary support 1319. The transfer material is manufactured by subsequently laminating the ink receiving layer 53 to the substrate 50 and peeling off the support 1319. Any well-known method may be used to provide the three-dimensional image directly on the ink receiving layer. For example, laser engraving or platen transfer may be used to form a three-dimensional image directly on the ink receiving layer.

Any well-known method may be used to laminate the ink receiving layer provided with the three-dimensional image to the conveying substrate. For example, the adhesive may be applied to the substrate to a small thickness, and the substrate may be laminated to the ink receiving layer. Importantly, with printing of an image on the front surface of the printed material taken into account, the adhesive on the substrate is provided partly in contact with the ink receiving layer. In a case where the adhesive contacts the entire surface of the ink receiving layer and the image is printed on the front surface of the printed material to which the ink receiving layer has been transferred, the ink absorptivity may be degraded. In a case where the substrate and the ink receiving layer are thermocompression bonded together, bonding temperature and bonding pressure are adjusted so as to allow the three-dimensional image on the ink receiving layer to be maintained. Basically, the substrate and the ink receiving layer need to be bonded together with the three-dimensional image formed on the ink receiving layer maintained.

[6] Manufacturing Method for the Printed Material

[6-1] Image Printing Using the Ink Jet System

A method for printing an image on the transfer material of the present invention will be described.

As described above, the transfer material may be configured such that the externally exposed portions remain on the front surface of the ink receiving layer of the air gap absorption type laminated on the substrate, by discretely providing the aggregates of pieces of the adhesive included in the bonding layer on the front surface of the ink receiving layer. An image may be printed on the print surface of the transfer material as described above using the ink jet printing method.

The ink jet printing method is a method of printing an image by ejecting ink (ink droplets) to the ink jet print surface of the transfer material through a plurality of nozzles formed in the print head. The type of the ink jet printing method is not particularly limited, and either a thermal ink jet method or a piezoelectric ink jet method may be used. The thermal ink jet printing method is preferable in view of its capability of printing high-quality, high-resolution images at high speed.

The ink jet printing method may be implemented using an ink jet printing apparatus (ink jet printer). The ink jet printer can print very stable images because, during image printing, the print head is inhibited from coming into contact with the image support with the ink receiving layer. The type of the ink jet printer is not particularly limited, and a printing method for the ink may be a serial scan method, a full line method, or the like. The serial scan method enables a reduction in the size of each ink droplet ejected from the print head to allow high-quality images to be easily printed. Such a serial scan printer may be a well-known small-sized ink jet printer or a large-format printer. In the serial scan method of printing the sections of an image during the corresponding scans of the print head, a plurality of scans may be executed to allow the ink to land on the same print area a plurality times at predetermined time intervals (divided overlapping scans). Also in this case, the ink absorption speed of the ink receiving layer is sufficiently higher than an ink vaporization speed, and thus, the ink is unlikely to remain on the adhesive.

On the other hand, the full-line printer can print high-resolution, high-quality images at high speed. In a case where an image is printed on the transfer material, an inverted image or a normal image is printed depending on the direction in which the image is viewed, and the image may be selected according to the intended use.

[6-2] Ink Used

As the ink for the present invention, either the dye ink or the pigment ink may be used. The pigment ink is preferably used in view of the quality and durability of images printed with the pigment ink.

[6-2-1] Dye Ink

Dye color material components and water and solvent components in the dye ink permeate even the inside of the ink receiving layer of the air gap absorption type and are fixed therein. In the present invention, in a case where a portion of the dye ink comes into contact with the exposed portion of the ink receiving layer, which has a high ink absorption speed, the portion of the ink is drawn and absorbed into the ink receiving layer. The dye ink absorbed through the exposed portion of the ink receiving layer permeates the inside of the ink receiving layer according to the appropriately designed and controlled permeation anisotropy of the ink receiving layer, to form a desired ink dot. In the ink receiving layer, the ink infiltrates and spreads according to the permeation anisotropy, thus allowing the ink dot to be formed below the corresponding bonding portion. Therefore, high-resolution images can be printed with the area factor needed to form images maintained. However, since the dye color material and the moisture and solvent in the ink permeate the inside of the ink receiving layer, the liquid components and the dye color material of the remaining ink may infiltrate and diffuse through the ink receiving layer depending on the storage conditions for the printed material, inducing image bleeding (color material migration) Furthermore, the dye ink has only low weatherability, and in a case where the dye ink is exposed to sunlight or the like for a long term, the dye may be decomposed to degrade the printed image.

In regard to color material migration as described above, much attention needs to be paid to dye inks containing no solids because the color material is dissolved into the ink. For example, in a case where a portion of the ink absorbed once into the air gaps in the ink receiving layer is even slightly dried, the ink is separated into portions in the respective the air gaps, and the length of each of the connections between the air gaps is reduced to facilitate isolation of the portions of the ink remaining in the air gaps from one another. More specifically, as described above, a portion of the air remaining at each of the connections between the air gaps is moved to form an air layer. The continuous ink having permeated the inside of the air gaps is separated into portions by the air layer, and the portions of the ink in the respective air gaps are isolated from one another. The separate portions of the ink isolated from each other by the air layer are unlikely to migrate because the air layer offers resistance. These actions allow possible image bleeding (color material migration) to be suppressed even in a case where the dye ink is used.

In a case where the transfer material from which the substrate is not peeled off is bonded to the image support with no breatherability for transfer and the substrate covering the ink receiving layer as a protective layer has poor moisture permeability, the color material may re-diffuse due to residual moisture of the ink resulting from the ink jet printing and moisture absorption during storage of the printed material, leading to image bleeding. Thus, in particular, in a case where ink jet printing is performed on the bonding layer side using the dye ink, the substrate covering the front surface of the ink receiving layer may be formed of a material having a certain level of moisture permeability.

[6-2-2] Pigment Ink

In the pigment ink, the state of ink absorption varies depending on the average particle size of the pigment color material of the ink and the average pore diameter of the ink receiving layer. For example, in a case where the average particle size of the pigment color material of the ink is larger than the average pore diameter of the ink receiving layer, the pigment color material component remains on the front surface of the ink receiving layer, the water and solvent components in the ink permeate the inside of the ink receiving layer, and the pigment color material components is separated from the water and solvent components as a result of solid-liquid separation. In this case, in order to inhibit the color material remaining on the front layer of the ink receiving layer from acting as hindrance to bonding, the thickness of the bonding layer may be appropriately adjusted so that the exposed portions of the ink receiving layer house all of the color material remaining on the front surface of the ink receiving layer to prevent the color material from protruding high above the bonding layer. More preferably, a more advanced bonding capability can be achieved by covering the color material remaining on the front surface of the ink receiving layer with a sufficient amount of adhesive melted during thermocompression bonding to form the melted adhesive into a bonding film.

In a case where ink jet printing is performed on the bonding layer side using the pigment ink, the pigment may remain on the front surface of the ink receiving layer of the air gap absorption type as a result of solid-liquid separation. However, in a case where the transfer material is bonded to the image support for transfer, the pigment is fixedly bonded with the adhesive provided in the form of the sea and islands, hindering possible image bleeding resulting from re-diffusion of the color material. In a case where the substrate itself is peeled off after being bonded to the image support for transfer, the protruding and recessed three-dimensional image on the substrate is inverted, and the inverted three-dimensional image is transferred to the ink receiving layer. Then, an image is additionally printed on the front surfaces of the recesses and protrusions of the ink receiving layer that are exposed as a result of removal of the substrate. Even in a case where the image is additionally printed with the pigment ink, the scratch resistance of the image can be improved by modifying the recessed and protruding shape of the ink receiving layer and the like so as to hinder possible scratching of the color material remaining on the recessed portions of the front surface of the ink receiving layer. As described above, the scratch resistance problem can be mitigated in a case where the image is additionally printed on the front surface of the ink receiving layer to which the three-dimensional image on the substrate has been transferred. Thus, the pigment ink containing the color material itself having high weatherability is preferably used. In a case where the image is additionally printed with the pigment ink, the recessed and protruding shape, the width, and the height of the three-dimensional image may be controllably modified or adjusted so as to improve the scratch resistance of the front surface.

For example, the pigment, which is a color material, is assumed to be subjected to solid-liquid separation on the front surface of the ink receiving layer, with all of the pigment remaining on the front surface of the ink receiving layer. For the mass concentration of solids such as the pigment in the aqueous ink that can be stably ejected, the concentration of the pigment in the ink is assumed to be approximately 5%. In such a case, the thickness of the bonding layer may be set equal to approximately three-hundredths to approximately half of the thickness of the ink receiving layer to inhibit the color material from protruding beyond the height of the adhesive and to prevent the color material remaining on the front surface of the ink receiving layer from acting as hindrance to bonding. As a result, an excellent bonding capability can be achieved. A sufficient amount of adhesive melted during thermal transfer can cover the color material remaining on the front surface of the ink receiving layer to form the melted adhesive into a bonding film between the color material and the image support, allowing further higher bonding capability to be achieved. For example, in a case where each ink droplet has a volume of 2 pl to 4 pl, the ink receiving layer of the air gap absorption type has a porosity of 80%, and the printed image is a color image, then preferably the ink receiving layer has a thickness of approximately 8 μm to approximately 16 μm and the bonding portion has a thickness of approximately 0.3 μm to approximately 8 μm. With an environmental variation in the volume of the ink droplet and a manufacturing variation in the porosity of the ink receiving layer taken into account, the bonding portion preferably has a thickness of 0.5 μm to 5 μm.

The air gap diameter of the ink receiving layer may be set larger than the expected average particle size of the pigment to allow some of the solid components such as the pigment to permeate the inside of the ink receiving layer, enabling a reduction in the thickness of the bonding layer. However, in a case where the air gap diameter of the ink receiving layer is much larger the average particle size of the pigment and the air gaps of the ink receiving layer are filled with the liquid components of the ink to some degree, image bleeding (color material migration) may be induced depending on the storage conditions for the printed material. That is, along with the liquid components of the remaining ink, the pigment component, which is a color material, may gradually infiltrate and diffuse into the ink receiving layer. Therefore, the permeability of the pigment in the ink receiving layer can be controlled by setting the air gap diameter of the ink receiving layer slightly larger than the average particle size of the pigment, which is a color material, or slightly larger than the particle size of each secondary particle or composite particle. As a result, a print material may be provided that is excellent in print characteristics and storage stability.

Only the water and solvent components of the pigment ink permeate the ink receiving layer according to the appropriately designed and controlled permeation anisotropy of the ink receiving layer. Thus, the pigment color material contributing to coloring is unlikely to permeate the ink receiving layer located below the bonding portions, and thus, the pigment ink is inferior to the dye ink in the capability of forming high-resolution images. However, substantially problem-free high-resolution images can be printed by extending the exposed portions of the ink receiving layer down to areas below the bonding portions, modifying the structure of the adhesive taking the bonding capability and the area factor into account, and enlarging the air gaps in the ink receiving layer to facilitate infiltration of the color material into the ink receiving layer. That is, the area of a part of each bonding portion that contacts the ink is reduced to allow the ink to move around to the ink receiving layer, located below the bonding portion, increasing the area factor and thus the image density.

Regardless of whether each piece of the pigment ink has a large or small diameter, the particle size of each piece of the pigment, which serves as a coloring agent, is of substantially the same order of the air gap diameter of the ink receiving layer, and the front surface of the ink receiving layer is very hydrophilic. Thus, a layer of the pigment remaining on the ink receiving layer as a result of solid-liquid separation is likely to allow the water and solvent components in the pigment ink to pass through. Therefore, even in a case where the pigment first covers the adhesive during color printing, the pigment is absorbed more quickly into the ink receiving layer than into the adhesive because the water and solvent components of the pigment ink have a particle size sufficiently smaller than the diameter of each of the air gaps in the adhesive formed by particles thereof.

Furthermore, the pigment ink is likely to be separated into the color material component and the water or solvent component as a result of solid-liquid separation, with the water or solvent component permeating the inside of the ink receiving layer. Consequently, the front surface of the ink receiving layer is likely to be dried. Thus, during bonding, the front surface of the ink receiving layer has a reduced amount of moisture, suppressing improper bonding caused by vaporization of moisture to allow improvement of the bonding capability.

The pigment component in the pigment ink may be a self-dispersing pigment with a bond to at least one type of functional group selected from a group consisting of a carbonyl group, a carboxyl group, a hydroxyl group, and a sulfone group, or salt thereof, or a resin dispersing pigment containing pigment particles peripherally coated with resin. In the transfer material of the present embodiment, appropriate adjustment of the thickness of each bonding portion allows all of the pigment color material remaining on the front surface of the ink receiving layer as a result of solid-liquid separation to be housed in the exposed portions of the ink receiving layer 53. Consequently, the color material is hindered from protruding high above the adhesive to allow the color material remaining on the front layer of the ink receiving layer to be prevented from acting as hindrance to bonding. As described above, adjustment of the thickness of each bonding portion allows the color material remaining on the front surface of the ink receiving layer to be covered with a sufficient amount of adhesive melted during thermal transfer, enabling the melted adhesive to be formed into a bonding film between the color material and the image support. The bonding portion as described above is suitable in a case where a self-dispersing pigment containing pigment particles themselves not exhibiting the bonding capability.

The resin dispersing pigment increases the binding force exerted among the pigment particles separated from the ink medium, allowing a pigment film to be formed on the front surface of the ink receiving layer. In this case, only a small amount of moisture is present on a front surface of the pigment film. This is because the pigment film substantially holds back the moisture in the lower layer in the ink receiving layer and further substantially blocks feeding of moisture from the lower layer. Thus, the resin dispersing pigment component preferably makes the front surface of the ink receiving layer likely to dry. In a case where the heat during transfer melts the dispersing resin of the resin dispersing pigment, the water-soluble resin in the ink receiving layer, and the adhesive, the dispersing resin, the water-soluble resin, and the adhesive exhibit an increased affinity for one another, and the resin dispersing pigment is also firmly bonded to the ink receiving layer. Moreover, in a case where the heat during transfer melts the dispersing resin of the resin dispersing pigment, the adhesive, and the constituent material of the image support, the dispersing resin, the adhesive, and the image support exhibit an increased compatibility with one another, and the resin dispersing pigment is also firmly bonded to the image support. Therefore, the use of the resin dispersing pigment enables the dispersed resin to be melted and properly bonded to the image support even in a case where the bonding layer is too thin to allow all of the color material remaining on the front surface of the ink receiving layer from being housed in the exposed portions of the ink receiving layer, resulting in a part of the color material protruding high above the bonding layer.

The resin with which the periphery of the pigment particles is coated is preferably an ester (meth)acrylate-based copolymer having an acid value of 100 to 160 mg KOH/g. Setting the acid value of the resin to 100 mg KOH/g or more allows the ink to be more stably ejected in the ink jet printing system that thermally ejects the ink. On the other hand, setting the acid value of the resin to 160 mg KOH/g or less makes the resin hydrophobic relative to the pigment particles, improving the fixability and the bleeding resistance of the ink. Therefore, the resin is suitable for high-speed fixation of the ink and high-speed printing.

The acid value as used herein refers to the amount (mg) of KOH needed to neutralize 1 g of resin and may be an indicator of hydrophilicity of the resin. The acid value in this case may be calculated from the composition ratio of monomers contained in the resin dispersant. As a specific method for measuring the acid value of the resin dispersion element, Titrino (manufactured by Metrohm) may be used which determines the acid value by potentiometric titration.

In the present invention, the surface tension and the viscosity of the ink for ink jet printing are appropriately controlled such that, when a portion of the ink having come into contact with the exposed portion of the front surface of the ink receiving layer starts to be absorbed into the ink receiving layer, which has a high ink absorption speed, the remaining portion of the ink that is continuous with the above-described portion is uninterruptedly drawn into the ink receiving layer. The viscosity of the ink as described above is preferably 1.5 mPa·s to 10.0 mPa·s, more preferably 1.6 mPa·s to 5.0 mPa·s, and most preferably 1.7 mPa·s to 3.5 mPa·s. On the other hand, the surface tension y of the ink is preferably 25 mN/m to 45 mN/m.

That is, in a case where a portion of the ink having landed on the print surface of the transfer material protrudes out from the bonding portion of the bonding layer and droops onto the corresponding exposed portion of the ink receiving layer, the surface tension and the viscosity of the ink may be adjusted so as to inhibit the ink from being broken away on the front surface of the bonding layer. The surface tension and the viscosity of the ink may further be adjusted so that, after a portion of the ink having passed through the space between the bonding portions of the bonding layer in a bypassing manner and then come into contact the exposed portion of the front surface of the ink receiving layer, the ink is drawn and absorbed into the ink receiving layer. Adjusting the ink viscosity to within the above-described range improves the fluidity of the ink during ink ejection to allow more excellent supply of the ink to the nozzles and thus more stable ejection of the ink. Adjusting the ink surface tension to within the above-described range allows meniscus at ink ejection ports to be maintained during ink ejection.

The viscosity of the ink is a value calculated in compliance with a method described in a standard (Japanese Industrial Standards) specifying a method for measuring the viscosity, the kinematic viscosity, the viscosity×density, and the apparent viscosity of a liquid using a capillary viscometer, a falling-ball viscometer, a rotational viscometer, and an oscillational viscometer. Specifically, the viscosity means a value measured at 25° C. at using an E viscometer (for example, "RE-80L Viscometer" manufactured by TOKI SANGYO CO., LTD.). The viscosity of the ink may be adjusted based on the type and amount of a water-soluble organic solvent and the like, besides the type and amount of a surfactant.

The surface tension of the ink means a value measured at 25° C. using a Welhelmy method using a platinum plate and an automatic surface tensiometer (for example, "CBVP-Z Series" manufactured by Kyowa Interface Science Co., Ltd.). The surface tension of the ink may be adjusted based on the amount of the surfactant added, the type and the content of the water-soluble organic solvent, and the like.

In the present embodiment, the concentration of the color material in the ink is not particularly specified. However, the color material concentration is preferably 0.5% or more and 10% or less and more preferably 1% or more and 5% or less. Adjusting the color material concentration to within such a range allows both the visibility and bonding capability of the image to be achieved. Particularly for the pigment ink, the color material concentration needs to be precisely controlled in order to allow the color material pigment remaining on the front surface of the ink receiving layer to be housed in the exposed portions of the ink receiving layer. That is, the pigment concentration is preferably set as high as possible to the extent that the color material is inhibited from protruding high above the adhesive and that the visibility of the image can be improved. Adjusting the ink concentration to within the above-described range allows the viscosity of the ink to be optimally adjusted to improve the fluidity of the ink during ink ejection, enabling more excellent supply of the ink to the nozzles in the print head and thus more stable ejection of the ink.

[6-3] Transfer Method

In a case where the printed material of the present invention is produced using the transfer material from which the substrate is not peeled off, first, for example, a normal image or an inverted image is printed on the ink jet print surface of the transfer material depending on the direction in which the image is viewed. Then, after the image is printed, the printed material is obtained by transferring the transfer material to the image support via discretely disposed aggregates of pieces of the adhesive or allowing self-melting of discretely disposed aggregates of a self-melt adhesive.

In a case where the printed material of the present invention is produced using the transfer material from which all of the substrate including the conveyance layer is peeled off, for example, an inverted image is printed on the print surface of the transfer material. Then, the printed material with the ink receiving layer laminated on the image support is obtained by transferring the transfer material to the image support via discretely disposed aggregates of pieces of the adhesive and then peeling off all of the substrate.

In a case where the substrate includes the functional layer such as the transparent protective layer, the hologram layer, or the print layer, first, for example, an inverted image is printed on the print surface of the transfer material including the functional layer. Then, the transfer material is transferred to the image support via the discretely disposed aggregates of pieces of the adhesive, and subsequently, only the conveyance layer (a part of the substrate) is peeled off from the substrate including the functional layer such as the conveyance layer, the hologram layer, or the print layer. Consequently, a printed material can be obtained in which the ink receiving layer integrated with the functional layer and on which the image is printed is laminated on the image support.

In the present invention, excellent transfer can be achieved even in a case where the ink receiving layer contains a sufficient amount of moisture during the transfer process. As described above, the ink receiving layer of the air gap absorption type can absorb a large amount of ink, and has an air gap structure unlikely to be destroyed during transfer and can thus maintain the air gap structure after transfer. Thus, even in a case the adhesive and the binder are melted during transfer, the absorbed ink can be held inside the ink receiving layer, and possible vapor is trapped inside the ink receiving layer. Thus, excellent transfer can be achieved even in the presence of a sufficient amount of moisture. In the bonding layer with the aggregates of pieces of the adhesive discretely disposed on the ink receiving layer, the adhesive absorbs substantially no ink or absorbs the ink but only at a low absorption speed, making the ink less likely to remain on the front surface of the bonding layer or inside the bonding layer. Thus, the ink that hinders transfer is less likely to remain in the bonding layer, allowing the transfer material to be properly transferred to the image support.

A transfer method used for the present invention may be selected according to the characteristics of the adhesive. For example, in a case where a stimulation responsive material is used for the adhesive and the adhesive is of a water activation type, water is applied in a water application step using a water application apparatus after an image is formed on the transfer material. This allows the bonding layer with the discretely disposed aggregates of pieces of the adhesive to be provided with the bonding capability. In a case where the thermoplastic resin is of an ultraviolet activation type, ultraviolet rays are applied in an ultraviolet irradiation step using an ultraviolet irradiation apparatus after an image is formed on the transfer material. This allows the bonding layer with the discretely disposed aggregates of pieces of the adhesive to be provided with the bonding capability. In a case where the adhesive is pressure sensitive, the bonding layer with the aggregates of pieces of the adhesive discretely disposed therein itself exhibits bonding capability. Thus, the bonding layer may be allowed to exhibit bonding capability by executing a compression bonding step.

In a case where the adhesive is of a thermal activation type and self-melt type, the bonding layer with the discretely disposed aggregates of pieces of the adhesive is heated in a heating step using a heating apparatus, so as to be provided with the bonding capability. Examples of the heating apparatus include a heating fan, a heating belt, and a thermal transfer head, but the present embodiment is not limited to these heating apparatuses.

In a case where the adhesive is formed of a plurality of materials, the above-described transfer step may include a plurality of steps using a combination of a plurality of apparatuses.

In the present invention, as the adhesive, thermoplastic particles are particularly preferably used that exhibit the bonding capability on heating or under pressure. Thus, among the above-described transfer methods, the transfer based on the thermocompression bonding step is preferable that uses both heating and compression bonding. An example configuration for such transfer may be a configuration including both a heat roller and a pressurization roller.

In the present invention, a printed material may be obtained by forming an image on the ink receiving layer of the transfer material, then laying the ink receiving layer on top of the image support, and conveying the laminate between the heated heat roller and the pressurization roller to bond the transfer material to the image support via the bonding layer with the discretely disposed aggregates of pieces of the adhesive. Alternatively, a printed material may be obtained by printing an image on the ink receiving layer of the transfer material and then passing the transfer material between the heated heat roller and the pressurization roller to allow self-melting of the bonding layer with discretely disposed aggregates of a self-melt adhesive. In this case, the substrate side is preferably heated using the heat roller. Heating the substrate side facilitates heating of the water-soluble resin in the ink receiving layer to the glass transition temperature at which the resin exhibits the bonding capability, or higher, and also facilitates heating of the bonding layer with the discretely disposed aggregates of pieces of the adhesive to the temperature at which the adhesive exhibits the bonding capability, or higher.

In the present invention, in a case where the transfer material with the image printed on the ink receiving layer is transferred to the image support by thermocompression bonding, it is important to control the heat and pressure during thermocompression bonding so as to allow the air gap structure of the ink receiving layer to be maintained even after thermocompression bonding. With the air gap structure maintained, even in a case where the liquid components of the ink are subjected to bumping to generate vapor due to heat and pressure during thermocompression bonding, the vapor can be trapped in each of the air gaps. As a result, no air layer or the like is formed on the bonding surface, resulting in an excellent bonding capability. The air gap structure maintained during transfer suppresses collapse of the air gaps caused by pressure and melting of the air gaps caused by heat to prevent the nonvolatile solvent, which is a liquid component of the ink, from seeping out on the front surface, allowing an excellent bonding capability to be achieved. In a case where images are printed in multiple layers on the printed material including the recessed and protruding ink receiving layer as a front surface thereof, it is important to control the heat and pressure during thermocompression bonding so as to maintain the recessed and protruding portion of the three-dimensional image formed on the ink receiving layer. With the recessed and protruding portion of the three-dimensional image maintained, even in a case where images are printed in multiple layers on the printed material including the recessed and protruding ink receiving layer as a front surface thereof, the visibility of the lower-layer three-dimensional image is maintained.

The temperature of the thermocompression bonding is preferably controllably adjusted to the glass transition temperature at which the thermoplastic resin of the discretely disposed aggregates of pieces of the adhesive exhibits the bonding capability, or higher. The temperature of the thermocompression bonding may thus be controlled to allow the transfer material to be transferred to the image support via the discretely disposed aggregates of pieces of the adhesive. More preferably, the temperature of the thermocompression bonding is controllably adjusted to the glass transition temperature at which the water-soluble resin forming the ink receiving layer of the transfer material is melted, or higher, to melt and bond the water-soluble resin of the ink receiving layer and the adhesive together, improving the bonding capability. More preferably, the temperature of the thermocompression bonding may be controllably adjusted to the temperature at which the resin particles E2 forming the protective layer are melted, or higher, to allow the foil cutting capability to be improved.

Importantly, the temperature of the thermocompression bonding is controlled so as to maintain the air gap structure after bonding without collapsing the air gap structure of the ink receiving layer more than needed in a case where the image support and the transfer material are thermocompression bonded together. That is, the transfer is preferably performed at a temperature equal to or lower than the melting temperature of the component forming the air gaps so as to inhibit the air gaps from being melted to cause the nonvolatile solvent, which is a liquid component of the ink, to seep out on the front surface. Furthermore, the transfer is preferably performed particularly at the boiling point of water or lower so as to inhibit bumping and vaporization of the water and solvent component of the ink in the individual air gaps.

The pressure of the thermocompression bonding is preferably 0.5 kg/cm or more and 7.0 kg/cm or less. Setting the pressure of the thermocompression bonding to 0.5 kg/cm or more allows the ink receiving layer of the transfer material with the image printed thereon to adhere to the image support to enable the image support and the transfer material to be compressively bonded together. That is, the thermoplastic resin resulting from melting of the discretely disposed aggregates of pieces of the adhesive can sufficiently fill the spaces defined by the fine recesses and protrusions of the ink receiving layer of the air gap absorption type between the ink receiving layer and the image support. On the other hand, setting the pressure of the thermocompression bonding to 7.0 kg/cm or less allows the air gaps to be maintained without collapsing the air gap structure of the ink receiving layer more than necessary, preventing the non-volatile solvent, which is a liquid component of the ink, from seeping out on the front surface to improve the bonding capability. Even in a case where images are printed in multiple layers on the printed material including the recessed and protruding ink receiving layer as a front surface thereof, the visibility of the lower-layer three-dimensional image is maintained. Moreover, the spaces defined by the recessed and protruding portion of the three-dimensional image can be sufficiently filled with the thermoplastic resin resulting from melting of the discretely disposed aggregates of pieces of the adhesive.

A silicone roller is preferably used as a pressurization roller 22 that contacts the image support 55 side. The silicone roller has a release function. Thus, in a case where the image support 55 is not present between the heat roller 21 and the pressurization roller 22, in other words, in a case where the pressurization roller 22 is brought into contact with the front surface of the ink receiving layer having the bonding layer with the discretely disposed aggregates of pieces of the adhesive, the silicone roller makes the front surface of the ink receiving layer difficult to transfer. Therefore, the front surface of the ink receiving layer can be prevented from being bonded to the pressurization roller 22 via the discretely disposed aggregates of pieces of the adhesive.

In the present invention, in a case where the transfer material is used from which all of the substrate is peeled off, an inverted image can be printed via the discretely disposed aggregates of pieces of the adhesive. Subsequently, the transfer material with the image printed thereon is transferred (bonded) to the image support, and then, a peel-off step is executed to peel off all of the substrate. Consequently, a printed material is obtained in which the ink receiving layer with the image printed thereon is laminated on the image support via the adhesive. In a case where the substrate further includes the functional layer such as the protective layer, the hologram layer, or the print layer, a printed material in which the ink receiving layer integrated with the functional layer and on which the image is printed can be obtained by peeling off only the conveyance layer of the substrate (a part of the substrate) in the peel-off step following the bonding between the transfer material and the image support.

[6-4] Peel-Off Method

In the present invention, the peel-off step may be provided in which a part or all of the substrate is peeled off as needed after the transfer material with the image printed thereon is transferred (bonded) to the image support. Peel-off of all of the substrate allows obtainment of a printed material in which the ink receiving layer with the image printed thereon is laminated on the image support via the adhesive. The ink receiving layer with the three-dimensional image provided thereon is exposed from this printed material, and thus, an additional image may be printed on the ink receiving layer. In a case where the substrate further includes the functional layer such as the protective layer, the hologram layer, or the print layer, a printed material in which the ink receiving layer integrated with the functional layer and on which the image is printed can be obtained by peeling off only the conveyance layer of the substrate (a part of the substrate).

In a case where the substrate is of a hot-state peel-off type, the substrate is preferably peeled off immediately after thermocompression bonding before the temperature lowers. In a case where the substrate is of such a hot-state peel-off type, the substrate is preferably peeled off using a peeling mechanism including a separation pawl or a peeling roll. Such a peel-off method effectively allows productivity to be improved in a case where the transfer material is supplied in a roll to roll manner, in other words, in a case where a roll of the transfer material is paid out and fed and where the substrate is then peeled off from the transfer material and rolled.

In a case where the substrate is of a cold-state peel-off type, the substrate may be peeled off even at a reduced temperature. Thus, the substrate may be peeled off not only using a roll or peel mechanism but also manually. Therefore, the substrate of the cold-state peel-off type is particularly suitable for a case the substrate is machined into a cut sheet form.

A peel-off angle θ at which the substrate is peeled off is 0° C. to 165° C. and preferably 90° C. to 165° C. Setting the peel-off angle θ in this manner allows the foil cutting capability to be improved.

In the thermocompression bonding step and the peel-off step, a laminate machine of a well known two-roll type or a four-roll type may be used. Compared to the two-roll type, the four-roll type is preferably used because this type facilitates heat transfer during thermocompression bonding to allow the peel-off step to be easily executed.

[7] Manufacturing Apparatus for the Printed Material

A manufacturing apparatus will be described that manufactures a printed material using the ink jet transfer material from which the substrate serving as a conveyance layer of the transfer material is peeled off.

As an apparatus that prints an image on the print medium of the present invention, either a well-known small-sized ink jet printer or a large-format printer may be used so long as the printer uses the pigment ink for printing. As an apparatus that transfers the transfer material to the image support and peels off the substrate, any well-known laminator may be used, such as D-10 manufactured by DYNIC CORPORATION or LPD3223 CLIVIA manufactured by FUJITEX. The laminator may include a pair of heat rollers 21 and a pair of pressurization roller 22 such that, when the image support and the transfer material pass between the rollers, the pigment permeation layer of the transfer material is thermocompression bonded to the image support.

The manufacturing apparatus may include a feeding unit that feeds the transfer material to a printing unit, the printing unit that prints an image using the ink jet printing method or the like, a thermocompression bonding unit, peel-off unit that peels off the substrate, and a discharge unit that discharges and accumulates printed materials with pigment images transferred thereto; all of the units are integrated together. As such an integral apparatus, for example, an apparatus described in Japanese Patent No. 05944947 may be used.

EXAMPLES

Specific examples of the present invention will be described below. However, the present invention is subjected to no limitations by the examples described below. In the description below, "pts" and "%" refer to mass standards unless otherwise specified.

[Preparation of an Alumina Hydrate Dispersion Liquid]

Twenty pts·wt. alumina hydrate A having a boehmite structure (pseudo-boehmite structure) ("Disparel HP14" manufactured by SASOL) was added into 79.4 pts·wt. water, and 0.4 pts·wt. acetic acid was added to the mixture. A peptization treatment was executed on the mixture to provide 20% alumina hydrate dispersion liquid. Alumina hydrate particulates in the alumina hydrate dispersion liquid had an average particle size of 140 nm.

[Preparation of a Water Solution of Polyvinyl Alcohol 1]

Besides the alumina hydrate dispersion liquid, polyvinyl alcohol (trade name: "PVA235"; manufactured by KURARAY CO., LTD.) was dissolved into ion exchange water to prepare a water solution of polyvinyl alcohol with a solid content of 8%. The polyvinyl alcohol had an average degree of polymerization of 3,500 and a degree of saponification of 87 to 89 mol %.

Polyvinyl alcohol (trade name "PVA123", manufactured by KURARAY CO., LTD.) was dissolved into ion exchange water to prepare a water solution of polyvinyl alcohol 2 with a solid content of 8%. The polyvinyl alcohol had an average degree of polymerization of 2,300 and a degree of saponification of 98 to 99 mol %.

[Synthesis of a Coating Liquid for Protective-Layer Formation]

Nine pts·wt. water solution of acrylic resin (JONCRYL 352D manufactured by BASF, Tg: 56° C., solid content concentration: 45%), 1 pts·wt. water solution of urethane resin (SUPERFLEX 130 manufactured by DKS Co., Ltd., Tg: 103° C., solid content concentration: 35%), and 0.5 pts·wt. water solution of polyvinyl alcohol were added together. The resultant solution was stirred and mixed for five minutes to prepare a coating liquid for protective layer formation.

[Preparation of a Coating Liquid for Ink Receiving Layer Formation 1]

Twenty-seven point eight pts·wt. water solution of polyvinyl alcohol was added to 100 pts·wt. water solution of polyvinyl alcohol, and 3.0 pts·wt. polyallylamine was added to the resultant solution as a cationic resin. The solutions were then mixed together using a static mixer to prepare a coating liquid for ink receiving layer formation 1. The polyallylamine used was polyallylamine with a weight-average degree of polymerization of 1,600 (trade name "PAA-01" manufactured by Nitto Boseki Co., Ltd.).

[Preparation of a Coating Liquid for Ink Receiving Layer Formation 2]

Three point zero pts·wt. polyallylamine was added to NS-625XC manufactured by TAKAMATSU FAT & OIL CO., LTD. as a cationic resin, and the solutions were mixed together using the static mixer to prepare a swelling coating liquid for ink receiving layer formation 2. The polyallylamine used was polyallylamine with a weight-average degree of polymerization of 1,600 (trade name "PAA-01" manufactured by Nitto Boseki Co., Ltd.).

[Preparation of a Water Solution of an Adhesive]

Ten pts·wt. Ion exchange water was added to 5 pts·wt. Bondic 1940NE (average particle size: 0.62 μm) manufactured by DIC to prepare a water solution of an adhesive.

[Preparation of a Substrate 1]

Figure 18:
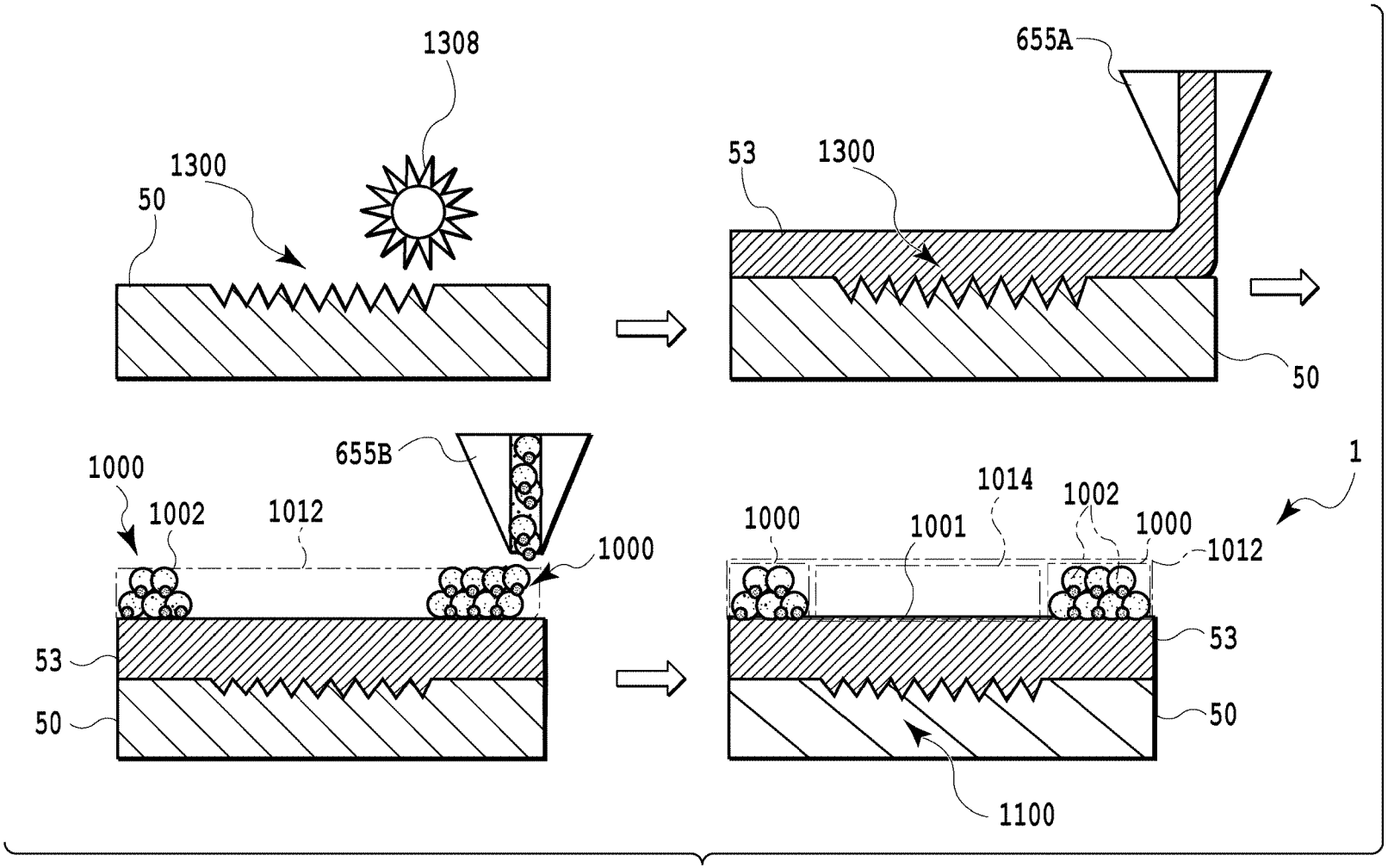
FIG. 18 is a diagram illustrating an example of a manufacturing process for the transfer material.

A three-dimensional image formation apparatus 1308 depicted in FIG. 18 was used to machine the front surface of a PET substrate (trade name "Tetoron G2"; thickness: 19 μm; manufactured by Teijin Dupont Films Japan Limited) so as to form recesses and protrusions thereon, thus preparing a substrate 1 with a three-dimensional image. The three-dimensional image was formed all over the substrate. Each of the recesses and protrusions of the three-dimensional image had a width of 30 μm and a height of 3 μm. The width of each of the recesses and protrusions of the three-dimensional image was measured by observing a cross section of the substrate 1 using an SEM. The height of each of the recesses and protrusions of the three-dimensional image was measured by a method compliant with a standard (international standard ISO 25178) specifying an evaluation method for surface roughness.

[Preparation of a Substrate 2]

A substrate 2 with a three-dimensional image was prepared similarly to the substrate 1 except that, unlike the recesses and protrusions of the three-dimensional image on the substrate 1, the recesses and protrusions of the three-dimensional image on the substrate 2 each had a height of 10 μm.

[Preparation of a Substrate 3]

A substrate 3 with a three-dimensional image was prepared similarly to the substrate 1 except that, unlike the recesses and protrusions of the three-dimensional image on the substrate 1, the recesses and protrusions of the three-dimensional image on the substrate 3 each had a height of 0.5 μm.

[Preparation of a Substrate 4]

A substrate 4 with a three-dimensional image was prepared similarly to the substrate 1 except that, unlike the recesses and protrusions of the three-dimensional image on the substrate 1, the recesses and protrusions of the three-dimensional image on the substrate 4 each had a height of 13.0 μm.

[Preparation of a Substrate 5]

A substrate 5 with a three-dimensional image was prepared similarly to the substrate 1 except that, unlike the recesses and protrusions of the three-dimensional image on the substrate 1, the recesses and protrusions of the three-dimensional image on the substrate 5 each had a height of 0.4 μm.

[Preparation of a Substrate 6]

A substrate 6 with a three-dimensional image was prepared similarly to the substrate 1 except that, unlike the recesses and protrusions of the three-dimensional image on the substrate 1, the recesses and protrusions of the three-dimensional image on the substrate 6 each had a width of 100.0 μm.

[Preparation of a Substrate 7]

A substrate 7 with a three-dimensional image was prepared similarly to the substrate 1 except that, unlike the recesses and protrusions of the three-dimensional image on the substrate 1, the recesses and protrusions of the three-dimensional image on the substrate 7 each had a width of 0.5 μm.

[Preparation of a Substrate 8]

A substrate 8 with a three-dimensional image was prepared similarly to the substrate 1 except that, unlike the recesses and protrusions of the three-dimensional image on the substrate 1, the recesses and protrusions of the three-dimensional image on the substrate 8 each had a width of 150 μm.

[Preparation of a Substrate 9]

A substrate 9 with a three-dimensional image was prepared similarly to the substrate 1 except that, unlike the recesses and protrusions of the three-dimensional image on the substrate 1, the recesses and protrusions of the three-dimensional image on the substrate 9 each had a width of 0.4 μm.

[Preparation of a Substrate 10]

A substrate 10 with a three-dimensional image was prepared similarly to the substrate 1 except that, unlike the recesses and protrusions of the three-dimensional image on the substrate 1, the recesses and protrusions of the three-dimensional image on the substrate 10 each had a height of 10.0 μm and a width of 30.0 μm.

[Preparation of a Substrate 11]

A protective layer was formed on a PET substrate (trade name "Tetoron G2"; manufactured by Teijin Dupont Films Japan Limited) by coating the front surface (thickness: 19 μm) of the PET substrate with the coating liquid for protective-layer formation and then drying the coating liquid. A die coater was used for the coating, a coating speed was 5 m/min., and the amount of resin applied as measured after drying was 5 g/m$^2$. A drying temperature was 90 deg. Then, the three-dimensional image formation apparatus 1308 depicted in FIG. 18 was used to machine the front surface of the transparent protective layer on the PET substrate so as to form recesses and protrusions thereon, thus preparing a substrate 11 with a three-dimensional image. Each of the recesses and protrusions of the three-dimensional image had a width of 30 μm and a height of 3 μm. The width of each of the recesses and protrusions of the three-dimensional image was measured by observing a cross section of the substrate 11 using the SEM. The height of each of the recesses and protrusions of the three-dimensional image was measured by the method compliant with the standard (international standard ISO 25178) specifying the evaluation method for surface roughness.

[Manufacture of the Transfer Material 1]

A laminate sheet 1 including the substrate and the ink receiving layer and used as a constituent material for the transfer material was manufactured by coating the front surface of the substrate 1 with the coating liquid 1 for ink receiving layer formation and then drying the coating liquid 1. The die coater was used for the coating, the coating speed was 5 m/min., and the amount of resin applied as measured after drying was 15 g/m$^2$. The drying temperature was 60 deg. The ink receiving layer had a thickness of 15 μm.

The transfer material 1 was manufactured by coating the front surface of the ink receiving layer in the laminate sheet 1 with a water solution of the adhesive and drying the water solution so as to form, on the front surface of the ink receiving layer, a bonding layer with discretely disposed aggregates of pieces of the adhesive so that externally exposed portions remain on the front surface of the ink receiving layer. A gravure coater was used to apply the coating liquid, and the coating speed was 5 m/min. The drying temperature was 60 deg. The number of groove lines in a gravure roll was 200. The transfer material 1 was rolled with the ink receiving layer facing outward and the substrate facing inward, and a rolled transfer material was obtained. The island-like portions of the bonding layer each had a thickness of 1.24 μm.

With a cross section of the transfer material 1 observed with the SEM, the diameter of a part of the ink receiving layer contacted by particles of the adhesive was measured. At that time, the average value of the diameters of 10 particles of the adhesive was calculated, and based on the average value, the area of a part of the ink receiving layer contacted by one particle of the adhesive was calculated. Then, based on an SEM projection of the print surface, the number of particles of the adhesive contacting the ink receiving layer was calculated, and the total area of a part B of the ink receiving layer contacted by the adhesive was determined. The total area of the part B was subtracted from the area of a measurement range to determine the area of a part of the front surface of the ink receiving layer that included no adhesive, in other words, the area of the exposed portions of the ink receiving layer (exposed portion area). Furthermore, based on an SEM projection of the print surface side, the area of the bonding portions as directly viewed from the print surface side (bonding portion area) was checked. As a result, the contact area of the part of the ink receiving layer contacted by the adhesive was smaller than the bonding portion area, and the exposed portion area was 75% of the total area of the ink receiving layer.

[Manufacture of a Transfer Material 2]

A transfer material 2 was obtained similarly to the transfer material 1 except that a substrate 2 was provided instead of the substrate 1 of the transfer material 1.

[Manufacture of a Transfer Material 3]

A transfer material 3 was obtained similarly to the transfer material 1 except that a substrate 3 was provided instead of the substrate 1 of the transfer material 1.

[Manufacture of a Transfer Material 4]

A transfer material 4 was obtained similarly to the transfer material 1 except that a substrate 4 was provided instead of the substrate 1 of the transfer material 1.

[Manufacture of a Transfer Material 5]

A transfer material 5 was obtained similarly to the transfer material 1 except that a substrate 5 was provided instead of the substrate 1 of the transfer material 1.

[Manufacture of a Transfer Material 6]

A transfer material 6 was obtained similarly to the transfer material 1 except that a substrate 6 was provided instead of the substrate 1 of the transfer material 1.

[Manufacture of a Transfer Material 7]

A transfer material 7 was obtained similarly to the transfer material 1 except that a substrate 7 was provided instead of the substrate 1 of the transfer material 1.

[Manufacture of a Transfer Material 8]

A transfer material 8 was obtained similarly to the transfer material 1 except that a substrate 8 was provided instead of the substrate 1 of the transfer material 1.

[Manufacture of a Transfer Material 9]

A transfer material 9 was obtained similarly to the transfer material 1 except that a substrate 9 was provided instead of the substrate 1 of the transfer material 1.

[Manufacture of a Transfer Material 10]

A transfer material 10 was obtained similarly to the transfer material 1 except that a substrate 10 was provided instead of the substrate 1 of the transfer material 1.

[Manufacture of a Transfer Material 11]

A laminate sheet 2 used as a constituent material for the transfer material and including the substrate, the protective layer, and the ink receiving layer was manufactured by coating the front surface of the protective layer in the substrate with the coating liquid 1 and then drying the coating liquid 1. The die coater was used for the coating, the coating speed was 5 m/min., and the amount of resin applied as measured after drying was 15 g/m$^2$. The drying temperature was 100 deg. The ink receiving layer had a thickness of 15 μm. Then, a transfer material 11 was manufactured by coating the front surface of the ink receiving layer in the laminate sheet 2 with a water solution of the adhesive and drying the water solution so as to form, on the front surface of the ink receiving layer, a bonding layer with discretely disposed aggregates of pieces of the adhesive so that externally exposed portions remain on the front surface of the ink receiving layer. The gravure coater was used to apply the coating liquid, and the coating speed was 5 m/min. The drying temperature was 60 deg. The number of groove lines in a gravure roll was 200. The transfer material 11 was rolled with the ink receiving layer facing outward and the substrate facing inward, and a rolled transfer material was obtained. The island-like portions of the bonding layer each had a thickness of 1.24 μm.

[Manufacture of a Transfer Material 12]

A laminate sheet 3 used as a constituent material for the transfer material and including the substrate and the ink receiving layer was manufactured by coating the front surface (thickness: 19 μm) of the PET substrate (trade name "Tetoron G2"; manufactured by Teijin Dupont Films Japan Limited) with the coating liquid for ink receiving layer formation 1 and then drying the coating liquid. The die coater was used for the coating, the coating speed was 5 m/min., and the amount of resin applied as measured after drying was 15 g/m$^2$. The drying temperature was 60 deg. The ink receiving layer had a thickness of 15 μm.

A transfer material 12 was manufactured by coating the front surface of the ink receiving layer in the laminate sheet 3 with a water solution of the adhesive and drying the water solution so as to form, on the front surface of the ink receiving layer, a bonding layer with discretely disposed aggregates of pieces of the adhesive so that externally exposed portions remain on the front surface of the ink receiving layer. The gravure coater was used to apply the coating liquid, and the coating speed was 5 m/min. The drying temperature was 60 deg. The number of groove lines in a gravure roll was 200. The transfer material 12 was rolled with the ink receiving layer facing outward and the substrate facing inward, and a rolled transfer material was obtained. The island-like portions of the bonding layer each had a thickness of 1.24 μm.

As is the case with the transfer material 1, with a cross section of the transfer material 12 observed with the SEM, a check was performed on the area of the exposed portions of the ink receiving layer (exposed portion area) and the area of the bonding portions as directly viewed from the print surface side (bonding portion area). As a result, the contact area of the part of the ink receiving layer contacted by the adhesive was smaller than the bonding portion area, and the exposed portion area was 75% of the total area of the ink receiving layer.

[Manufacture of a Transfer Material 13]

A laminate sheet 4 used as a constituent material for the transfer material and including the substrate and the ink receiving layer was manufactured by coating the front surface of the substrate 1 with the coating liquid for ink receiving layer formation 2 and then drying the coating liquid 2. The die coater was used for the coating, the coating speed was 5 m/min., and the amount of resin applied as measured after drying was 15 g/m$^2$. The drying temperature was 60 deg. The ink receiving layer had a thickness of 15 μm.

A transfer material 13 was manufactured by coating the front surface of the ink receiving layer in the laminate sheet 4 with a water solution of the adhesive and drying the water solution so as to form, on the front surface of the ink receiving layer, a bonding layer with discretely disposed aggregates of pieces of the adhesive so that externally exposed portions remain on the front surface of the ink receiving layer. The gravure coater was used to apply the coating liquid, and the coating speed was 5 m/min. The drying temperature was 60° C. The number of groove lines in a gravure roll was 200. The transfer material 13 was rolled with the ink receiving layer facing outward and the substrate facing inward, and a rolled transfer material was obtained. The island-like portions of the bonding layer each had a thickness of 1.24 μm.

As is the case with the transfer material 1, with a cross section of the transfer material 13 observed with the SEM, a check was performed on the area of the exposed portions of the ink receiving layer (exposed portion area) and the area of the bonding portions as directly viewed from the print surface side (bonding portion area). As a result, the contact area of the part of the ink receiving layer contacted by the adhesive was smaller than the bonding portion area, and the exposed portion area was 75% of the total area of the ink receiving layer.

Example 1

An image (first image) was printed on the transfer material 1 with the resin dispersing pigment ink using the above-described first manufacturing apparatus. Subsequently, the transfer material 1 was thermocompression bonded to the image support, and then, the PET substrate was peeled off to provide a printed material with the three-dimensional image on the front surface of the ink receiving layer. Then, an image (second image) was printed on the front surface of the ink receiving layer with the three-dimensional image using the resin dispersing pigment ink to provide a printed material 1 in Example 1. A preparation method for the resin dispersing pigment ink will be described below.

As a printing unit of the manufacturing apparatus that prints the first image and the second image, a pigment ink jet printer equipped with a serial head (trade name: "PIXUS PRO-1"; manufactured by Canon Inc.) was used. The resin dispersing pigment ink was installed in the printer, and a 100% solid image with a print duty of 100% was printed in a plain paper mode (ejection volume: 4 pl; resolution: 1200 dpi; single color printing). As the image support, a card formed of PET (trade name: "PET CARD"; manufactured by Goudou Giken) was used. Conditions for the thermocompression bonding were a temperature of 160 deg, a pressure of 3.9 Kg/cm, and a conveying speed of 50 mm/sec.

[Preparation of the Pigment Ink]

<Synthesis of a (Meth)Acrylic Acid Ester-Based Copolymer>

One thousand pts·wt. methyl ethyl ketone was fed into a reaction container equipped with a stirrer, a dripper, a temperature sensor, and a reflux apparatus having a nitrogen feeder at the top thereof. With the methyl ethyl ketone stirred, the content of the reaction container was substituted with nitrogen. With the inside of the reaction container maintained in a nitrogen atmosphere, the temperature in the reaction container was raised to 80° C. A mixed solution was dripped over four hours using the dripper, the mixed solution being a mixture of 63 pts·wt. methacrylate 2-hydroxyethyl, 141 pts·wt. methacrylic acid, 417 pts·wt. styrene, 188 pts·wt. benzyl methacrylate, 25 pts·wt. glycidyl methacrylate, 33 pts·wt. polymerization modifier (trade name "BLEMMER TGL" manufactured by NOF Corporation), and 67 pts·wt. peroxy-2-ethylhexanoic acid-t-butyl. When the dripping ended, the reaction was allowed to last at the same temperature for 10 hours to prepare a solution of an ester (meth) acrylate copolymer (A-1) (resin content: 45.4%) having an acid value of 110 mgKOH/g, a glass transition temperature (Tg) 89° C., and a weight average molecular weight of 8,000.

<Preparation of an Aqueous Pigment Dispersion Element>

One thousand pts·wt. phthalocyanine-based blue pigment, the solution of the ester (meth)acrylate copolymer (A-1) obtained by the above-described synthesis, 25% water solution of potassium hydroxide, and water were fed into a mixing tank with a cooling function and stirred and mixed to prepare a mixed solution. The amount of the ester (meth)acrylate copolymer (A-1) was 40% of the amount of the phthalocyanine-based blue pigment in nonvolatile content. The amount of the 25% water solution of potassium hydroxide was such that the ester (meth)acrylate copolymer (A-1) was neutralized 100%. The amount of the water was such that the nonvolatile content of the resultant mixed solution was 27%. The resultant mixed solution was passed through a disperser filled with zirconia beads with a diameter of 0.3 mm so as to disperse for four hours in accordance with a circulation method. The temperature of a dispersion liquid was maintained at 40° C. or lower.

After the dispersion liquid was extracted from the mixing tank, a channel between the mixing tank and the disperser was cleaned with 10,000 pts·wt. water, and a cleaning solution and the dispersion liquid were mixed to prepare a diluted dispersion liquid. The resultant diluted dispersion liquid was placed in a distillator, and a total amount of the methyl ethyl ketone and a portion of the water were distilled away to provide a concentrated dispersion liquid. The concentrated dispersion liquid was allowed to cool down to room temperature, and with the concentrated dispersion liquid being stirred, 2% chlorine acid was dropped into the liquid. When the pH of the concentrated dispersion liquid was adjusted to 4.5, a Buchner funnel was used to filter solids. The solids were then washed in water. The resultant solids (cake) were placed in the container, water was added to the solids, and a dispersing stirrer was used to re-disperse the solids. The pH of the solids was adjusted to 9.5 using a 25% water solution of potassium hydroxide. Subsequently, a centrifugal separator was used to remove coarse particles at 6,000 G over 30 minutes. The nonvolatile contents were then regulated to provide an aqueous cyan pigment dispersion element (pigment content: 14%, acid value: 110).

An aqueous black pigment dispersion element, an aqueous magenta pigment dispersion element, or an aqueous yellow pigment dispersion element were obtained as is the case with the aqueous cyan pigment dispersion element except that the phthalocyanine-based blue pigment was changed to a carbon black-based black pigment, a quinacridone-based magenta pigment, or a diazo-based yellow pigment.

<Preparation of the Ink>

The aqueous pigment dispersion element and the appropriate components were fed into a container so as to provide a composition illustrated below in Table 1 (total: 100 pts·wt.), and the mixture was stirred for 30 minutes or longer using a propeller stirrer. Subsequently, the mixture was filtered using a filter with a pore size of 0.2 μm (manufactured by NIHON PALL LTD.) to prepare a pigment ink. "AE-100" in Table 1 indicates acetylene glycol 10 mol ethylene oxide additive (trade name: "ACETYLENOL E100"; manufactured by Kawaken Fine Chemicals Co., Ltd.)

TABLE 1

| | Bk | C | M | Y |
|---|---|---|---|---|
| acid value (mgkOH) | 110 | 110 | 110 | 110 |
| pigment (pts. wt.) | 5.0 | 5.0 | 5.0 | 5.0 |
| glycerin (pts. wt.) | 7 | 7 | 7 | 7 |
| triethylene glycol (pts. wt.) | 5 | 5 | 5 | 5 |
| ethylene urine (pts. wt.) | 12 | 12 | 12 | 12 |
| AE-100 (pts. wt.) | 0.5 | 0.5 | 0.5 | 0.5 |
| pure water (pts. wt.) | remaining parts | remaining parts | remaining parts | remaining parts |

Example 2

A dye ink (trade name: "BC-341XL"; manufactured by Canon Inc.) was used instead of the resin dispersing pigment ink, and a 100% solid image with a print duty of 100% was printed with a magenta ink under conditions including a resolution of 1200 dpi and an ink ejection volume of 4 pl. A printed material 2 in Example 2 was obtained as is otherwise the case with Example 1.

In the transfer materials and the printed materials in Examples 1 and 2, the ink receiving layer of the air gap absorption type has the three-dimensional image and thus allows high security to be achieved. Furthermore, the inorganic particulates forming the ink receiving layer have the optimal average particle size and the optimal pore size, and thus, in Example 1 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In a case where the second image is formed, the pigment color material of the pigment ink is fixed in the recessed portions of the three-dimensional image, leading to high scratch resistance. On the other hand, in Example 2 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 3

A printed material 3 in Example 3 was obtained as is the case with Example 1 except a transfer material 2 was provided instead of the transfer material 1 in Example 1.

Example 4

A printed material 4 in Example 4 was obtained as is the case with Example 2 except that the transfer material 2 was provided instead of the transfer material 1 in Example 2.

Compared to the transfer material 1, the transfer materials and the printed materials in Examples 3 and 4 involve thick three-dimensional images but enable the three-dimensional images to be made highly visible, allowing high security to be achieved. Furthermore, the inorganic particulates forming the ink receiving layer have the optimal average particle size and the optimal pore size, and thus, in Example 3 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In a case where the second image is formed, the pigment color material of the pigment ink is fixed in the recessed portions of the three-dimensional image, leading to high scratch resistance. On the other hand, in Example 4 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 5

A printed material 5 in Example 5 was obtained as is the case with Example 1 except a transfer material 3 was provided instead of the transfer material 1 in Example 1.

Example 6

A printed material 6 in Example 6 was obtained as is the case with Example 2 except the transfer material 3 was provided instead of the transfer material 1 in Example 2.

Compared to the transfer material 1, the transfer materials and the printed materials in Examples 5 and 6 involve thin three-dimensional images but enable the three-dimensional images to be made highly visible, allowing high security to be achieved. Furthermore, the inorganic particulates forming the ink receiving layer have the optimal average particle size and the optimal pore size, and thus, in Example 5 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In a case where the second image is formed, the pigment color material of the pigment ink is fixed in the recessed portions of the three-dimensional image, leading to high scratch resistance. On the other hand, in Example 6 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 7

A printed material 7 in Example 7 was obtained as is the case with Example 1 except a transfer material 4 was provided instead of the transfer material 1 in Example 1.

Example 8

A printed material 8 in Example 8 was obtained as is the case with Example 2 except the transfer material 4 was provided instead of the transfer material 1 in Example 2.

Compared to the transfer material 1, the transfer materials and the printed materials in Examples 7 and 8 involve high three-dimensional images, which are highly visible, allowing high security to be achieved. However, the large height of the three-dimensional image results in a local variation in the thickness of the ink receiving layer corresponding to a significant difference in ink absorption capacity between the thick and thin parts of the ink receiving layer. The thin parts of the ink receiving layer each have only a small ink absorption capacity. An amount of the ink having failed to be absorbed into the thin part flows toward the thick part, where the ink is absorbed. Thus, image bleeding may occur in the thin part. Moreover, the image density may vary between the thick and thin parts of the ink receiving layer, leading to slight degradation of the print characteristics. In a case where the second image is formed, the pigment color material of the pigment ink is fixed in the recessed portions of the three-dimensional image, leading to high scratch resistance.

On the other hand, also in Example 8 using the dye ink, the ink absorption capacity varies between the thick and thin parts of the ink receiving layer in a case where the first image is formed. Thus, the thin parts of the ink receiving layer each have only a small ink absorption capacity. An amount of the ink having failed to be absorbed into the thin part flows toward the thick part, where the ink is absorbed. Thus, image bleeding may occur in the thin part. Moreover, the image density may vary between the thick and thin parts of the ink receiving layer, leading to slight degradation of the print characteristics. Furthermore, the second image offers high scratch resistance but is slightly inferior in water resistance, migration resistance, and image storage stability.

Example 9

A printed material 9 in Example 9 was obtained as is the case with Example 1 except a transfer material 5 was provided instead of the transfer material 1 in Example 1.

Example 10

A printed material 10 in Example 10 was obtained as is the case with Example 2 except the transfer material 5 was provided instead of the transfer material 1 in Example 2.

Compared to the transfer material 1, the transfer materials and the printed materials in Examples 9 and 10 involve thin three-dimensional images, and thus, the images have reduced visibility and deliver slightly inferior security performance. In Example 9 using the pigment ink, in a case where the first image is formed, the color material of the pigment ink does not permeate the inside of the ink receiving layer. Thus, the area factor is unlikely to be 100%, and the image exhibits slightly inferior print characteristics. However, this poses no problem in practice, and the image exhibits high storage stability. However, the reduced thickness of the three-dimensional image decreases the amount of the pigment ink fixed in the recessed portions of the three-dimensional image, while causing the pigment ink to be also fixed to the protruding portions of the three-dimensional image, in a case where the second image is formed. Thus, the image offers slightly low scratch resistance. In Example 10 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 11

A printed material 11 in Example 11 was obtained as is the case with Example 1 except a transfer material 6 was provided instead of the transfer material 1 in Example 1.

Example 12

A printed material 12 in Example 12 was obtained as is the case with Example 2 except the transfer material 6 was provided instead of the transfer material 1 in Example 2.

Compared to the transfer material 1, the transfer materials and the printed materials in Examples 11 and 12 involve wide three-dimensional images but enable the three-dimensional images to be made highly visible, allowing high security to be achieved. Furthermore, the inorganic particulates forming the ink receiving layer have the optimal average particle size and the optimal pore size. Thus, in Example 11 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In a case where the second image is formed, the pigment color material of the pigment ink is fixed in the recessed portions of the three-dimensional image, leading to high scratch resistance. In Example 12 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 13

A printed material 13 in Example 13 was obtained as is the case with Example 1 except a transfer material 7 was provided instead of the transfer material 1 in Example 1.

Example 14

A printed material 14 in Example 14 was obtained as is the case with Example 2 except the transfer material 7 was provided instead of the transfer material 1 in Example 2.

Compared to the transfer material 1, the transfer materials and the printed materials in Examples 13 and 14 involve narrow three-dimensional images but enable the three-dimensional images to be made highly visible, allowing high security to be achieved. Furthermore, the inorganic particulates forming the ink receiving layer have the optimal average particle size and the optimal pore size, and thus, in Example 13 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In a case where the second image is formed, the pigment color material of the pigment ink is fixed in the recessed portions of the three-dimensional image, leading to high scratch resistance. On the other hand, in Example 14 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 15

A printed material 15 in Example 15 was obtained as is the case with Example 1 except a transfer material 8 was provided instead of the transfer material 1 in Example 1.

Example 16

A printed material 16 in Example 16 was obtained as is the case with Example 2 except the transfer material 8 was provided instead of the transfer material 1 in Example 2.

Compared to the transfer material 1, the transfer materials and the printed materials in Examples 15 and 16 involve wide three-dimensional images, which are highly visible, allowing high security to be achieved. However, in Example 15 using the pigment ink, the three-dimensional image is wide, and thus, in a case where the print surface of the second image is scratched by the finger, fibers, or the like, the finger, the fibers, or the like may enter the recessed portions of the three-dimensional image. The three-dimensional image in this case exhibits slightly low scratch resistance. Additionally, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In Example 16 using the dye ink, in a case where the first image is formed, the dye ink permeates the inside of the ink receiving layer while spreading therein substantially isotropically. Thus, the area factor is likely to be 100% and the image exhibits excellent print characteristics. The second image offers high scratch resistance but is slightly inferior in water resistance, migration resistance, and image storage stability.

Example 17

A printed material 17 in Example 17 was obtained as is the case with Example 1 except a transfer material 9 was provided instead of the transfer material 1 in Example 1.

Example 18

A printed material 18 in Example 18 was obtained as is the case with Example 2 except the transfer material 9 was provided instead of the transfer material 1 in Example 2.

Compared to the transfer material 1, the transfer materials and the printed materials in Examples 17 and 18 involve narrow three-dimensional images, which exhibit only low visibility and slightly inferior security performance. In Example 17 using the pigment ink, the three-dimensional image is narrow, hindering the pigment color material from being housed in the recessed portions of the three-dimensional image, with the pigment ink also fixed to the protruding portions of the three-dimensional image. Thus, the three-dimensional image in this case exhibits slightly low scratch resistance. Additionally, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. In Example 18 using the dye ink, the dye ink permeates the inside of the ink receiving layer while spreading therein substantially isotropically. Thus, in a where the first image is formed, the area factor is likely to be 100% and the image exhibits excellent print characteristics. Furthermore, the second image offers high scratch resistance but is slightly inferior in water resistance, migration resistance, and image storage stability.

Example 19

A printed material 19 in Example 19 was obtained as is the case with Example 1 except a transfer material 10 was provided instead of the transfer material 1 in Example 1.

Example 20

A printed material 20 in Example 20 was obtained as is the case with Example 2 except the transfer material 10 was provided instead of the transfer material 1 in Example 2.

In the transfer materials in Examples 19 and 20, as depicted in FIG. 17, the ink receiving layer 53 is thinner than the three-dimensional image 1300, and thus, many pieces of the adhesive 1002 included in the bonding layer 1012 are present in the recessed portions of the three-dimensional image 1300. The recessed portions where many pieces of the adhesive are present absorb the ink slowly. In a case where the first image is formed, the ink is likely to be retained in the recessed portions, leading to slightly inferior print characteristics. In a case where the second image is formed, the pigment color material of the pigment ink is fixed in the recessed portions of the three-dimensional image, leading to high scratch resistance. On the other hand, in Example 20 using the dye ink, the second image offers high scratch resistance but is slightly inferior in water resistance, migration resistance, and image storage stability.

Example 21

A printed material 21 in Example 21 was obtained as is the case with Example 1 except a transfer material 11 was provided instead of the transfer material 1 in Example 1.

On the printed material 21, a first image was printed with the resin dispersing pigment ink using the above-described manufacturing apparatus. Subsequently, the transfer material 11 was thermocompression bonded to the image support, and then, only the PET substrate was peeled off. Consequently, the printed material 21 was obtained in which the front surface of the ink receiving layer was provided with the three-dimensional image and covered with the protective layer. The uppermost surface of the printed material 21 corresponds to the protective layer, and thus, no second image was printed. As a printing unit of the manufacturing apparatus that prints the first image, the pigment ink jet printer equipped with the serial head (trade name: "PIXUS PRO-1"; manufactured by Canon Inc.) was used. The resin dispersing pigment ink was installed in the printer, and a 100% solid image with a print duty of 100% was printed in the plain paper mode (ejection volume: 4 pl; resolution: 1200 dpi; single color printing). As the image support, the card formed of PET (trade name: "PET CARD"; manufactured by Goudou Giken) was used. The conditions for the thermocompression bonding were a temperature of 160 deg, a pressure of 3.9 Kg/cm, and a conveying speed of 50 mm/sec.

Example 22

The dye ink (trade name: BC-341XL; manufactured by Canon Inc.) was used instead of the resin dispersing pigment ink in Example 21, and a 100% solid image with a print duty of 100% was printed with a magenta ink under conditions including a resolution of 1200 dpi and an ink ejection volume of 4 pl. A printed material 22 in Example 22 was obtained as is otherwise the case with Example 21.

The transfer materials in Examples 21 and 22 are configured so that a part of the substrate is peeled off. After thermocompression bonding of the transfer material, the PET substrate, serving as the conveyance layer, was peeled off, and the protective layer was laminated onto the print surface of the ink receiving layer. The transfer material and the printed material exhibit high security because the ink receiving layer of the air gap absorption type has the three-dimensional image. Furthermore, the inorganic particulates forming the ink receiving layer have the optimal average particle size and the optimal pore size. Thus, in Example 21 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. The uppermost surface of the printed material 21 corresponds to the protective layer, and thus, the printed material 21 offers particularly high scratch resistance.

In Example 22 using the dye ink, in a case where the first image is formed, the dye ink permeates the inside of the ink receiving layer while spreading therein substantially isotropically. Thus, the area factor is likely to be 100% and the image exhibits excellent print characteristics. The uppermost surface of the printed material 22 corresponds to the protective layer, and thus, the printed material 22 offers particularly high scratch resistance. However, the printed material 22 is slightly inferior in water resistance, migration resistance, and image storage stability.

Example 23

In Example 23, a first image was printed on the print surface of the transfer material 1 with the resin dispersing pigment ink using the above-described manufacturing apparatus. Subsequently, the transfer material 1 was thermocompression bonded to the image support, and the PET was not peeled off. Consequently, a printed material 23 was obtained in which the front surface of the ink receiving layer was provided with the three-dimensional image and covered with the PET substrate. The uppermost surface of the printed material 23 corresponds to the PET substrate, and thus, no second image was printed. As a printing unit of the manufacturing apparatus that prints the first image, the pigment ink jet printer equipped with the serial head (trade name: "PIXUS PRO-1"; manufactured by Canon Inc.) was used. The resin dispersing pigment ink was installed in the printer, and a 100% solid image with a print duty of 100% was printed in the plain paper mode (ejection volume: 4 pl; resolution: 1200 dpi; single color printing). As the image support, the card formed of PET (trade name: "PET CARD"; manufactured by Goudou Giken) was used. The conditions for the thermocompression bonding were a temperature of 160 deg, a pressure of 3.9 Kg/cm, and a conveying speed of 50 mm/sec.

Example 24

The dye ink (trade name: BC-341XL; manufactured by Canon Inc.) was used instead of the resin dispersing pigment ink in Example 23, and a 100% solid image with a print duty of 100% was printed with a magenta ink under conditions including a resolution of 1200 dpi and an ink ejection volume of 4 pl. A printed material 24 in Example 24 was obtained as is otherwise the case with Example 23.

In Examples 23 and 24, after thermocompression bonding of the transfer material, the PET substrate, serving as the conveyance layer, is not peeled off. Thus, the PET substrate is laminated on the ink receiving layer of the printed material. The transfer material and the printed material exhibit high security because the ink receiving layer of the air gap absorption type has the three-dimensional image. Furthermore, the inorganic particulates forming the ink receiving layer have the optimal average particle size and the optimal pore size, and thus, in Example 23 using the pigment ink, in a case where the first image is formed, the pigment color material does not permeate the inside of the ink receiving layer. Thus, the area factor is unlikely to be 100%, and the image exhibits slightly inferior print characteristics. However, this poses no problem in practice, and the image exhibits high storage stability. The uppermost surface of the printed material 23 corresponds to the substrate layer, and thus, the printed material 23 offers particularly high scratch resistance.

In Example 24 using the dye ink, the dye ink permeates the inside of the ink receiving layer while spreading therein substantially isotropically in a case where the first image is formed. Thus, the area factor is likely to be 100% and the image exhibits excellent print characteristics. The uppermost surface of the printed material 24 corresponds to the protective layer, and thus, the printed material 24 offers particularly high scratch resistance. However, the printed material 24 is slightly inferior in water resistance, migration resistance, and image storage stability.

Comparative Example 1

A printed material 25 in Comparative Example 1 was obtained as is the case with Example 1 except that a transfer material 12 was provided instead of the transfer material 1 in Example 1.

Comparative Example 2

A printed material 26 in Comparative Example 1 was obtained as is the case with Example 1 except that the transfer material 12 was provided instead of the transfer material 1 in Example 2.

In Comparative Examples 1 and 2, the substrate of the transfer material is smooth, and thus, the ink receiving layer of the air gap absorption type is smooth and has no three-dimensional image. In Comparative Example 1 using the pigment ink, in a case where the second image was formed, the pigment color material remained on the front surface of the ink receiving layer, resulting in reduced scratch resistance.

Comparative Example 3

A printed material 27 in Comparative Example 3 was obtained as is the case with Example 1 except that a transfer material 13 was provided instead of the transfer material 1 in Example 1.

Comparative Example 4

A printed material 28 in Comparative Example 4 was obtained as is the case with Example 1 except that the transfer material 13 was provided instead of the transfer material 1 in Example 2.

In Comparative Examples 3 and 4, the transfer material exhibited only low bonding capability and failed to be transferred to the image support. Thus, no printed material was successfully produced, precluding the image storage stability from being evaluated.

<Evaluation>

(Visibility)

The visibility of the three-dimensional image (the image based on the three-dimensional micro-structure) was evaluated using the transfer materials in the above-described examples and comparative examples. For evaluation of the visibility, a three-dimensional image was visually checked. The results of the evaluation are represented below in Tables 2 to 5.

○: 90% or more of the three-dimensional image is visible. Δ: 50% or more and less than 90% of the three-dimensional image is visible.

x: less than 50% of the three-dimensional image is visible.

(Image Characteristics)

The print characteristics (image characteristics) of the image were evaluated using the transfer materials in the above-described examples and comparative examples. For the image characteristics, the ink absorptivity and the degree of blown-out highlights (image density) were comprehensively evaluated. The evaluation results for the ink absorptivity and the degree of blown-out highlights (image density) are represented in Tables 2 to 5.

(Ink Absorptivity)

For the transfer materials in the above-described examples and comparative examples, the ink absorptivity was evaluated. Specifically, one second after printing of an image on the transfer material, paper was laid on top of the image print surface. Then, transfer, to the paper, of unabsorbed ink not absorbed yet by the transfer material was visually checked. The ink absorptivity was evaluated based on the following criteria.

⊙: less than 5% of the unabsorbed ink was transferred to the paper.

○: 5% or more and less than 10% of the unabsorbed ink was transferred to the paper.

Δ: 10% or more and less than 20% of the unabsorbed ink was transferred to the paper.

x: 20% or more of the unabsorbed ink was transferred to the paper.

(Degree of Blown-Out Highlights (Image Density))

The degree of blown-out highlights in the image was evaluated using the transfer materials in the above-described examples and comparative examples. Specifically, a solid image was printed on the print surface of the transfer material, and then, a part of the print surface where the solid image was printed was observed with a microscope from a side opposite to the print surface. The degree of blown-out highlights was evaluated based on the following criteria.

⊙: the area factor is 95% or more.

○: the area factor is 70% or more and less than 95%.

Δ: the area factor is 50% or more and less than 70%.

x: the area factor is less than 50%.

(Bonding Capability)

The transfer materials in the above-described examples and comparative examples were evaluated for the bonding capability. After the transfer material was thermocompression bonded to the image support, the bonding capability was evaluated based on the following criteria. For Examples 31 and 32, the ink receiving layer on the front surface of the transfer material and the heat seal layer on the back surface thereof were evaluated based on the following criteria. For Example 33 and Comparative Example 5, the surface condition of the print surface subjected to ink jet printing was observed with the microscope and evaluated based on the following criteria. The results of the evaluation are represented in Tables 2 to 5.

○: the print surface is properly transferred (bonded) to the image support, or the front surface of the print surface is completely covered with the adhesive.

Δ: the print surface is partly not transferred (bonded) to the image support, or a part of the front surface of the print surface is not completely covered with the adhesive.

x: the entire print surface fails to be transferred (bonded) to the image support, or the front surface of the print surface is not covered with the adhesive.

(Scratch Resistance of the Image)

For the scratch resistance of the image, the printed material with the second image printed thereon was tested using a Gakushin tester. The print surface of the printed material was scratched 50 times with sulfonic paper subjected to a 500-g load. For evaluation, the optical density of the image on the front surface of the printed material was measured using an optical reflective densiometer (trade name: "RD-918"; manufactured by GretagMacbeth), and a residual OD ratio was calculated in accordance with Equation (2). The results of the evaluation are represented in Tables 2 to 5.

$$\text{Residual OD ratio}=(\text{OD after tests}/\text{OD before tests})\times 100\% \quad (2)$$

○: the residual OD ratio is 80% or more.

Δ: the residual OD ratio is 50% or more or less than 80%.

x: the residual OD ratio is less than 50%.

TABLE 2

| | | Example 1 | Example 2 | Example 3 | Example 4 | Example 5 | Example 6 | Example 7 | Example 8 |
|---|---|---|---|---|---|---|---|---|---|
| | | transfer material 1 | | transfer material 2 | | transfer material 3 | | transfer material 4 | |
| state of bonding layer | | sea and islands | | sea and islands | | sea and islands | | sea and islands | |
| ink receiving layer | | air gap absorption type | | air gap absorption type | | air gap absorption type | | air gap absorption type | |
| substrate | image based on three-dimensional micro-structure | image printed | | image printed | | image printed | | image printed | |
| | width of each recess and protrusion (μm) | 30 | | 30 | | 30 | | 30 | |
| | height of each recess and protrusion (μm) | 3 | | 10 | | 0.5 | | 13 | |
| ink receiving layer | thickness (μm) | 15 | | 15 | | 15 | | 15 | |
| print | ink | resin dispersing pigment | dye | resin dispersing pigment | dye | resin dispersing pigment | dye | resin dispersing pigment | dye |
| evaluation | image characteristics (ink absorption speed) | ○ | ⊙ | ○ | ⊙ | ○ | ⊙ | Δ | ⊙ |
| | image based on three-dimensional micro-structure (visibility) | ○ | ○ | ○ | ○ | ○ | ○ | ○ | ○ |
| | bonding capability | ○ | ○ | ○ | ○ | ○ | ○ | ○ | ○ |
| | image storage stability (scratch resistance) | ○ | ○ | ○ | ○ | ○ | ○ | ○ | ○ |

TABLE 3

| | | Example 9 | Example 10 | Example 11 | Example 12 | Example 13 | Example 14 | Example 15 | Example 16 |
|---|---|---|---|---|---|---|---|---|---|
| | | transfer material 5 | | transfer material 6 | | transfer material 7 | | transfer material 8 | |
| state of front surface | | sea and islands | | sea and islands | | sea and islands | | sea and islands | |
| ink receiving layer | | air gap absorption type | | air gap absorption type | | air gap absorption type | | air gap absorption type | |
| substrate | image based on three-dimensional micro-structure | image printed | | image printed | | image printed | | image printed | |
| | width of each recess and protrusion (μm) | 30 | | 100 | | 0.5 | | 150 | |
| | height of each recess and protrusion (μm) | 0.4 | | 3 | | 3 | | 3 | |
| ink receiving | thickness (μm) | 15 | | 15 | | 15 | | 15 | |

TABLE 3-continued

| | | Example 9 | Example 10 | Example 11 | Example 12 | Example 13 | Example 14 | Example 15 | Example 16 |
|---|---|---|---|---|---|---|---|---|---|
| | | transfer material 5 | | transfer material 6 | | transfer material 7 | | transfer material 8 | |
| layer | | | | | | | | | |
| print | ink | resin dispersing pigment | dye | resin dispersing pigment | dye | resin dispersing pigment | dye | resin dispersing pigment | dye |
| evaluation | image characteristics (ink absorption speed) | ○ | ⊙ | ○ | ⊙ | ○ | ⊙ | ○ | ⊙ |
| | image based on three-dimensional micro-structure (visibility) | ○ | ○ | ○ | ○ | Δ | Δ | ○ | ○ |
| | bonding capability | ○ | ○ | ○ | ○ | ○ | ○ | ○ | ○ |
| | image storage stability (scratch resistance) | Δ | ○ | ○ | ○ | ○ | ○ | Δ | ○ |

TABLE 4

| | | Example 17 | Example 18 | Example 19 | Example 20 | Example 21 | Example 22 | Example 23 | Example 24 |
|---|---|---|---|---|---|---|---|---|---|
| | | transfer material 9 | | transfer material 10 | | transfer material 11 | | transfer material 1 | |
| state of front surface | | sea and islands | | sea and islands | | sea and islands | | sea and islands | |
| ink receiving layer | | air gap absorption type | | air gap absorption type | | air gap absorption type | | air gap absorption type | |
| substrate | image based on three-dimensional micro-structure | image printed | | image printed | | image printed | | image printed | |
| | width of each recess and protrusion (μm) | 0.4 | | 30 | | 30 | | 30 | |
| | height of each recess and protrusion (μm) | 3 | | 10 | | 3 | | 3 | |
| ink receiving layer | thickness (μm) | 15 | | 5 | | 15 | | 15 | |
| print | ink | resin dispersing pigment | dye | resin dispersing pigment | dye | resin dispersing pigment | dye | resin dispersing pigment | dye |
| evaluation | image characteristics (ink absorption speed) | ○ | ⊙ | Δ | Δ | ○ | ⊙ | ○ | ⊙ |
| | image based on three-dimensional micro-structure (visibility) | Δ | Δ | ○ | ○ | ○ | ○ | ○ | ○ |
| | bonding capability | ○ | ○ | ○ | ○ | ○ | ○ | ○ | ○ |
| | image storage stability (scratch resistance) | Δ | ○ | ○ | ○ | ○ | ○ | ○ | ○ |

TABLE 5

| | | Comparative Example 1 | Comparative Example 2 | Comparative Example 3 | Comparative Example 4 |
|---|---|---|---|---|---|
| | | transfer material 12 | | transfer material 13 | |
| | state of front surface | sea and islands | | sea and islands | |
| | ink receiving layer | air gap absorption type | | swelling type | |
| substrate | image based on three-dimensional micro-structure | no image | | image printed | |
| | width of each recess and protrusion (μm) | | | 30 | |
| | height of each recess and protrusion (μm) | | | 3 | |
| ink receiving layer | thickness (μm) | 15 | | 15 | |
| print | ink | resin dispersing pigment | dye | resin dispersing pigment | dye |
| evaluation | image characteristics (ink absorption speed) | ○ | ⊙ | X | X |
| | image based on three-dimensional micro-structure (visibility) | — | — | X | X |
| | bonding capability | ○ | ○ | X | X |
| | image storage stability (scratch resistance) | X | ○ | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-234907, filed Dec. 2, 2016, and No. 2017-194484, filed Oct. 4, 2017, which are hereby incorporated by reference wherein in their entirety.

What is claimed is:

1. A transfer material, including:

a substrate;

an ink receiving layer provided on the substrate, the ink receiving layer having an image based on a three-dimensional micro-structure; and an adhesive portion disposed on a first surface of the ink receiving layer that is not contacting the substrate, wherein the image based on the three-dimensional micro-structure comprises protruding portions that are facing the substrate and is formed on a second surface of the ink receiving layer that is contacting the substrate, wherein a width of the protruding portions is 10 μm or more and 100 μm or less, wherein an arithmetic mean height of the protruding portions is 500 nm or more and 10 μm or less, wherein an arithmetic mean height of an area without the protruding portions on the second surface of the ink receiving layer is 0.5 μm or less, wherein the arithmetic mean height of the area without the protruding portions is smaller than the arithmetic mean height of the protruding portions, wherein the ink receiving layer comprises inorganic particulates and a water-soluble resin, wherein an amount of the water-soluble resin is 3.3 to 20 pts.wt. relative to 100 pts.wt. of the inorganic particulates, wherein the adhesive portion includes adhesive particles that are aggregated, the adhesive portion being discretely disposed on the first surface of the ink receiving layer, and wherein the first surface of the ink receiving layer has (i) portions that contact the adhesive portion and (ii) exposed portions that do not contact the adhesive portion.

2. The transfer material according to claim 1, wherein the substrate has, on a surface thereof contacting the ink receiving layer, a three-dimensional micro-structure including recessed portions opposite to the protruding portions of the ink receiving layer.

3. The transfer material according to claim 1, wherein the substrate has a protective layer contacting the ink receiving layer.

4. The transfer material according to claim 1, wherein an area of the exposed portions is 50% or more of a total area of the ink receiving layer.

5. A manufacturing method for a printed material comprising:

a printing step of printing an image on the transfer material according to claim 1, by applying ink to the transfer material from the adhesive portion side; and a bonding step of bonding the transfer material with the image printed thereon and an image support, by pressurizing and heating the transfer material and the image support in a superposed state where the adhesive portion contacts to the image support.

6. The manufacturing method for the printed material according to claim 5, further comprising:

a peel-off step of peeling off the substrate from the transfer material bonded to the image support.

* * * * *